US008469541B2

(12) United States Patent
Walton

(10) Patent No.: US 8,469,541 B2
(45) Date of Patent: Jun. 25, 2013

(54) LIGHTING APPARATUS

(76) Inventor: Randal D. Walton, Reno, NV (US)

( * ) Notice: Subject to any disclaimer, the term of this patent is extended or adjusted under 35 U.S.C. 154(b) by 406 days.

(21) Appl. No.: 12/950,588

(22) Filed: Nov. 19, 2010

(65) Prior Publication Data

US 2011/0069494 A1 Mar. 24, 2011

Related U.S. Application Data

(63) Continuation-in-part of application No. 10/393,816, filed on Mar. 21, 2003, now Pat. No. 7,178,944, and a continuation-in-part of application No. 11/588,959, filed on Oct. 27, 2006, now Pat. No. 7,390,106, and a continuation-in-part of application No. 12/070,712, filed on May 21, 2010, now Pat. No. 7,748,871, and a continuation-in-part of application No. 12/717,051, filed on Mar. 3, 2010, and a continuation-in-part of application No. 12/768,717, filed on Apr. 27, 2010, and a continuation-in-part of application No. 12/813,851, filed on Jun. 11, 2010, and a continuation-in-part of application No. 12/835,919, filed on Jul. 14, 2010, and a continuation-in-part of application No. 12/869,739, filed on Aug. 26, 2010, and a continuation-in-part of application No. 12/892,721, filed on Sep. 28, 2010.

(51) Int. Cl.
*F21V 1/00* (2006.01)

(52) U.S. Cl.
USPC ..... 362/217.05; 362/217.07; 362/283; 362/306; 362/322

(58) Field of Classification Search
USPC ..... 362/217.05–217.07, 280–284, 296.01, 362/306, 322–324, 347
See application file for complete search history.

(56) References Cited

U.S. PATENT DOCUMENTS

| | | | | |
|---|---|---|---|---|
| 1,870,147 | A | | 8/1932 | Smally |
| D113,550 | S | | 2/1939 | Clark |
| 3,179,792 | A | | 4/1965 | Weiss |
| 3,558,873 | A | | 1/1971 | Smith |
| 4,074,124 | A | * | 2/1978 | Maute et al. ..... 362/217.02 |
| 6,033,092 | A | | 3/2000 | Simon |
| 6,068,388 | A | | 5/2000 | Walker et al. |

(Continued)

OTHER PUBLICATIONS

Atler, Lloyd, GE Announces High Efficiency Incandescent Light Bulbs. Why?, TreeHugger.com, Feb. 24, 2007, Toronto. Accessed Jan. 26, 2011.

(Continued)

*Primary Examiner* — Stephen F Husar
(74) *Attorney, Agent, or Firm* — Mohr Intellectual Property Law Solutions, PC

(57) ABSTRACT

Lighting apparatuses including a first endcap including a first light socket, a second endcap spaced from the first endcap including a second light socket, reflector rotatably attached between the first endcap and the second endcap, the reflector including a reflective surface partially enclosing a reflector interior space and defining a focal point within the reflector interior space. The first light socket and second light socket are collectively configured to support light sources substantially near the focal point. The first endcap and the reflector include complimentarily configured interlocking members.

20 Claims, 31 Drawing Sheets

U.S. PATENT DOCUMENTS

| | | | | |
|---|---|---|---|---|
| 6,291,936 | B1 | 9/2001 | MacLennan et al. | |
| 6,356,700 | B1 | 3/2002 | Strobl | |
| 7,390,106 | B2 | 6/2008 | Walton | |
| 8,016,456 | B2 * | 9/2011 | Paravantsos et al. | 362/282 |
| 2002/0149931 | A1 | 10/2002 | Chang | |
| 2010/0181892 | A1 | 7/2010 | Walton | |
| 2010/0207540 | A1 | 8/2010 | Walton | |
| 2010/0246188 | A1 | 9/2010 | Walton | |
| 2010/0277922 | A1 | 11/2010 | Walton | |
| 2010/0320930 | A1 | 12/2010 | Walton | |
| 2011/0012529 | A1 | 1/2011 | Walton | |

OTHER PUBLICATIONS

U.S. Patent & Trademark Office, Restriction Requirement, Oct. 4, 2004, U.S. Appl. No. 10/393,816.

U.S. Patent & Trademark Office, Office Action, Mar. 30, 2006, U.S. Appl. No. 10/393,816.

U.S. Patent & Trademark Office, Final Office Action, Aug. 9, 2006, U.S. Appl. No. 10/393,816.

U.S. Patent & Trademark Office, Notice of Allowance, Oct. 17, 2006, U.S. Appl. No. 10/393,816.

* cited by examiner

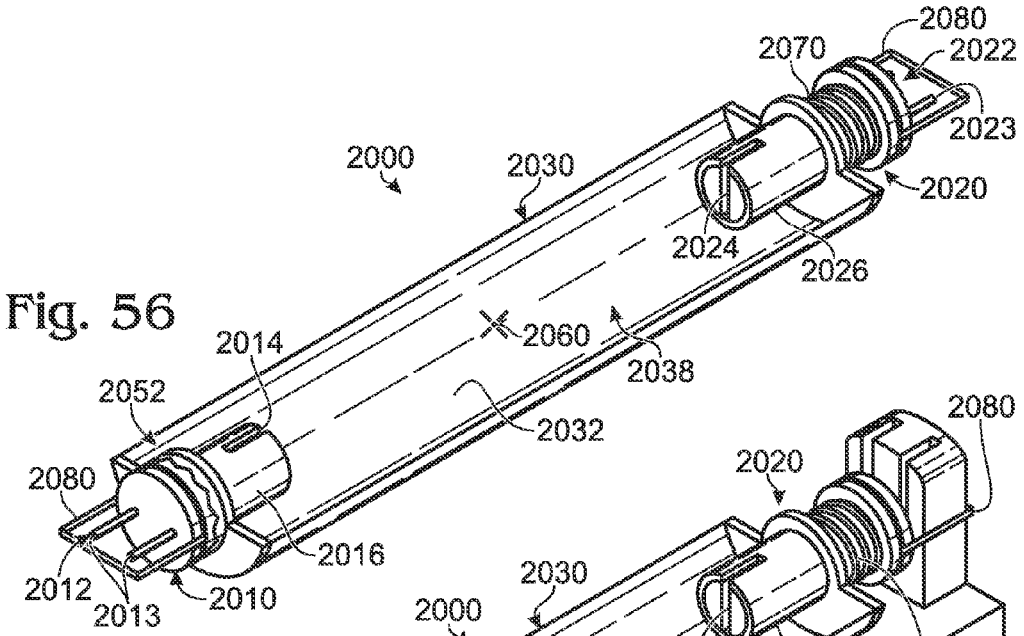
Fig. 56
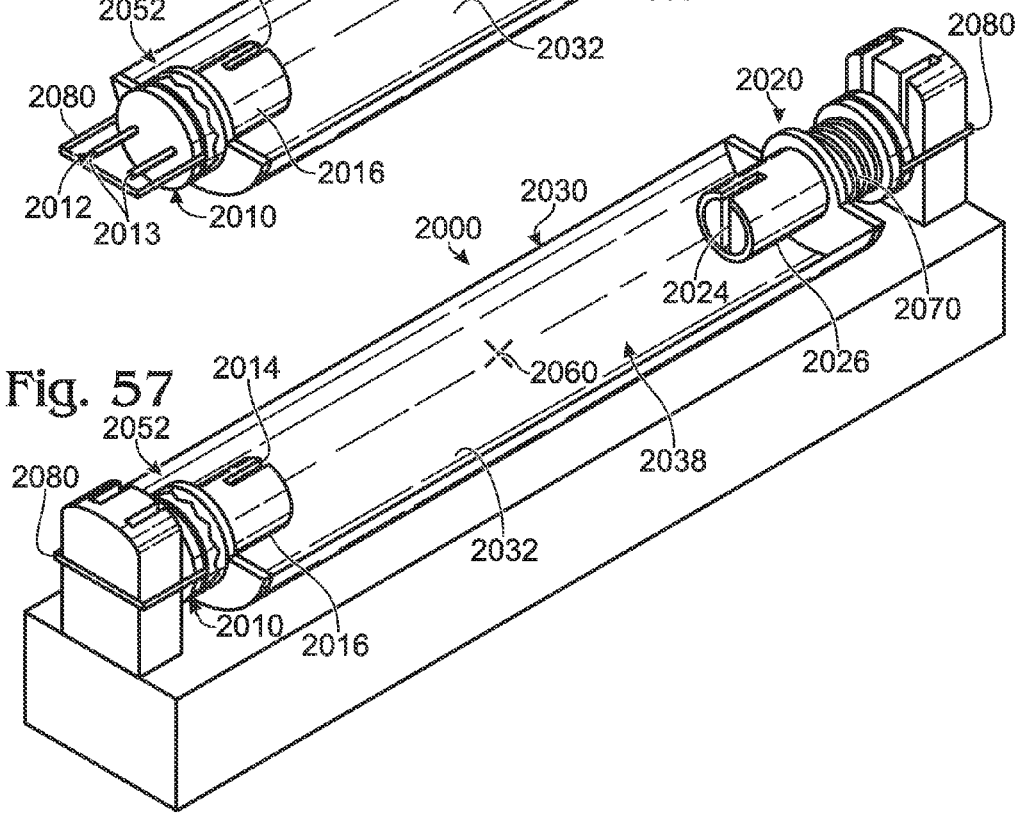
Fig. 57
Fig. 58
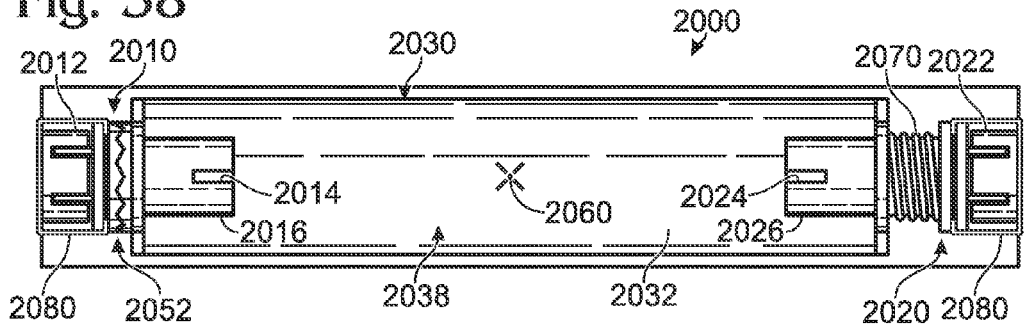

LIGHTING APPARATUS

CROSS-REFERENCE TO RELATED APPLICATIONS

This application is a continuation-in-part of, and claims priority to, copending applications:

Ser. No. 12/892,721, filed Sep. 28, 2010;

Ser. No. 12/869,739, filed Aug. 26, 2010;

Ser. No. 12/835,919, filed Jul. 12, 2010

Ser. No. 12/813,851, filed Jun. 11, 2010;

Ser. No. 12/768,717, now U.S. Patent Application Pub. No. 2010/0207540, filed Apr. 27, 2010;

Ser. No. 12/717,051, now U.S. Patent Application Pub. No. 2010/0181892, filed Mar. 3, 2010;

Ser. No. 12/070,712, now U.S. Pat. No. 7,748,871, filed Feb. 19, 2008;

Ser. No. 11/588,959, filed on Oct. 27, 2006, now U.S. Pat. No. 7,390,106; and

Ser. No. 10/393,816, filed on Mar. 21, 2003, now U.S. Pat. No. 7,178,944.

The disclosures of the cited related applications are incorporated herein by reference in their entirety for all purposes.

FIELD OF THE INVENTION

The instant invention may be considered to be in the field of lighting devices, specifically lamps of high intensity discharge and fluorescent lamps, but not limited thereto.

BACKGROUND OF INVENTION

Many industrial and commercial buildings have the burden of illuminating large areas from standard height as well as from higher than normal ceilings. One solution to this lighting application has been the use of high intensity discharge lamps. Mercury vapor, sodium and other high intensity discharge lamps in commercial applications may consume as much as 400 to 1000 watts, and generate an associated amount of heat, contributing to additional heating, ventilating and air conditioning ("HVAC") operation and tire protection considerations.

These lamps also utilize a certain time duration to warm up and achieve full illumination capability, resulting in time periods with less than desired lighting coverage. Such high intensity discharge lamps are also relatively expensive costing several hundreds of dollars per lamp.

Lamp manufacturers are constantly looking for ways to maximize the amount of foot candles of illumination which can be generated for a fixed amount of power consumption or wattage. These objectives have resulted in the evolution of high intensity discharge lamps which burn metallic vapors to achieve high lumen output.

A fairly common discharge lamp with a reflective lamp is disclosed in U.S. Pat. No. 6,291,936 B, issued Sep. 18, 2001 to MacLennan et al. Summarizing, the MacLennan patent discloses a discharge lamp including an envelope, a source of excitation power coupled to the fill for excitation thereof and thereby emit light, a reflector disposed around the envelope and defining an opening, and a reflector configured to reflect some of the light emitted by the fill back into the fill while allowing some light to exit through the opening. This description is typical of a high intensity discharge lamp. The high pressure sodium lamp emits the brightest light while metal halide and mercury vapor lamps emit about the same amount of light. For a lamp in the 400 W range, for example, a ballast which acts as the excitation for the fill may typically consume 40 to 58 watts.

Fluorescent lams are also used in commercial applications, often in offices and warehouses where a plurality of fluorescent tubes are positioned in front of a washboard-shaped, mirrored reflector. The purpose of the reflector is to reflect the light emitted upward back down toward the targeted illumination area. Fluorescent lamps differ from high intensity discharge lamps in that the "strike" time (the time to excite the interior of the lamp) is short—almost immediate, where the high intensity discharge lamps must warm up to full illumination. Fluorescent lamps also operate at a cooler temperature than do high intensity discharge lamps. The same approach may be applied to retrofitting existing installations in the commercial office environment.

Fluorescent lamps are also used in residential applications. A growing trend is the replacement of incandescent lamps with fluorescent lamps to achieve not only brighter light, but also savings in power consumption.

Lamps like the Sylvania ICETRON lamp are touted as having a 100,000 hour lamp life, or roughly five times the life of a standard high intensity discharge lamp. Consequently, with such added lamp life, the amount of maintenance required to change lamps in order to maintain illumination is reduced by 80%.

When one examines the shortcomings attendant to the use of high intensity discharge lamps and the advantages of fluorescent lamps, several observations result. By comparison, fluorescent lamps provide crisp white light in comparison to high intensity discharge lamps which offer unpleasant color and distracting color shift. Fluorescent lights my also be flexibly dimmed whereas high intensity discharge lights may not be operated below 50% output.

What is needed is a lamp which can illuminate a target area with the same amount of foot candles as a high intensity discharge lamp without consuming the same amount of energy, without requiring a warm-up period, and in operation generating less heat.

There exists a further need for high intensity discharge lamps which can illuminate a target area with the same amount of foot candles as a higher wattage, high intensity discharge lamp without consuming the same amount of energy.

Also, what is needed is a lamp which can illuminate a target area with the equivalent of foot candles as an incandescent lamp, but without consuming the same amount of energy.

Further, if the illuminating capability of a high intensity discharge lamp could be accomplished without the high capital cost associated with the purchase and operation of such lamps, the relative operating cost of illuminating industrial and commercial buildings would be reduced. The same can be said for the improvement of residential illuminations as well.

If such a lamp as described immediately above were developed, the cost of retrofitting fixtures with such lamps would be paid for relatively quickly by the associated savings from reductions in energy consumption.

One area of the art that remains to be fully developed is the optimal use of reflective surfaces to assist in directing light which would normally travel away from the targeted illumination area.

SUMMARY OF THE INVENTION

The present invention combines the advantages of compact fluorescent light tubes with reflective technology aimed at retrofitting high intensity discharge lamps in industrial and commercial applications. Applicant's invention also combines the advantages of high intensity discharge, incandescent and other light sources with reflective technology aimed at retrofitting each type of lamp for industrial, commercial, and residential applications.

By using a combination of cooler operating fluorescent tube lamps with concentrating reflective surfaces, an equivalent illumination result can be achieved at a reduction in energy consumption in the range of 40% to 74%. As a result of the much lower cost of a compact fluorescent lamp, multiple lamps may be used in combination to generate the equivalent illumination of a target area as that of high intensity discharge lamps.

The present invention utilizes reflective surfaces in a variety of ways to increase the intensity of light delivered to the target illumination area.

First, the lamp glass may be manufactured having a reflective surface to reflect light which would normally emanate away from the target illumination area back toward the target area, thereby increasing the amount of light delivered to said target illumination area ("TIA").

Second, a housing which is normally used for lamps such as a semi-conical or paraboloid-shaped high bay fixture, or a flat "washboard" type reflector may be retrofitted with a combination lamp and reflector which not only uses whatever reflective capability exists in the housing, but adds its own intensity focus factor to deliver light to the TIA, even delivering an equivalent amount of light at much less of a wattage rating (and thereof less power consumption) than the original lamp or lamps in the housing.

In a first embodiment of the present invention, a spiral fluorescent tube is combined with an interior reflector and a single secondary paraboloid reflector. A third reflector such as a semi-conical or paraboloid shape can be utilized by positioning the floodlight fixture at the focal point of said reflector. Important in this case is the distance between the tubes themselves as well as between each tube and its associated reflectors.

The importance stems from the amount of space needed to allow the reflector to bounce light back past the tubes and toward the TIA, and also the space needed for dissipation of heat. Convection allows cool air to be drawn past the fins and dissipating heat will protect the ballast. The compact fluorescent floodlight has a lens designed to precisely control the light from the reflector. It is covered with small, detailed shapes to direct the light into the desired beam pattern. The lens also acts as a cover to allow the lamp to act as it own fixture.

A second embodiment of applicant's invention employs an "implant" consisting of a spirally configured fluorescent or compact fluorescent lamp which is fitted with a reflective surface proximate to the interior portion of the lamp itself. This implant may be retrofitted into a conventional high-bay industrial fixture, thereby delivering an equivalent amount of light to the TIA with less wattage consumed. Each spiral lamp has proximate to it a primary reflector to re-direct light which might otherwise be "lost," meaning not directed to the TIA, and as well, a secondary reflector which helps direct the light to a third reflector which finally directs the focused light to the TIA.

A third embodiment of applicants invention employs a high intensity discharge compact fluorescent lamp consisting of an array of "spirally" configured fluorescent lamps, each fitted with a reflective surface proximate to the interior portion of the lamp itself. This "HID" may be retrofitted into a conventional high-bay industrial future, thereby delivering an equivalent amount of light to the TIA with less wattage consumed. As in the case of the second embodiment, each spiral lamp has proximate to it a primary reflector to re-direct light which might otherwise be "lost," meaning not directed to the TIA, and as well, a secondary reflector which helps direct the light to a third reflector which finally directs the focused light to the TIA. This triple reflective light fixture could be placed in a fourth semi-conical or paraboloid shape reflector and can be utilized by positioning the floodlight fixture at the focal point of said reflector to increase the foot candles at the TIA and reduce energy consumption. Fins allow cool air to be drawn in, dissipating heat and protecting the ballast. The compact fluorescent floodlight has a lens designed to precisely control the light from the reflector. It is covered with small, detailed shapes to direct the light into the desired beam pattern, but could also be smooth. The lens also acts as a cover to allow the lamp to act as its own fixture.

In a fourth embodiment, a plurality of spiral lamps having primary reflectors is positioned inside a plurality of secondary reflectors. This array is then positioned inside a single third reflector having its own focusing characteristics, thereby further optimizing the delivery of light to the TIA. Consistent with the applicant's approach, the array is positioned at the focal point of the third reflector.

In a fifth, or preferred embodiment, of the instant invention a light source positioned at the focal point of a reflective surface which optimizes the amount of light which is directed to the TIA. In this embodiment, a small wattage fluorescent tube is placed inside a second tube having a partially reflective surface and in some cases, a partial lens. An all-in-one open "said" Reflector Lamp can also be used by placing a smaller lamp at the focal point of said reflector. The placement of the smaller fluorescent tube is determined by the focal point of the second outer tube, thereby dependent upon the diameter of the second outer tube.

In a sixth embodiment of the present invention, a U-shaped tube is positioned at the focal point of a reflective surface thereby optimizing the amount of light which is directed to the TIA. Also, in this embodiment, a small wattage fluorescent tube is placed inside another tube or concave, open reflector having a partially reflective surface.

In a seventh embodiment of the instant invention, a high intensity discharge lamp employs a light source at the focal point of a reflective surface again optimizing the amount of light which is directed to the TIA. In this embodiment, a small wattage HID "said invention" Reflector Lamp is placed at the focal point of an outer second reflective surface. The placement of the small light source is again determined by the focal point of the bulb.

In another embodiment, an incandescent lamp employs a light source at the focal point of a reflective surface which optimizes the amount of light which is directed to the TIA. In this embodiment, a small wattage incandescent "same said" Reflector Lamp is placed at the focal point of an outer second reflective surface. The placement of the small light source is determined by the focal point of the bulb.

As one can see, a variety of different shaped lamps can be positioned in the focal point of a reflective surface, even taking advantage of a reflective surface with multiple facets, thereby increasing the amount of light reflected toward the TIA. The placement of the light is typically determined by the focal point of the reflector, thereby dependant upon its diameter. The resultant light delivered to the TIA is consistent with the values expressed in Tables A, B, and C.

The focal point is determined using the formulas developed to describe light reflected from a concave mirror. The equation may be expressed as $f=R/2$, where R is the radius of the mirror (in the case of the preferred embodiment, the outer tube) and f is the focal length, or the distance from the mirror where the light source should be placed for optimal reflection.

Graph 1 shown in FIG. 16 illustrates how the various types of lamps; i.e., fluorescent, halogen, mercury vapor and high pressure sodium compare with one another. As can be seen from the table, the fluorescent bulb has a higher color rendition index, or "CRI" than other lamp media utilizing the same wattage rating of power consumption.

Graph 2 shown in FIG. 17 shows the asymptotic relationship between an object's distance from the focal point of a reflector and the associated magnification.

Summarizing, the embodiments shown herein comprise seven examples of applicant's invention:

First, a compact or fluorescent lamp such as that already available on the open market, be it spiral, U-shaped, or other configuration, is fitted with a conical (or a variety of other shapes such as concave, or a flat washboard) reflector proximate to the exterior of the lamp glass itself. The purpose of the reflector is to redirect light toward the TIA which would normally scatter in all directions. This Reflector Lamp combination may also be used in conjunction with a single secondary reflector in a combination akin to what is commonly referred to as a floodlamp type apparatus. Positioning of the lamp or lamps in said secondary reflectors proximate to the focal points thereof is advantageously employed.

Second, an embodiment comprising a plurality of spiral fluorescent or compact fluorescent lamps each having a primary reflector is positioned inside a secondary reflector at the focal point forming an array. In this embodiment, a third reflector is employed at the focal point to provide additional direction or focusing of light toward the TIA.

The third embodiment utilizes a small fluorescent tube of low wattage placed proximate to the focal point of a larger tube having, in the preferred embodiment, a reflective hemisphere acting as a primary reflector. In this configuration, light may be directed with substantial increased intensity to the TIA, and when used with a secondary reflector, may provide even more intensity to the TIA.

The fourth embodiment utilizes the amount of space needed for reflector and tubes to allow cool air to flow past the space between reflector and tubes as heat dissipates. Fin spacing allows cool air to pass the fins thereby dissipating heat. Over heating will deteriorate lamp life of the fluorescent ballast.

A fifth embodiment of applicant's invention comprises, the compact fluorescent floodlight with a lens designed to precisely control the light emanating from the reflector. Although it could be smooth, the lens is covered with small, detailed shapes to direct the light into the desired beam pattern. The lens also acts as a cover to allow the lamp to act as its own fixture.

A sixth embodiment of applicant's invention comprises, high-intensity discharge lamps with a light emitting source at the focal point of a reflective surface which optimizes the amount of light directed to the TIA. High pressure sodium is one of the most efficient HID sources available today. These lamps are used for general lighting applications where high efficiency and long life are desired while color rendering is not critical. Typical applications include street lighting, industrial hi-bay lighting, parking lot lighting, building floodlighting and general area lighting. The placement of the small light emitting source is determined to be at the focal point of the reflective hemisphere of the outer tube, thereby being determined by said outer tubes diameter.

A seventh embodiment of applicant's invention comprises incandescent lamps with a light emitting source at the focal point of a reflective surface, which optimizes the amount of light directed to the TIA. The placement of the small light emitting source is determined to be at the focal point of the reflective hemisphere of the outer tube, thereby being determined by said outer tubes diameter.

BRIEF DESCRIPTION OF THE DRAWINGS

FIG. 56 is a perspective view of a first example of an adapter for lighting apparatuses.

FIG. 57 is a perspective view of the adapter for lighting apparatuses shown in FIG. 1 depicting the adapter in use within a lighting fixture.

FIG. 58 is a top view of the adapter for lighting apparatuses shown in FIG. 1.

DETAILED DESCRIPTION OF THE INVENTION

Figure 1:
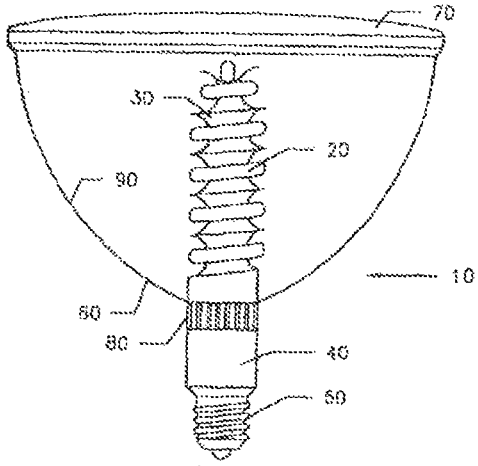
FIG. 1 is a side view of the first embodiment showing a spiral compact fluorescent tube at the focal point of a primary reflector proximate thereto and positioned at the focal point of a secondary reflector, in a configuration commonly referred to as a "floodlight;"

As seen in FIG. 1, a flood light 10 comprises a spiral compact fluorescent lamp 20 around which a primary reflector 30 is positioned. A first bonding means, such as glue or other adhesive or mechanical means is employed to fix lamp 20 and primary reflector 30 in a predetermined position. Lamp 20 is constructed in accordance with typical fluorescent lamps, comprising phosphor coating applied to the inside of the tube with hot cathodes at each end of the lamp. Air is exhausted through the exhaust tube during manufacture and an inert gas is introduced into the bulb. A minute quantity of liquid mercury is included gas, the gas is usually argon. The stem press has lead-in-wires connecting the base pins and carry the current to and from the cathodes and the mercury arc. Reflector 30 may be fashioned from a variety of materials including but not limited to chrome-plated glass, chrome-plated metal, polished or painted aluminum plate, painted glass, and painted plastic with a variety of reflective coatings. When utilizing molded metal for reflector 30, "mirro 4," "mirro 27" or white reflective aluminum may be selected. Commonly configured, a ballast housing 40, contains a ballast of either electrical or magnetic type, said ballast having a connecting means for electrical connection to lamp 20 and screw plug 50. A second bonding mean is necessary to attach housing 40 to lamp 20. While a bonding means in specified, other means, mechanical or otherwise, may be employed. In addition, ballast housing 40 and screw plug 50 could be fashioned as one unit rather than as separate structures, said unit having either glass, plastic, ceramic or other typical construction known in the art. The area of ballast housing 40 through screw plug 50 is typically fashioned from brass. A secondary reflector 60 in combination with a lens 70 encloses the lighting apparatus. Lens 70 can be made of glass or plastic. Fins 80 are provided on ballast housing 40 to assist in the dissipation of heat.

Secondary reflector 60, in the preferred embodiment, is of paraboloid shape, with its inner surface having a reflective coating 90 said reflector may be fashioned typically from glass, plastic, or metal.

Figure 2:
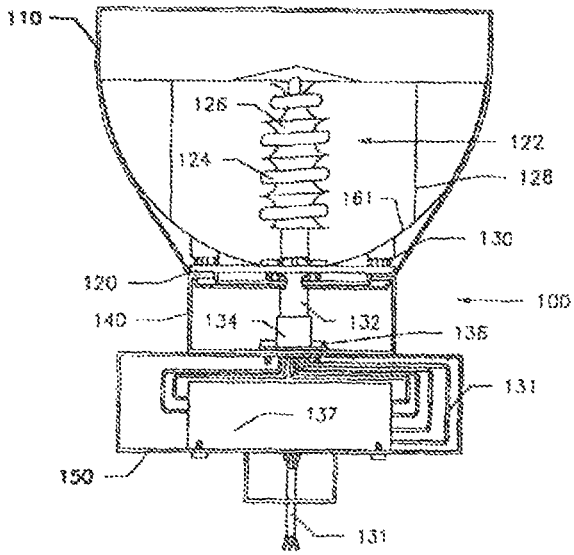
FIG. 2 is a side view of the second embodiment of applicant's invention, disclosing a plurality of spiral fluorescent tubes having primary reflectors positioned as an array and having also secondary reflectors, said array positioned in a third reflector each at its focal point.

FIG. 2 discloses an embodiment 100 of applicant's invention which is primarily employed as a retrofit of existing high bay fixtures. The common housing 110 provides a dual function as a support for a frame 120, said frame fashioned to hold an array 122 of fluorescent lamps 124 having primary reflectors 126. Array 122 further comprises a secondary reflector 128 commonly of assembled sections. Assembled sections are put into third reflector 161. Electrical connections 130, to which electrical wires 131 are attached, are positioned below frame 120 and are fed through a platform 132 and through a transition piece 134, to a fastening means 136. Fastening means 136 fixes secondary housing 140 and therefore housing 110, to a ballast housing 150, through which the electrical wires 131 again pass. These electrical wires may be hard wired to a lighting circuit.

When utilizing embodiment number two for retrofitting a typical high bay fixture such as that disclosed in U.S. Pat. No. 6,068,388 (See sheet 1 of 6), the capacitor and igniter in part 12 are replaced with a ballast. The wiring is kept along with the structure there above. The core and coil which housed in the space adjacent to part 12 is removed. Part 12 may be then fastened to secondary housing 18, each of which can be utilized in addition to reflector 21. All other numbered parts are replaced by those items listed above and below and shown in FIG. 2 and FIG. 3.

A typical high hay fixture can be retrofitted, the capacitor and igniter are replaced with an appropriate capacitor and igniter for a lower wattage high pressure sodium, metal halide, or mercury vapor lamps. The wiring is kept along with the structure thereabove. The core and coil which is housed in the space adjacent to part 12 shown above in U.S. Pat. No. 6,068,388 is replaced with the appropriate core and coil for the lower wattage lamp. All other numbered parts are replaced by those items listed below as shown in FIG. 2 and FIG. 3.

Figure 3:
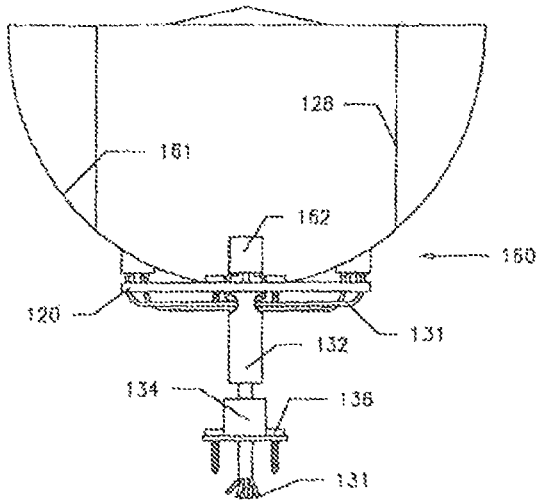
FIG. 3 is a side view of the aforementioned "implant," which may be utilized with a variety of light sources such as the spiral fluorescent tube with primary reflector and beyond, and which may be used to retrofit existing high bay fixtures.
Figure 4:
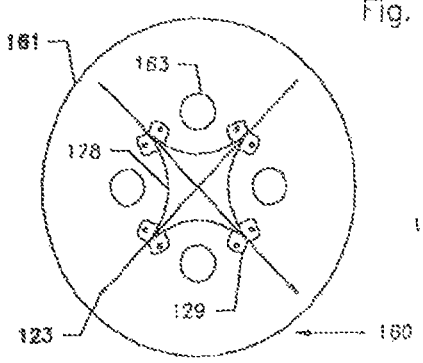
FIG. 4 is a top view of the invention of FIG. 3, further showing the orientation of secondary and third reflectors.

FIG. 3 discloses "implant" 160, described above, provided also with a third reflective mirror-like surface 161. The third reflector could also be used as a secondary reflector 161 in cases where existing technology lamps are used. The implant may be set into an existing high bay enclosure for retrofitting. The height of the implants third reflector depends on condition of reflector 110. Light sockets 162 are provided to accept lamps or other light sources as previously described, and are typically of ceramic construction. As seen in FIG. 4, access holes 163 are provided in reflector 161, allowing for the installation of light source 122, also facilitating the passage of air through holes 163.

Figure 5:
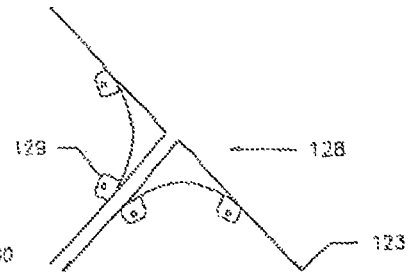
FIG. 5 is a top view of the secondary reflector of the invention disclosed in FIG. 3.

FIG. 5 further discloses secondary reflector 128, and tabs 129, used to fasten the reflector to reflector 161 of FIG. 4, typically by rivets or equivalent means. Folded metal slips 123 slip reflectors 128 together.

Figure 6:
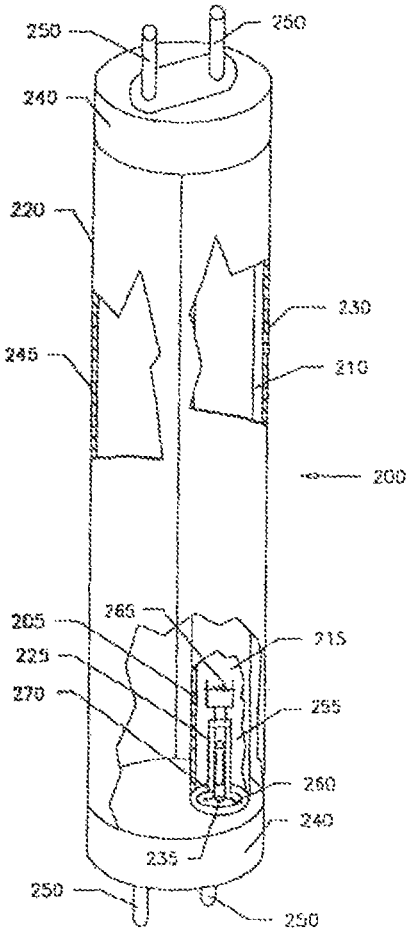
FIG. 6 is a side view of the fifth embodiment of applicant's invention, disclosing a smaller fluorescent tube proximate to the focal point of a larger cylindrical enclosure having a reflective hemisphere and manufactured as one piece.

FIG. 6 shows what appears on the surface to be a standard fluorescent tube. However, FIG. 6 depicts a lighting apparatus 200, which comprises a first fluorescent tube 210. First fluorescent tube may include a bulb 255 with Phosphor coating inside the bulb 255. Cathodes 265 at each end of lamp are coated with emissive materials which emit electrons. Air is exhausted through a tube 270 during manufacture and a minute quantity of liquid mercury 205 is place in the bulb to furnish mercury vapor. Gas 215, usually comprises Argon or a mixture of inert gases at low pressure, but Krypton is sometimes used. Stem Press 225 includes lead-in wires that have an air tight seal here and are made of specific wire to assure about the same coefficient of expansion as the glass. Lead-in wires 235 connect to the base pins and carry the current to and from the cathodes and the mercury arc. The first fluorescent tube 210 housed in a larger cylindrical housing 220. Housing 220 is usually a straight glass tube, but may also be circular or U-shaped, and may be made of plastic, glass or other suitable material. Housing 220 has a reflective hemisphere 230, at the focal point of which is located tube 210, serving as a primary reflector. Several different types of base 240 used to connect the lamp to the electric circuit and to support the lamp in the lamp holder serve to position tube 210 in proper position in housing 220, and further provide penetrations whereby pins 250 may be in electrical contact with the circuitry 260 of tube 210. Of course, the primary reflective surface of hemisphere 230 is provided on the inside or outside of housing 220, which provides reflective capability for light emitted from tube 210. Lens 245 may be smooth, but could be designed to precisely control the light from the reflector. It is covered with small, detailed shapes to direct the light into the desired beam pattern. The lens also acts as a cover to allow the lamp to act as it own fixture. A common material for lens 245 can be glass or plastic or other suitable materials. Reflector 230 could also not be enclosed to save on material costs.

Lighting apparatus 200 depicted in FIG. 6 may be manufactured as one unit or the different elements of lighting apparatus 200 may be used separately with an adapter. The benefit of these separate elements is that standard "T5" units or equivalent fluorescent lamps can be replaced, but the other parts will continually last and not need replacement.

For example, base 240 and pins 250 may be in electrical contact with the circuitry of a tombstone. The tombstone positioned at the focal point of the base hemisphere 240 can hold the smaller pins used in T5 fluorescent lamps. Several different types of lamp pins maybe used to connect lamp 210 and the tombstone. Common materials for the adaptor tombstone, pins, and connectors could be metal, ceramic, plastic, or the equivalent.

Housing 220 of FIG. 6 may be provided in a number of suitable configurations, including a larger cylindrical housing. Housing 220 has a reflective hemisphere 230 with lens cover 245. Some common materials that could be used for housing 220 may be glass or plastic, or other suitable materials commonly employed in the art.

The fluorescent tube may also be combined with bases 240, pins 250, and fluorescent tube 210 as one unit.

Additionally or alternatively, lighting apparatus 200 may include enclosure caps and end caps with slots to hold pins 250 in place. Lighting apparatus 200 may also be employed in a secondary reflector, such as a wash board type reflective housing, thereby giving additional reflective assistance in delivering light to a target illumination area.

In lighting apparatus 200 depicted in FIG. 6 and disclosed hereinabove, standard type electrical connections including ballasts, sockets, and standard wiring are employed. Applicant's invention focuses primarily on the reflective aspects of providing additional light to a TIA, resulting in more lighting where desired with conservation of energy.

Figure 6A:
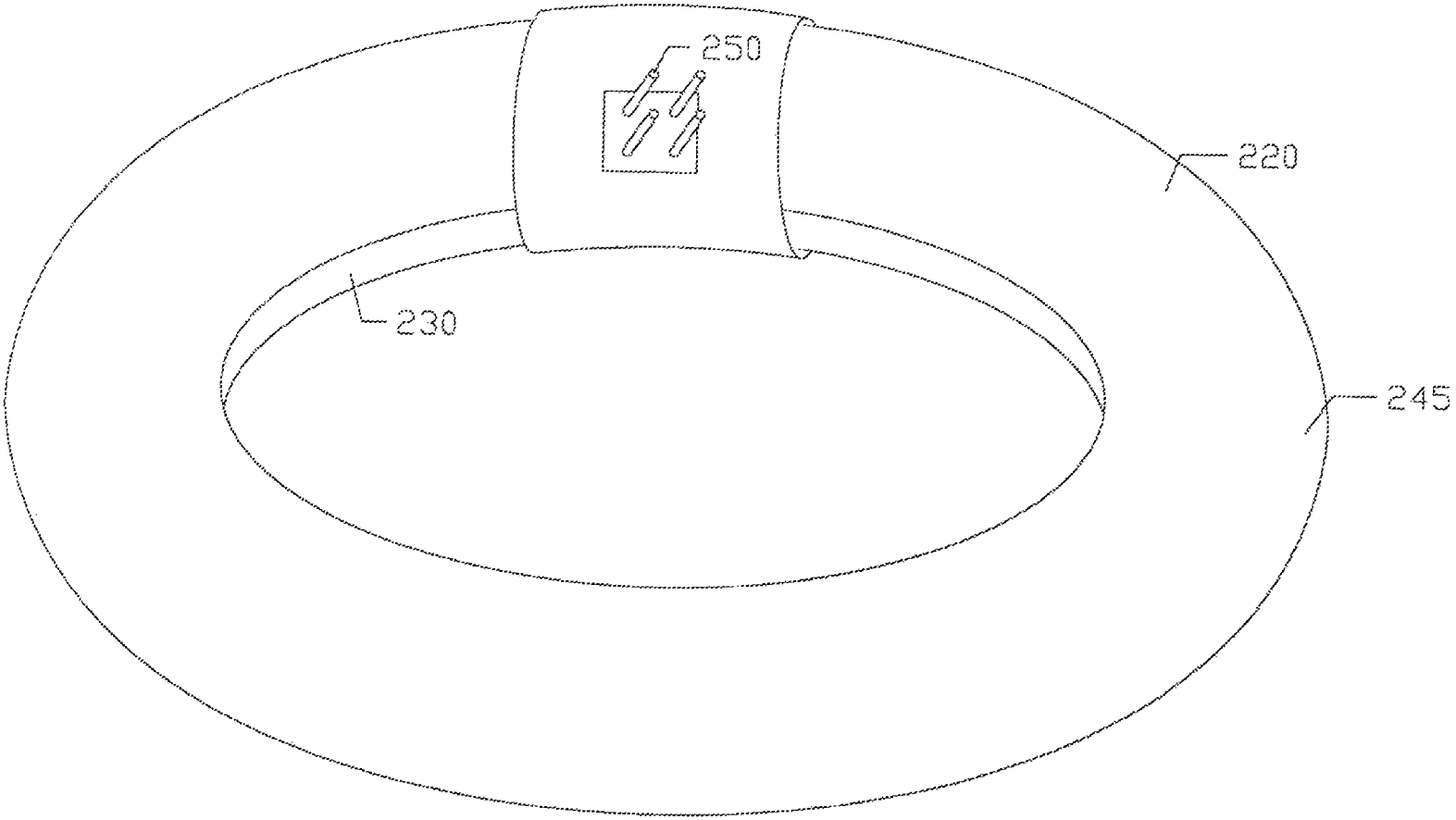
FIG. 6A is a side view of the lighting apparatus of FIG. 6 having a tubular housing of a circular shape.
Figure 6B:
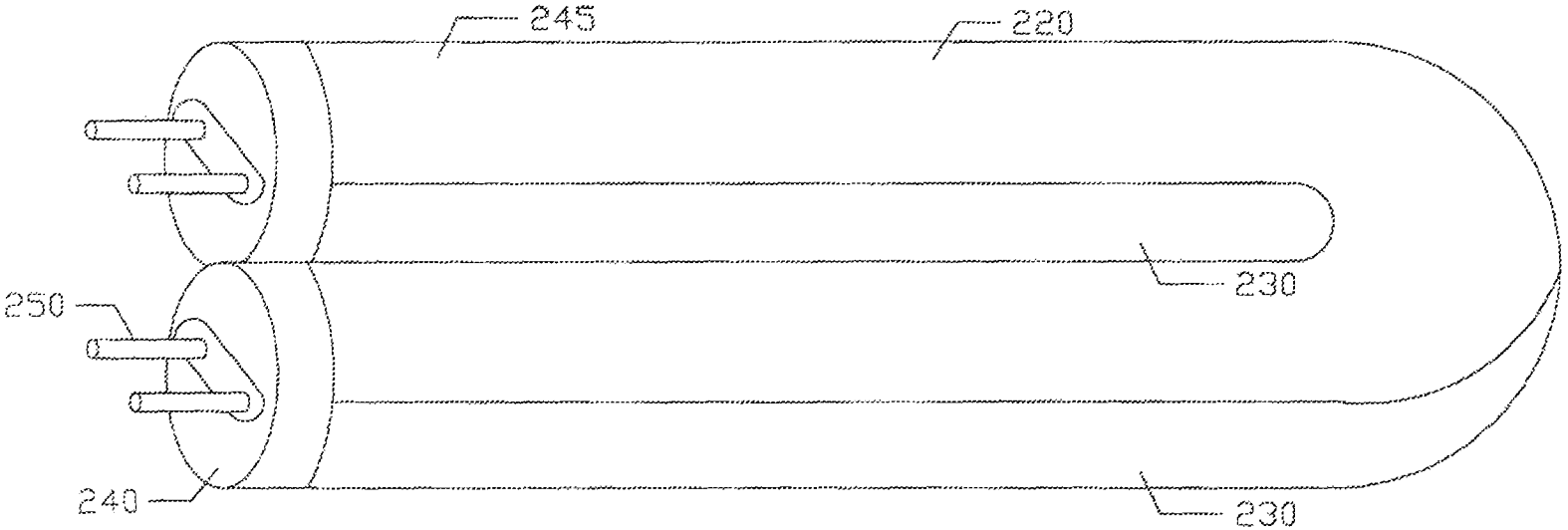
FIG. 6B is a side view of the lighting apparatus of FIG. 6 having a tubular housing of a U-shape.

FIGS. 6A and 6B depict the housing 220 shown in FIG. 6 in circular and U-shapes, respectively, as discussed above.

Figure 7:
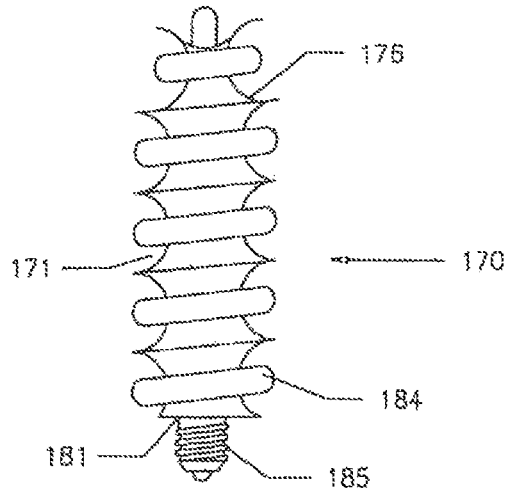
FIG. 7 is a side view of the aforementioned spiral compact fluorescent or fluorescent lamp, disclosing a smaller fluorescent spiral tube proximate to the focal point of a larger concave spiral reflector.

FIG. 7 discloses spiral compact fluorescent (or fluorescent lamp) 170 comprising a spiral compact fluorescent lamp 184 around which a primary reflector 176 is positioned. A first bonding means, such as glue or other adhesive or mechanical means is employ to fix lamp 184 and primary reflector 176 in a predetermined position. Ballast housing 181 for compact fluorescent lamp (or no ballast housing 181 for fluorescent lamp without ballast). In addition, housing 181 and screw plug 185 could be fashioned as one unit rather than as separate structures. Also air space 171, as heat dissipates cool air is drawn into space 171 cooling housing 181 and reflector 176.

Figure 8:
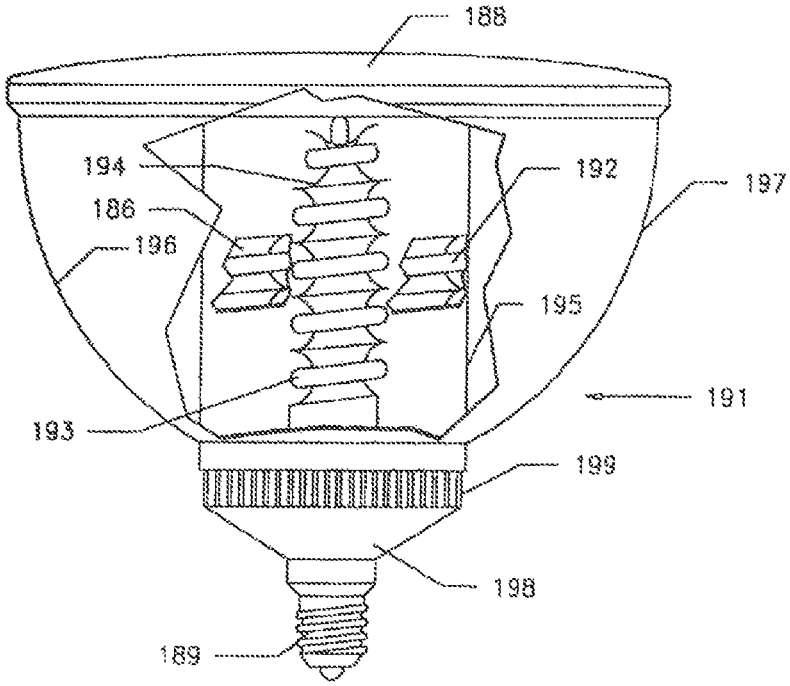
FIG. 8 is a side view of the aforementioned "HID" compact fluorescent lamp with an array of spiral fluorescent tubes with primary, secondary and third reflectors in a configuration commonly referred to as a "floodlight;"

FIG. 8 discloses the "HID" fluorescent lamp 191, of applicant's invention which is primarily employed as a retrofit of existing high bay fixtures. HID fluorescent lamp 191 holds an array 192 of fluorescent lamps 193 having primary reflectors 194. The array 192 further comprises a secondary reflector 195 commonly of assembled sections or one molded piece slips into a third reflective mirror-like surface 196 which is coated with a reflective material. The paraboloid shape housing 197 is made up of material like glass or plastic or other suitable equivalents. A variety of reflective materials may be used for reflectors 194, 195, and 196 including but not limited to chrome-plated glass, chrome-plated metal, polished or painted aluminum plate, painted glass, and plastic painted with a variety of reflective coatings. When utilizing molded metal for reflectors 194, 195, and 196 "mirro 4", "mirro 27" or white reflective aluminum may be selected. A first bonding means, such as glue or other adhesive or mechanical means is employed to fix lamp array 192 and primary reflector array 186 in a predetermined position relative to secondary 195 and third 196 reflectors housing. Commonly configured, a ballast housing 198, contains a ballast of either electrical or magnetic type, said ballast having a connecting means for electrical connection with lamp 193 and screw plug 189. A second bonding means is necessary to attach housing 198 to housing 197. Fins 199 are provided on ballast housing 198 to assist in dissipation of heat. A smooth lens 188 or a lens 188 designed to precisely control the light from the reflector is provided. Lens 188 covered with small, detailed shapes to direct the light into the desired beam pattern. The lens also acts as a cover to allow the lamp to act as its own fixture.

Figure 9:
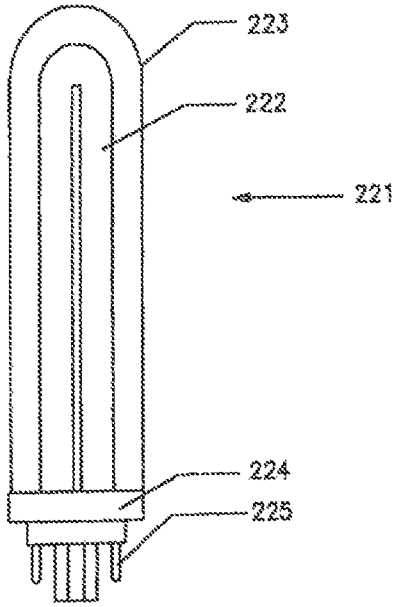
FIG. 9 is a side view of the invention, disclosing smaller U-shaped fluorescent tube proximate to the focal point of an enclosed partially reflective tube or concave open reflector.

FIG. 9 shows a U-shaped fluorescent lamp 221 with tube 222 in a predetermined positioned of reflective surface 223. Tube 222 and reflector 223 are bonded to base 224 by glue or other mechanical means. Pin 225 and base 224 can be manufactured as one unit or as separate pieces. Many types of base 224 are used on the open market.

Figure 10:
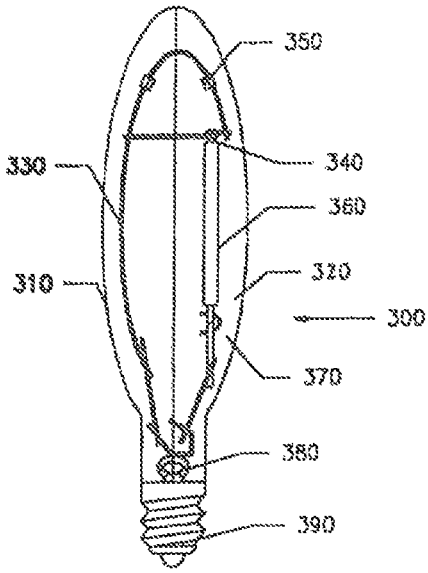
FIG. 10 is a side view of the invention, disclosing the HID high pressure sodium lamp with part of the glass envelope having reflective surface.

FIG. 10 discloses a high pressure sodium Lamp ("HPS") 300 comprising a glass envelope 310 having a substantially concave reflective surface 320. An arc tube 340, with hermetic end seal 360, typically an alumina arc tube or equivalent, is located proximate to the focal point of reflector 320 via a frame 330, usually steel. A residue gas repository 380 is positioned in lamp 300 on a base 390, where it is affixed in its location, and serves to support frame 330. Brass base 390 secures lamp 300 to a suitable light fixture and connects the light fixture's electric circuitry to the lamp. This lamp is made up of glass, metals, or other suitable materials commonly employed in the art.

Figure 11:
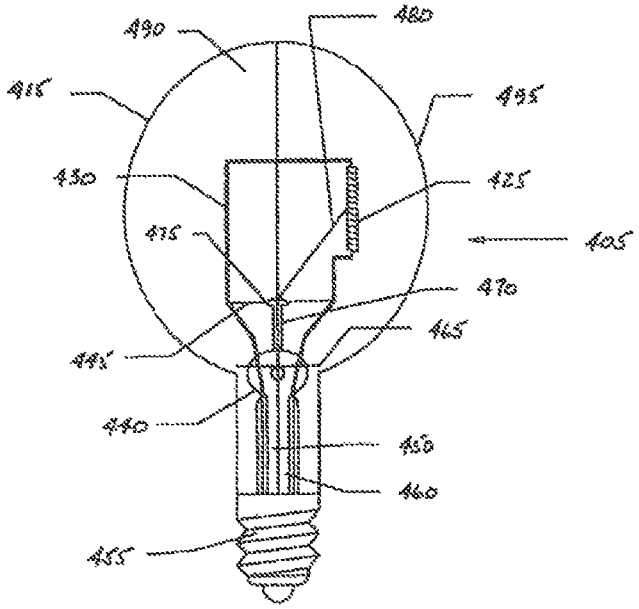
FIG. 11 is a side view of the invention, disclosing an incandescent lamp with part of the glass bulb as a reflective surface.

FIG. 11 shows an incandescent lamp 405 comprising a soft glass envelope 415. Filament 425, generally tungsten is electrically connected by wires 430 to a glass stem press 440. Wires 430 are made typically or nickel-plated copper or nickel from stem press 440 to filament 425. Tie wires 445 support wires 435 in the largest envelope area. Wires 430 pass through stem press 440, and an air evacuation tube 450 toward a base 455. In this stem press area, wires 430 transition from nickel-plated copper or nickel to a nickel-iron alloy core and a copper sleeve (Dumet wire). In this area, there exists an air tight seal at the termination of tube 450, said wires' material change made to assure about the same coefficient of expansion of the wires as the glass, and air exhaust tube 450. Base 455 is made of brass or aluminum. A fuse 460 protects the lamp and circuit if filament 425 arcs. A heat deflector 465 is used in higher wattage general service lamps and other types when needed to reduce circulation of hot gases into neck of bulb.

Glass button rod 470 projects from stem press 440 and supports button 475. Button 475 has affixed thereto support wires 481 and 485. Gas 490 a mixture of nitrogen and argon is used in most lamps 40 watts and over to retard evaporation of the filament 425. A coating is applied to glass envelope 415, creating a substantially sphere-shaped reflective surface 495. Filament 425 is located proximate to the focal point of surface 495. The lamp is made of material like glass or plastic or other suitable equivalents.

Figure 12:
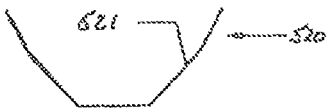
FIG. 12 is a side view of the aforementioned "reflector", disclosing a concave reflector.

FIG. 12, discloses reflector 500, a concave reflector 501, made of a variety of reflective materials including but not limited to chrome-plated glass, chrome-plated metal, polished or painted aluminum plate, painted glass, and plastic painted with a variety of reflective coatings. When utilizing molded metal for reflector 500 "mirro 4", "mirro 27" or white reflective aluminum may be selected or other suitable equivalents.

Figure 13:
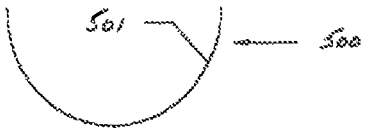
FIG. 13 is a side view of the aforementioned "reflector", disclosing a W-Shape reflector.

FIG. 13, discloses reflector 510, a W-shape reflector 511, again fashioned from a variety of reflective materials as mentioned in FIG. 12.

Figure 14:
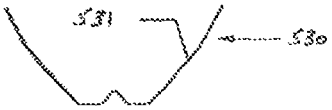
FIG. 14 is a side view of the aforementioned "reflector", disclosing a wash board reflector.

FIG. 14, discloses reflector 520, and a wash board shape reflector 521, again made from a variety of reflective materials as mentioned in FIG. 12.

Figure 15:
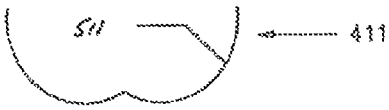
FIG. 15 is a side view of the aforementioned "reflector", disclosing a wash board shaped reflector.

FIG. 15, discloses reflector 530, and a wash board shape reflector 531, both made from a variety of reflective materials as mentioned in FIG. 12.

Figure 16:
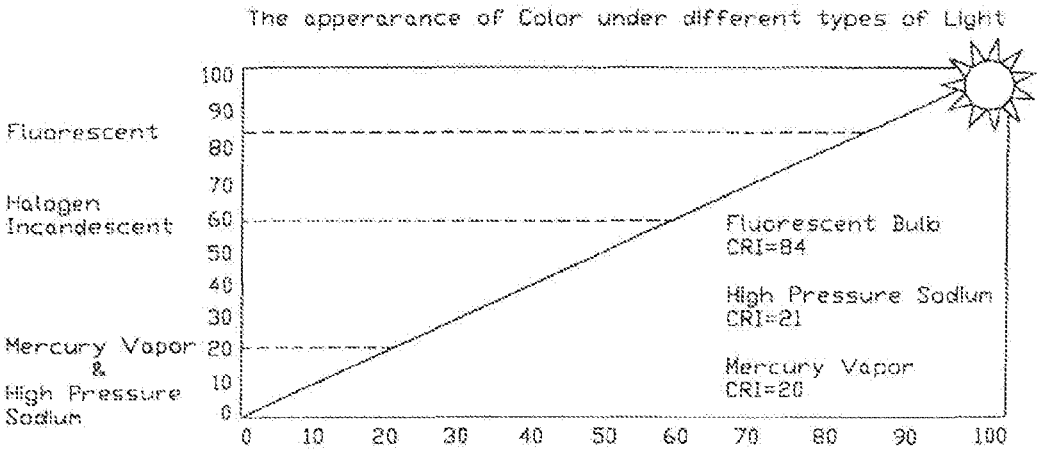
FIG. 16 is a graph showing the appearance of color under different types of light.

FIG. 16 is a graph showing the appearance of color under different types of light.

Figure 17:
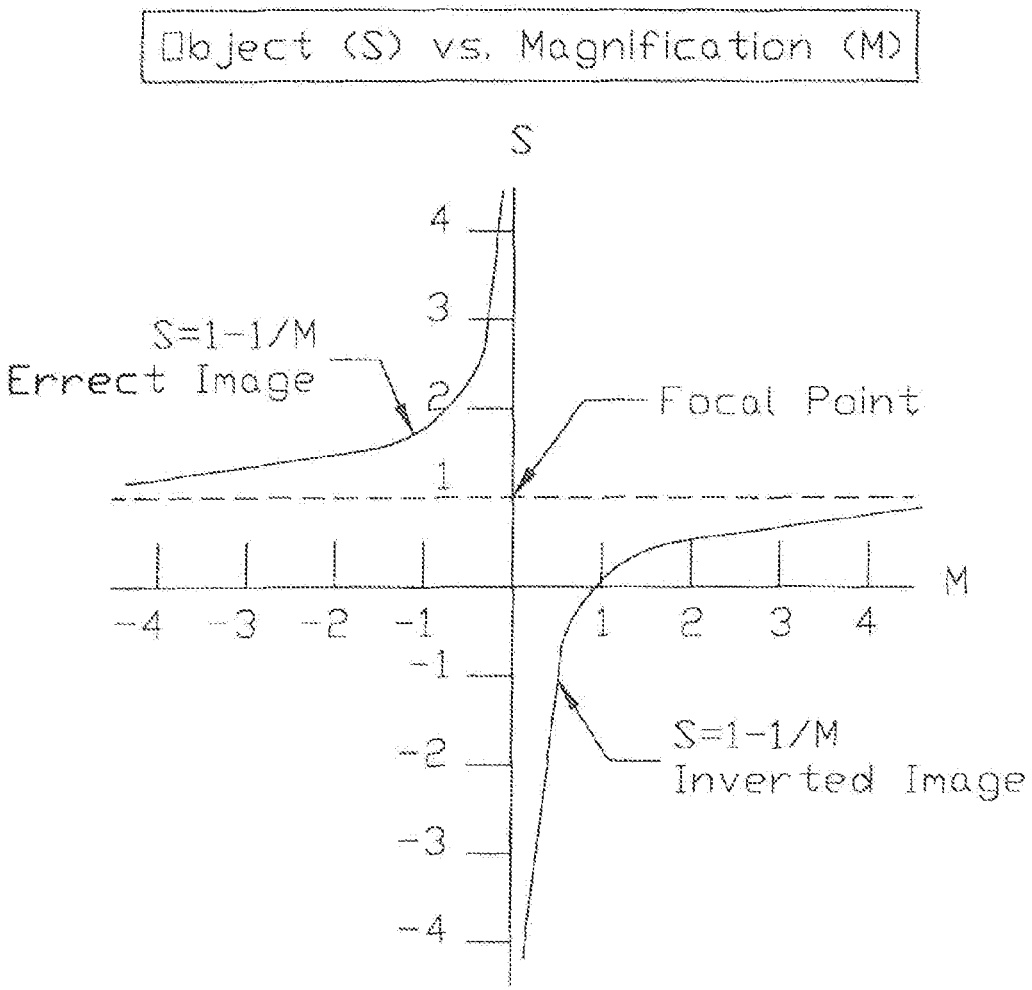
FIG. 17 is a graph showing the relationship between an object and magnification.

FIG. 17 is a graph showing the relationship between an object and magnification.

Figure 18:
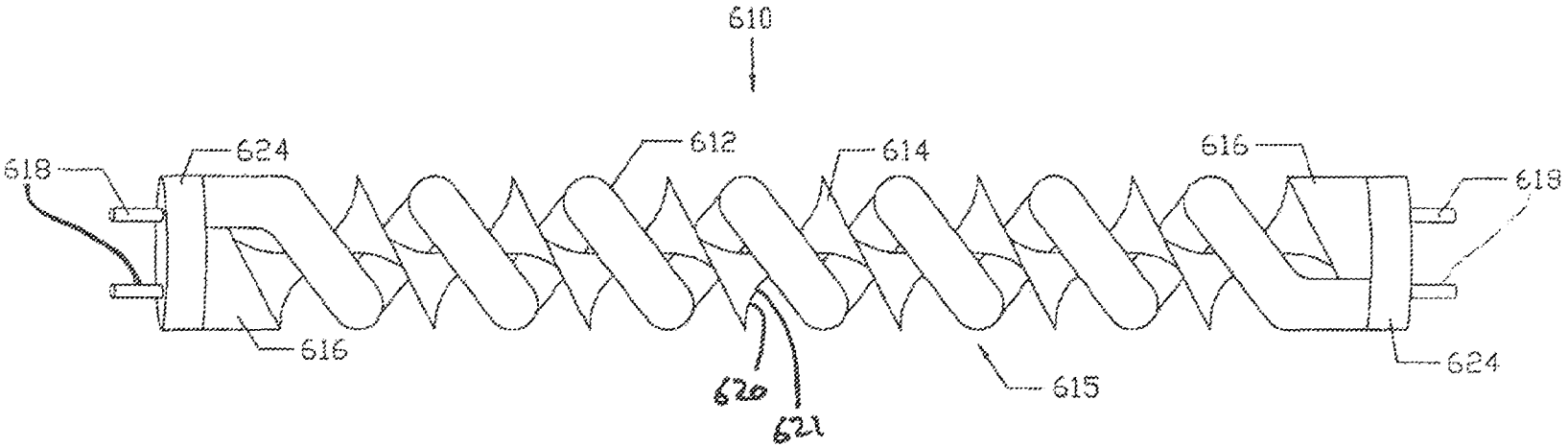
FIG. 18 is a side view of an illumination device with a light source coiled around a primary reflector.
Figure 19:
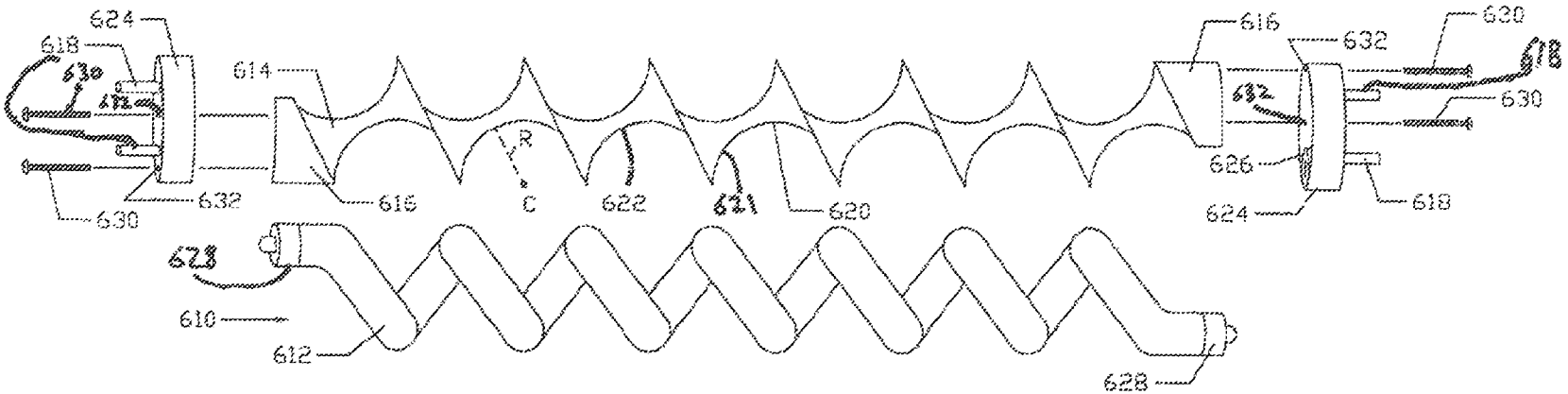
FIG. 19 is an exploded view of the illumination device of FIG. 18.
Figure 20:
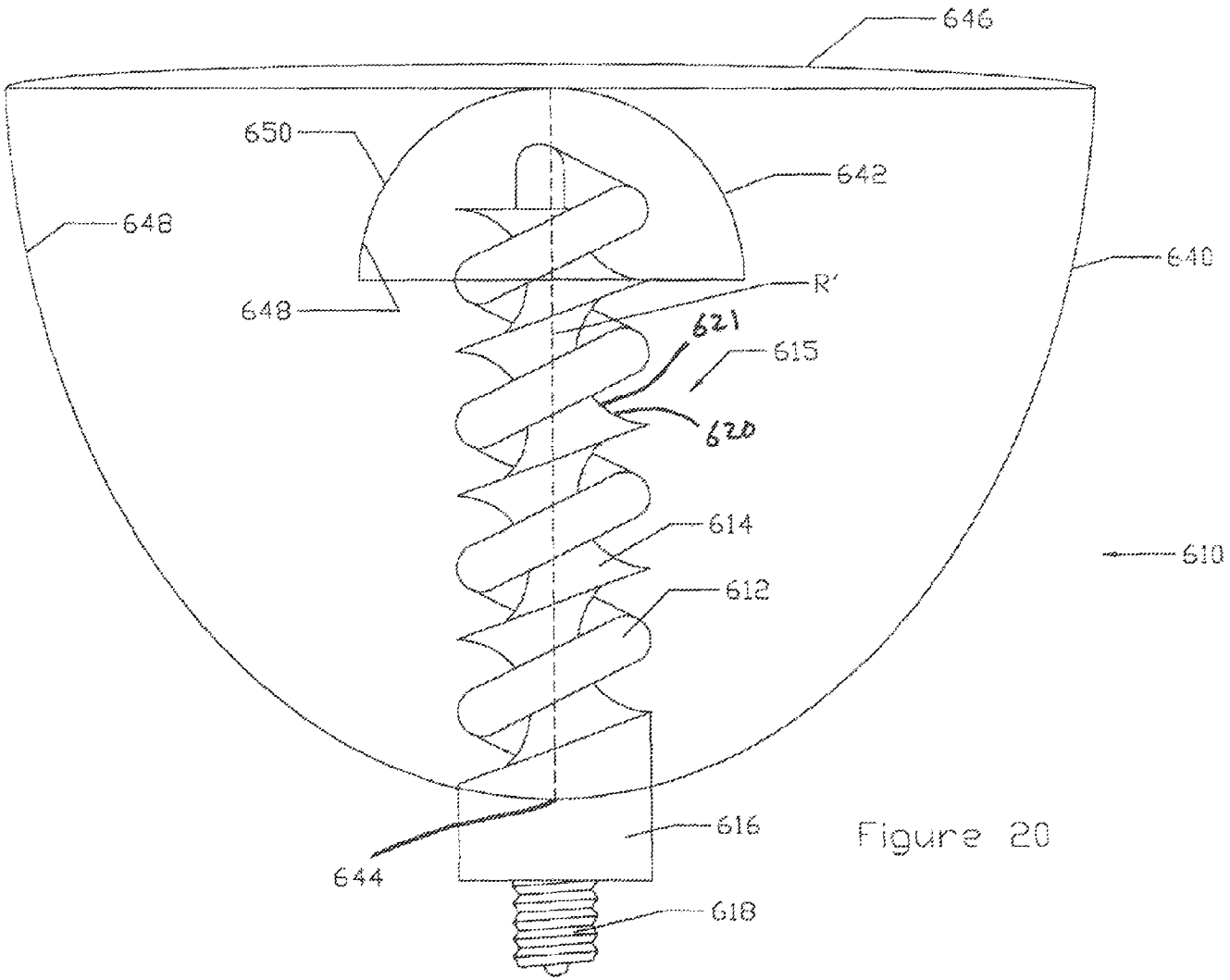
FIG. 20 is a side view of the illumination device of FIG. 18 having a secondary reflector and a tertiary reflector.

As shown in FIGS. 18-20, an illumination device 610 may include a light source 612, such as a fluorescent light, coiling around a primary reflector 614 in a helical fashion. The combination of light source 610 and primary reflector 614 may define a light reflection unit 615. Light reflection unit 615 is typically mounted to one or more bases 616.

Bases 616 may include electrical contacts 618 for electrically coupling with an external power supply. Electrical contacts 618 may take the form of any suitable type of electrical contact known in the art, such as electrically conductive pins as pictured in FIGS. 18 and 19, or a screw base connector as pictured in FIG. 20. Base 616 may house a ballast (not pictured) for regulating current flow through light source 612.

As shown most clearly in FIG. 19, primary reflector 614 may include a helical groove 620 having reflective properties. Helical groove 620 may have an interior curve forming a curved channel 621 with a helical groove apex 622. Helical groove apex 622 is the minimum (or maximum depending on the frame of reference) point along curved channel 621. The interior curve of helical groove 620 may define an effective radius R extending from helical groove apex 622 to an imaginary center C of what would be an approximate circle were curved channel 621 to extend further along its curved path. Light source 612 may be spaced apart radially from primary reflector 614 half the distance of effective radius R, which may correspond to the focal point of light reflected from primary reflector 614.

As shown in FIGS. 18 and 19, bases 616 may be fitted with endcaps 624. In some examples, illumination device 610 may include two or more endcaps 624. In the example shown in 19, fasteners 630, such as screws, secure endcaps 624 to bases 616 through apertures 632.

Each endcap 624 may include a tombstone 626 in which mating members 628 of light source 612 may it insert to electrically couple light source 612 with a power supply. Tombstone 626 may be a "tombstone" style electrical connector as known in the art for facilitating electrical communication between light source 612, such as a fluorescent light, and electrical contacts 618. In the examples shown FIGS. 18 and 19, electrical contacts 618 comprises electrically conductive pins extending from each endcap 624. The electrically conductive pins are typically configured to mate with a complimentary electrical socket linked to a power supply. Tombstone 626 may be in electrical communication with electrical contacts 618 via a ballast (not pictured), which may regulate the current flow through light source 612, such as a fluorescent light.

In some examples, such as shown in FIG. 20, illumination device 610 may include a secondary reflector 640 and/or a tertiary reflector 642. In some examples, illumination device 610 may include secondary reflector 640 without tertiary reflector 642 or vice versa. Secondary reflector 640 and tertiary reflector 642 each compliment the reflective properties of reflector 614 by redirecting light from light reflection unit 615 towards a target illumination area. However, neither secondary reflector 640 nor tertiary reflector 642 is required and one may be used without the other.

Secondary reflector 640 may generally be in the shape of a paraboloid with a second apex 644 opposite an opening 646. Secondary reflector 640 may take additional or alternative shapes such as pyramidal, tubular, or an irregular shape. An interior surface 648 of secondary reflector 640 may have reflective properties. As shown in FIG. 20, secondary reflector may include an effective paraboloid radius R' extending from secondary reflector apex 644 to opening 646.

Secondary reflector apex 644 defines an effective minimum (or maximum depending on the frame of reference) region in the paraboloid shape. Secondary reflector apex 644 may include an apex aperture (not pictured) through which base 616 may extend. Secondary reflector 640 typically attaches to base 616 at secondary reflector apex 644 to yield certain reflective properties from the shape of secondary reflector 640. In the example shown in FIG. 20, the curved shape of secondary reflector 640 may direct light from light reflection unit 615 to a target illumination area.

Tertiary reflector 642 may also have a paraboloid shape with a tertiary interior surface 648 having reflective properties. However, tertiary reflector 642 may take additional or alternative shapes such as pyramidal, tubular, or an irregular shape. Tertiary reflector 642 may also have an exterior surface 650 having reflective properties. In the example shown in FIG. 20, light entering tertiary reflector 642 is reflected downward onto secondary reflector 640. Upon reaching secondary reflector 640, the light may then be reflected towards a target illumination area.

In all embodiments disclosed hereinabove, standard type electrical connections including ballasts, sockets, and standard wiring are employed. Applicant's invention focuses primarily on the reflective aspects of providing additional light to a target illumination area, resulting in more lighting where desired with conservation of energy.

Figure 21:
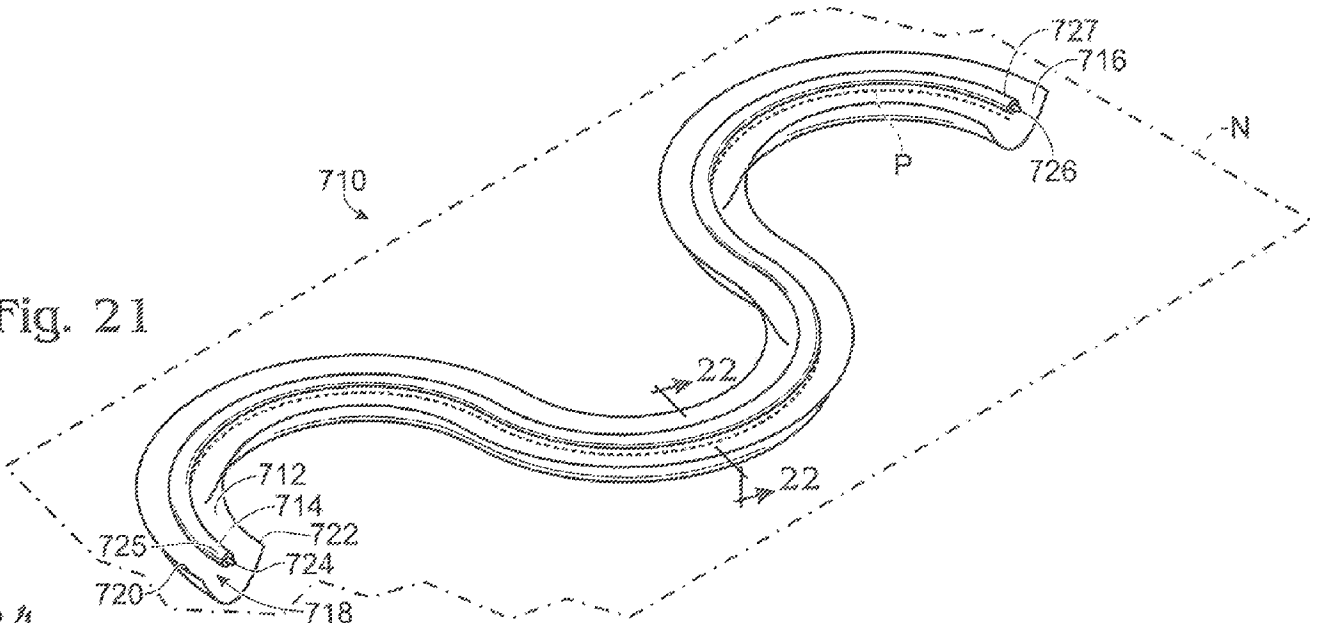
FIG. 21 is a perspective view of an illumination device including a reflector having a curved path.

A further example of an illumination device 710 is shown in FIG. 21. As shown in FIG. 21, illumination device 710 may include a primary reflector 712 and a light source 714 spaced from primary reflector 712. As a point of reference, primary reflector 712 in FIG. 21 may be described as extending longitudinally in a plane P. Additionally or alternatively, primary reflector 712 may extend in three dimensions. Illumination device 710 may be suitable for providing illumination a variety of residential, commercial, and industrial settings.

Figure 22:
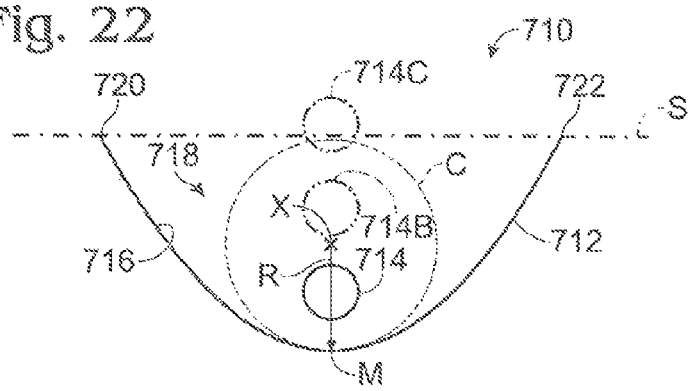
FIG. 22 is a side elevation view of a cross section of the FIG. 21 illumination device taken along line 22-22 in FIG. 21.

As shown in FIGS. 21 and 22, primary reflector 712 may include an exterior surface 716. In some examples, exterior surface 716 reflects light, such as reflecting light towards a first target illumination area. Exterior surface 716 itself may be mirrored or otherwise have reflective properties. Additionally or alternatively, a layer of reflective material or a reflective coating may be supported by exterior surface 716. For example, exterior surface 716 may be a substrate including a metallic coating having light reflective properties.

Exterior surface 716 may define a curved path P as shown in FIG. 21. A wide variety of curved paths are envisioned. For example, a random curved path P extending longitudinally is shown in FIG. 21. An exterior surface 716A shown in FIG. 23 defines a spiral curved path. Helical curved paths are shown generally in FIGS. 1, 2, 7, 8, and 18-20, a circular curved path is shown generally in FIG. 6A, and U-shaped curved paths are shown generally in FIGS. 6B and 9. Other curved paths (not pictured) may include sinusoidal and oblong portions.

Exterior surface 716 may be curved in a plane transverse to the reference plane N. For example, as can be seen in FIGS. 21 and 22, a cross section of exterior surface 716 taken transverse to curved path P may be curved in the shape of a parabola. The curvature of exterior surface 716 may alternatively be described as being latitudinal relative to the longitudinally extending curved path P. Any or all two-dimensional sections of exterior surface 716 along curved path P may be curved in some manner. Alternatively, one or more sections may not be curved.

Exterior surface 716 may partially enclose an interior space 718. Interior space 718 may be the space bounded by exterior surface 716 and an imaginary surface S shown in FIG. 22. Imaginary surface S is shown in FIG. 22 to extend between a first edge 720 of exterior surface 716 and a second edge 722 of exterior surface 716. Imaginary surface S may be a plane, as depicted in FIG. 22, or may be a curved surface complimenting first and second edges 720, 722. For example, imaginary surface S may be curved if the height of the edges 720, 722 varies as curved path P extends longitudinally.

With reference to FIG. 22, the curvature of exterior surface 716 may include a minimum point M and define an effective radius R. The minimum point M may be the point along the curvature of exterior surface 716 in which the curve transitions between ascending or descending or between any other opposed relationship, such as inward and outward. Effective radius R may be the distance between exterior surface 716 and an imaginary center P of an imaginary circle C. Imaginary circle C is a circle that approximately corresponds to or shares a common circumference with a portion of the curvature of exterior surface 716.

Light source 714 of illumination device 710 may be spaced from primary reflector 712 at least partially within interior space 718. As can be seen in FIG. 22, a variety of spacing distances are contemplated. For example, in FIG. 22, light source 714 is shown to be spaced approximately one-half effective radius R from minimum point M of the curved exterior surface 716. The position of light source 714 in FIG. 22 may be referred to as the focal point of exterior surface 716.

As an alternative example, a light source 714B is shown to be spaced greater than the effective radius R from minimum point M of exterior surface 716. Further, a light source 714C is shown to be spaced a distance greater than effective radius R from minimum point M of exterior surface 716. A portion of light source 714C is within interior space 718 and a portion of light source 714C is outside interior space 718.

Spacing light source 714 different distances from exterior surface 716 may be suitable for different applications. For example, different spacing distances may modify the light concentration emanating from illumination device 710. Additionally or alternatively, the spacing may modify the power consumed by illumination device 710 to produce a given amount of illumination. Further, the spacing may modify how heat generated by illumination device 710 is dissipated. In some examples, light source 714 is positioned approximately at the focal point of exterior surface 716 to increase the intensity of light emanating from illumination device 710.

In comparison to light source 714 having a circular cross section as shown in FIG. 22, in some examples, the light source may have oblong cross section (not pictured). In examples where the light source has an oblong cross section, the longer dimension of the oblong cross section may extend along a line extending from minimum point M to center X. Having the longer dimension of the oblong cross section oriented in this manner may fill more of the height of exterior surface 716 with a source of light. As with light source 714 shown in FIG. 22, the light source having an oblong cross section may be spaced a variety of distances from minimum point M.

Light source 714 may include a wide variety of lighting technologies. For example, light source 714 may include fluorescent, incandescent, halogen, xenon, neon, mercury-vapor lights, and gas-discharge lights, as well as light emitting diodes. The light sources shown in FIGS. 21-24 depict fluorescent lights. However, those skilled in the art will understand that fluorescent lights represent only one example of lighting sources that may be used with the presently described illumination devices.

As shown in FIG. 21, light source 714 may extend between a first terminal end 725 and a second terminal end 727 and be curved to compliment curved path P. Light source 714 shown in FIG. 21 may alternatively be described as substantially following curved path P. Thus, light source 714 may be longitudinally curved and extend along exterior surface 716 of primary reflector 716.

For electrically coupling to a power supply (not pictured), light source 714 is shown in FIG. 21 to include a first conductive pin 724 extending from first terminal end 725 and a second conductive pin 726 extending from second terminal end 727. The first and second conductive pins 724 and 725 may couple with a tombstone or other electrical connecter as necessary to electrically couple light source 714 to a power supply.

Figure 24:
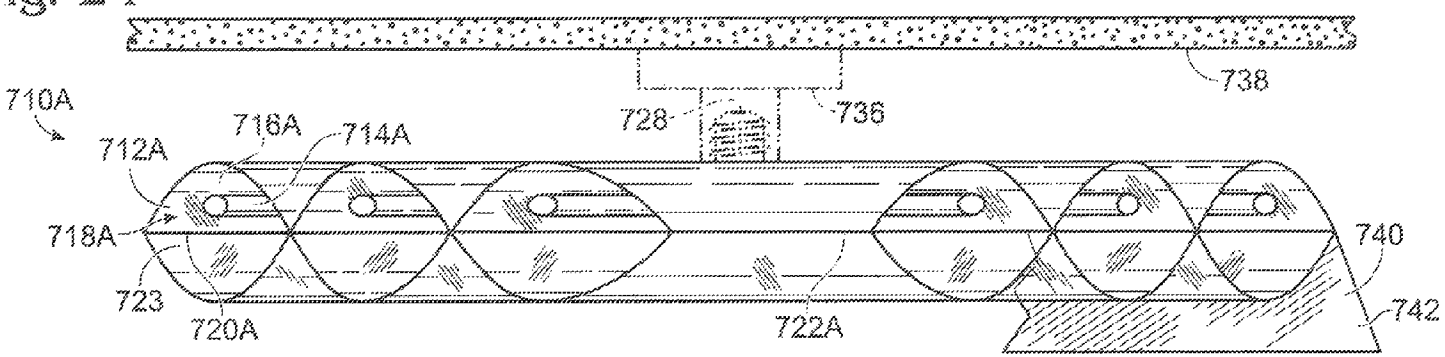
FIG. 24 is a side elevation view of a cross section of the FIG. 23 illumination device example taken along line 24-24 in FIG. 23.
Figure 23:
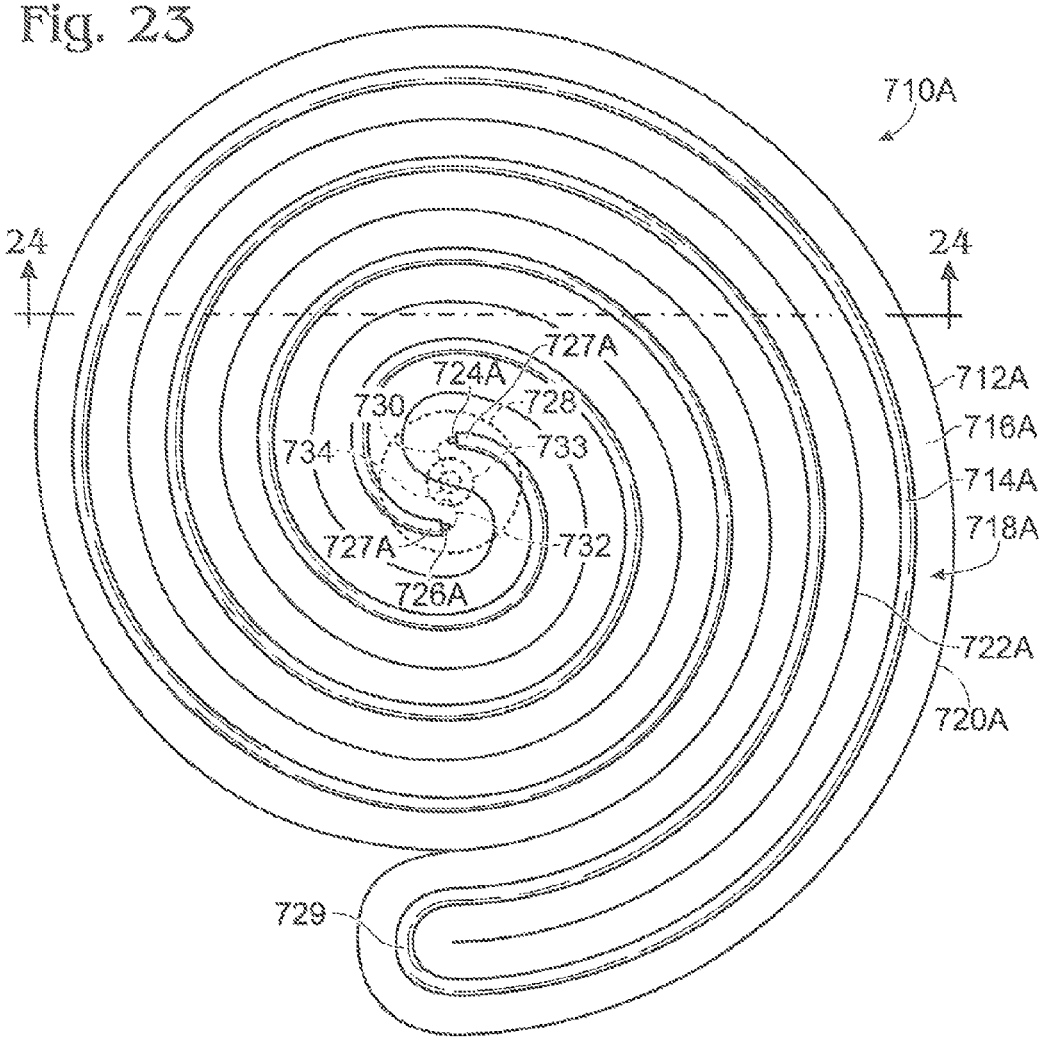
FIG. 23 is a plan view of an underside of illumination device including a reflector having a spiral curved path.

An alternative illumination device 710A is shown in FIGS. 23 and 24. As shown in FIGS. 23 and 24, illumination device 710A may include a primary reflector 712A at least partially surrounding a light source 714A. Light source 714A may extend between a first terminal end 725A and a second terminal end 727A. Primary reflector 712A may include an exterior surface 716A having reflective properties.

As shown in FIG. 23, exterior surface 716A may extend in a curved path, such as a spiral curved path. Additionally or alternatively, exterior surface 716A may be curved to at least partially surround light source 714A. The curvature of exterior surface 716A may be concave facing light source 714A and may partially enclose an interior space 718A. The partially enclosed interior space 718A may be defined as the space surrounded by the concave exterior surface 716A and within an imaginary surface extending between a first edge 720A of exterior surface 716A and a second edge 722A of exterior surface 716A.

With reference to FIG. 24, illumination device 710A include a lens 723 extending between first edge 720A and second edge 722A. Lens 723 may be formed from glass, plastic, or other polymeric material. Permanent, semi-permanent, or selective attachment of lens 723 to primary reflector 712A is contemplated, such as with adhesive, magnetic, snap on, or screw in, attachment means. Lens 723 may be curved, as shown in FIG. 24, or may be flat, angular, or irregular.

Lens 723 may be transparent, translucent, colored, or selective opaque. Light may be refracted by lens 723 or may pass substantially unaffected through lens 723. Lens 723 may include patterns, designs, or etchings configured to direct light in certain directions or to concentrate light towards certain areas, such as a target illumination area. In some examples, lens 723 may redirect or reflect ambient light towards a target illumination area.

Light source 714A may be spaced a variety of distances from exterior surface 716A. For example, light source 714A may be spaced at the focal point of exterior surface 716A, or may be spaced closer to or farther from exterior surface 716A than the focal point. In some examples, such as shown in FIG. 24, light source 714A is positioned wholly within the interior space 718A, while in other examples, light source 714A is positioned partially within interior space 718A. Further, light source 718A may be positioned wholly outside of interior space 718A in some applications.

As shown in FIG. 23, light source 714A may be bent into a bent configuration that brings first terminal end 725A and second terminal end 727A substantially adjacent to one another. In the bent configuration, light source 714A may include one or more bends 729. Bend 729 may be formed at a midpoint of tight source 714A or at any point between first and second terminal ends 725A, 727A. In some examples, exterior surface 716A includes complimentarily bends to correspond with light source 714A in the bent configuration.

As can be seen in FIG. 23, the spiral curved path may include a center portion. First and second terminal ends 725A, 727A may be substantially adjacent to each other at or adjacent to the central portion. Having first and second terminal ends 725A, 727A substantially adjacent at the central portion may obviate the need for tombstones or other electrical connectors. In the bent configuration shown in FIGS. 23 and 24, a common, centrally disposed screw base connector 726 is used to connect both first and second terminal ends 725A, 727A to a power supply (not pictured).

A variety of connectors and connection means may be used to electrically connect light source 714A to a power supply. As shown in FIGS. 23 and 24, light source 714A may include first and second conductive pins 724A, 726A extending from first and second terminal ends 725 and 727, respectively. As mentioned above, an example of a screw base connector 728 is shown in FIGS. 23 and 24. In the example shown in FIG. 24, first and second wires 730, 732 electrically couple first and second conductive pins 724A, 726A with screw base connector 728, respectively.

Screw base connector 728 may include a first connection portion 733 providing a current path for an electrical circuit. Further, screw base connector 728 may include a second connection portion 734 providing a current path for an electrical circuit. First connection portion 733 may provide a current path from a power supply to illumination device 710A and second connection portion 734 may provide a current path to electrical ground or other relatively lower electrical potential destination, or vice versa. As shown in FIG. 23, a first wire 730 may electrically couple first conductive pin 724 with first connection portion 733. Further, a second wire 732 may electrically couple second conductive pin 726 with second connection portion 734.

As shown in FIG. 24, screw base 738 may couple with a fixture 736 that mounts to a mountable surface 738, such as a ceiling, wall, bookcase, or desk. Additionally or alternatively, illumination device 710A may be supported from the ground by a base, such as in a free-standing lamp configuration. Illumination device may also by supported in handheld devices, such as flashlight, lantern, or torch bodies.

Illumination device 710A may include any and all components necessary for proper functioning of light source 714A. For example, ballasts, internal connection components, such as wires and other circuitry, and suitable insulating materials may be included as necessary. Further, in some examples, illumination device 710A may include a portable power source, such as a battery, a generator, or a fuel cell, to power light source 714A.

Additionally or alternatively to primary reflector 712A, illumination device 710A may include a secondary reflector 740 having a reflective surface 742. As shown in FIG. 24, secondary reflector 740 may be supported by primary reflector 712A and extend beyond primary reflector 712A. By extending beyond primary reflector 712A, secondary reflector 740 may reflect light emanating from light source 714A that would not be reflected by primary reflector 712A. Additionally or alternatively, secondary reflector 740 may reflect again light that was previously reflected by primary reflector 712A.

In some examples, secondary reflector 740 is configured to reflect light towards a second target illumination area. The second target illumination area may be the same or different than the first target illumination area towards which primary reflector 712A may reflect light. The size, the angle and orientation, and the shape of secondary reflector 740 may influence how it reflects light. In some examples, secondary reflector 740 is frustoconical. A frustoconical secondary reflector 740 may enclose an inner volume and orient interior surface 742 at a non-90 degree angle to light emanating from light source 714A and reflecting from primary reflector 712A.

Figure 25B:
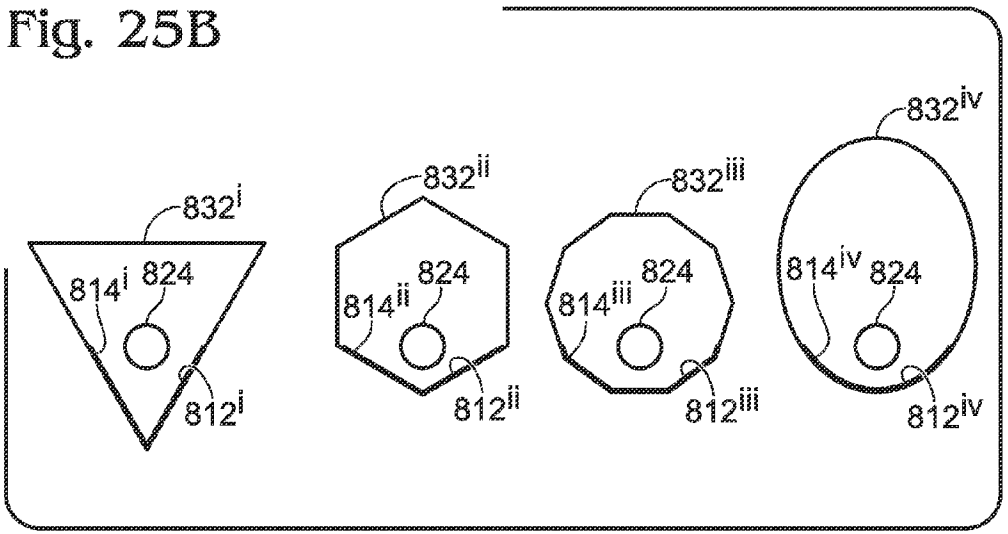
FIG. 25B depicts cross sections of alternative examples of lighting apparatuses.
Figure 25A:
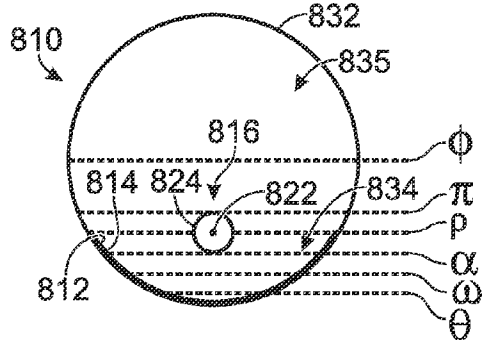
FIG. 25A is a side elevation view of a cross section of the FIG. 26 illumination device taken along line 25A-25A in FIG. 26.
Figure 26:
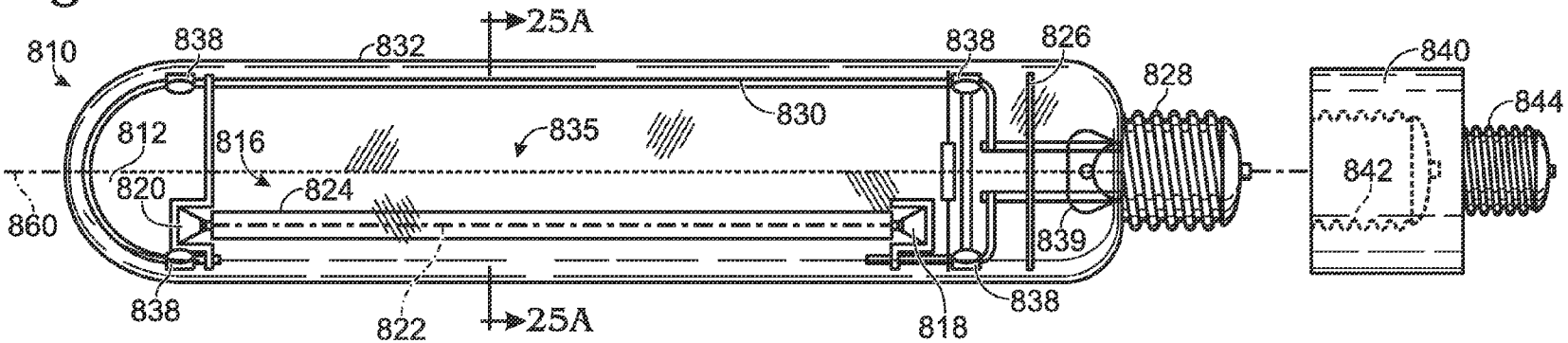
FIG. 26 is a side elevation view of another example of a lighting apparatus.

A further example of a lighting apparatus 810 that embodies certain features of this disclosure is shown in FIGS. 25A and 26. FIGS. 25A and 26 are non-limiting and merely illustrative examples, and lighting apparatuses according to the present disclosure may have shapes and physical arrangements different to that shown in FIGS. 25A and 26. In the example shown in FIGS. 25A and 26, lighting apparatus 810 includes a reflector 812 and a light sources 816 at least partially within the interior space 834 defined by the reflector 812.

Reflector 812 functions to reflect light from a light source 816 more efficiently toward a target illumination area. As shown in FIGS. 25A and 26, reflector 812 includes a reflective exterior surface 814 facing light source 816 to reflect light from light source 816 toward a target illumination area. In examples where the light apparatus includes more than one light source, the reflective exterior surface defines space sufficient to accommodate multiple light sources and a shape to reflect the light produced by each light source to a target illumination area.

In some embodiments, such as the one illustrated in FIG. 26, reflector 812 extends along a longitudinal axis 860 defined by lighting apparatus 810. In the example shown in FIG. 26, longitudinal axis 860 is transverse to the direction in which light travels to the target illumination area. In other embodiments, such as reflector 1012 shown in FIG. 28 having a reflective exterior surface 1014 defining an elliptical paraboloid, the reflector and/or the reflective exterior surface may revolve around an axis, such as axis 1060 in FIG. 28, extending toward the target illumination area. As shown in FIG. 26, exterior surface 814 of reflector 812 defines a series of focal points 822 as it extends along a longitudinal axis 860.

Light source 816 provides a means for generating light in lighting apparatuses 810. In the embodiment shown in FIG. 26, light source 816 comprises a first electrode 818, a second electrode 820, and an arc tubes 824. However, the reader should understand that light sources that do not comprise these same exact elements are equally within this disclosure.

In the embodiment shown in FIG. 26, arc tube 824 contains a gas between first electrode 818 and second electrode 820. In the present example, arc tube 824 is hermetically sealed. In various embodiments, the gas contained in arc tube 824 comprises a metal halide, mercury, sodium, or any other gas that may generate light when ionized by an electrical current. Light source 816 shown in FIG. 26 (as well as in FIGS. 27 and 28) defines a high pressure discharge lamp positioned substantially at focal point 822 of reflective exterior surface 814. In some embodiments, the light source defines a low pressure discharge lamp.

In some embodiments, reflective exterior surface 814 is composed of reflective materials, such as reflective metals including aluminum or conventional mirror surfaces. In the example shown in FIG. 26 (as well as in FIGS. 27 and 28), reflective exterior surface is formed by depositing aluminum vapor onto an inner surface of envelope 832. In other examples, the lighting apparatus includes reflector members positioned near and/or around light source 816 such examples, the reflector members have exterior surfaces made out of reflective metals or mirrors to reflect light. As another non-exclusive example, the reflector and its corresponding exterior surface may comprise a reflective material or coating applied to an envelope 832 containing a light source 816.

The reflective exterior surface may define several different shapes with unique focal point geometries. For example, as shown in FIGS. 25A and 25B, a cross section of the reflective exterior surface transverse to longitudinal axis 860 may define a portion of a regular polygon or a parabola. FIG. 25B illustrates a series of non-exclusive examples of reflective exterior cross sections, including 1) reflector 812*i* mounted on envelope 832*i* and having surface 814*i*, which defines a portion of a triangle; 2) reflector 812*ii* mounted on envelope 832*ii* and having surface 814*ii*, which defines a portion of a hexagon; 3) reflector 812*iii* mounted on envelope 832*iii* and having surface 814¬ *iii*, which defines a portion of a decagon; and 4) reflector 812*iv* mounted on envelope 832*iv* and having surface 814*iv*, which defines a portion of an oval, which could also be described as a parabola. FIG. 25B is illustrative, and shapes of reflective exterior surfaces according to this disclosure are not to be limited to the examples illustrated in the figures, but rather include any other shape that may be useful in efficiently illuminating a target illumination area.

With reference to FIG. 25A the reader can see that reflective exterior surface 814 may partially enclose different amounts of interior space 834 depending on the particular arc length defined by the exterior surface. In FIG. 25A, a variety of different exterior surface arc length examples are indicated with dashed lines identified by lower case Greek letters denoting the different angles the arcs are subtending. For example, in FIG. 25A, the arc indicated by the dashed line identified by $\Phi$ would comprise the portion of the ellipse below the dashed line denoted as $\Phi$. In FIG. 25A, the reflective exterior surface arc examples subtend angles of approximately 40° ($\theta$), 64° ($\omega$), 94° ($\alpha$), 110° ($\rho$), 128° ($\pi$), and 172° ($\Phi$), but any angle between 0° and 360° is equally within this disclosure.

FIG. 25A illustrates an circular embodiment, but embodiments with exterior surfaces having polygonal cross sections will also partially enclose different amounts of interior space depending on the dimensions of the polygon defined by the reflective surface.

In the example shown in FIGS. 25A and 26, light source 816 is placed substantially at a focal point defined by a reflective exterior surface 814. The focal point of a given reflector will depend on its geometry. There are mathematical expressions for the focal point of a curved reflector. Reflectors having polygonal geometry will have more complex mathematical expressions for the focal point or can be described as having an "effective focal point" that approximates the focal point of a curved reflector. The inventor has discovered that placing the light source at the focal point or effective focal point provides more efficient illumination to a target illumination area.

As mentioned above, the focal point of a given reflector will depend on its geometry. For example, prior discussions have defined the focal point of concave reflectors with generally circular cross sections as half the radius of the circle divided by two. For concave reflectors with a cross section in the shape of a parabola, the focal point can be defined as the product of one-half the maximum interior width of the parabola squared divided by four times the height of the parabola. Any method of calculating the focal point of a given geometry, including any focal point approximations, may be used to determine the focal point of a given reflector.

In embodiments in which the reflective exterior surface 814 extends longitudinally, including those with parabolic and polygonal cross sections, the reflective exterior surface may define a series of focal points. As a non-exclusive example, a series of focal points 822 are shown in FIG. 26. In FIG. 26, focal points 822 include all of the points at the focus of a parabolic cross section spanning the length of the reflective exterior surface 814. However, such a series of focal points may comprise any collection of points within the reflective exterior surface.

As can be seen in FIG. 26, lighting apparatus 810 includes a base electrode 828. Base electrode 828 electrically couples light source 816 with a complimentary electrical socket to provide energy to lighting apparatus 810 from the electrical socket. Base electrode 828 is connected to at least one of first or second electrode 818 and 820 of lighting apparatus 810.

Lighting apparatus 810 shown FIG. 26 includes a conductive steel frame 830 supporting light source 816. Conductive steel frame 830 electrically connects first and second electrodes 818 and 820 with base electrode 828. With brief reference to FIG. 28, the reader can see that a lighting apparatus 1010 includes a similar conductive steel frame 1030. Conductive steel frame 1030 supports a first electrode 1018 and a second electrode 1020 as well as electrically connects these electrodes to a base electrode 1028.

In the particular example shown in FIG. 26, lighting apparatus 810 includes a second reflector 826 disposed between light source 816 and base electrode 828. Second reflector 826 is positioned to reflect away from base electrode 828 a substantial portion of the light that would otherwise be directed toward base electrode 828. Second reflector 826 may be made of any reflective material, such as reflective metals or mirrors. In some examples, the second reflector is not positioned to reflect light away from base electrodes 828, but instead is positioned to reflect light in a beneficial direction to more efficiently direct light towards a target illumination area.

As shown in FIG. 26, some embodiments of lighting apparatuses according to the present disclosure may additionally comprise an adapter. In FIG. 26, adapter 840 includes a recess electrode 842 complimentarily configured with base electrode 828 and an adapter electrode 844 electrically connected to recess electrode 842. Adapter electrode 844 is complimentarily configured with a desired electrical socket.

In some embodiments, the adapter electrode is designed to complement electrical sockets that are physically incompatible with base electrode 828. However, this is not required, and embodiments that implement adapters in which base electrode 828 and the adapter electrode physically complement the same electrical socket are equally within this disclosure.

In some examples, the adapter includes compatibility means for using the lighting apparatus with electrical sockets that are otherwise electrically incompatible with such lighting apparatuses. The compatibility means may comprise electrical circuitry, including transformers, that covert electrically incompatible power from the electrical socket to electric power that is compatible with a particular lighting apparatus. Such conversion circuitry, however, is not required, and in some embodiments the adapter outputs power to the base electrode from the electrical socket unchanged.

In the example shown in FIG. 26, lighting apparatus 810 includes an envelope 832 attached to base electrode 828 and enclosing light source 816, the reflector 812, or both. In FIG. 26, envelope 832 is substantially clear, however different levels of opacity are equally within the present disclosure. In some embodiments, the envelope may have a tint that changes the color of the light emitted from the lighting apparatus.

In lighting apparatus 810, reflector 812 comprises a metal coating deposited onto a portion of envelope 832. Additionally or alternatively, there may be one or more reflectors included as a separate body from envelope 832, that is, not a coating applied to envelope 832.

FIG. 26 shows an illustrative, non-limiting example of a lighting apparatus 810 embodying elements of the present disclosure. In FIG. 26, lighting apparatus 810 includes envelope 832 connected to base electrode 828. Envelope 832 encloses an interior space 835 substantially evacuated of air to form a vacuum. Envelope 832 is formed from weather resistant glass, but plastics and other suitable materials may be readily used.

In the example shown in FIG. 26, approximately one-half of envelope 832 is exposed to vaporized aluminum, which deposits on envelope to form a coating representing reflector 812 with a reflective exterior surface 814. In other examples, more or less than one-half of envelope 832 is coated with a reflective material. A cross section of reflector 812 is shown in FIG. 25A, with alternative reflector shape cross sections depicted in FIG. 25B.

As shown in FIG. 26, lighting apparatus 810 includes a steel frame 830 and dome mount supports 838 that cooperate to maintain the position of light source 816 substantially at focal point 822 of reflector 812. In the example shown in FIG. 26, steel frame 830 is electrically conductive, and electrically connects base electrode 828 to both first and second electrodes 818 and 820.

In the embodiment shown in FIG. 26, light source 816 comprises a high pressure sodium lamp with an arc tube 824, which is hermetically sealed. As shown in FIG. 26, light apparatus 810 includes an additional reflector 826 reflecting light away from base electrode 828 and a residue gas getter 839 attached to base electrode 828.

Figure 27:
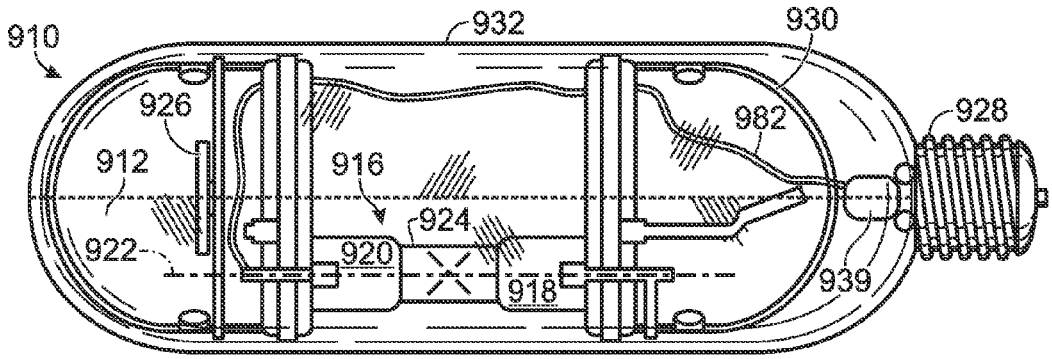
FIG. 27 is a side elevation view of a further example of a lighting apparatus.

Turning attention to FIG. 27, a lighting apparatus 910 will be described. As can be seen in FIG. 27, lighting apparatus 910 includes a reflector 912, a light source 916, a base electrode 928, and an envelope 932. Features of lighting apparatus 910 that are substantially similar to the features of lighting apparatus 810 will not be redundantly explained. Rather, the use of related reference numbers (e.g., 812 vs. 912) should cue the reader that the features are similar and that the discussion above pertains to the given similar feature being referenced.

As can be seen in FIG. 27, light source 916 includes a first electrode 918, a second electrode 920, and an arc tube 924. Arc tube 924 contains a gas between first electrode 918 and second electrode 920. Specifically, in this present example arc tube 924 contains metal halide. From the foregoing, the reader will appreciate that light source 916 defines a high-pressure discharge lamp configured to generate light by discharging electricity between first electrode 918 and second electrode 920 through the gas within arc tube 924.

As can be seen in FIG. 27, reflector 912 includes a reflective exterior surface partially enclosing an interior space and defining a focal point 922 within interior space 934. As can further be seen in FIG. 27, arc tube 924 is disposed at least partially within the interior space and substantially at focal point 922. Lighting apparatus 910 also includes a secondary reflector 926 mounted adjacent light source 916 and distal a base electrode 928.

In the example shown in FIG. 27, a first electrode 918 is connected to base electrode 928 by a conductive steel frame 930. A second electrode 920 is electrically connected to base electrode 928 by a return lead 982. Return lead 982 may comprise a metallic wire or other conductive body.

As shown in FIG. 27, lighting apparatus 910 includes a gas getter 939. The inventor contemplates use of any suitable conventional gas getter.

Figure 28:
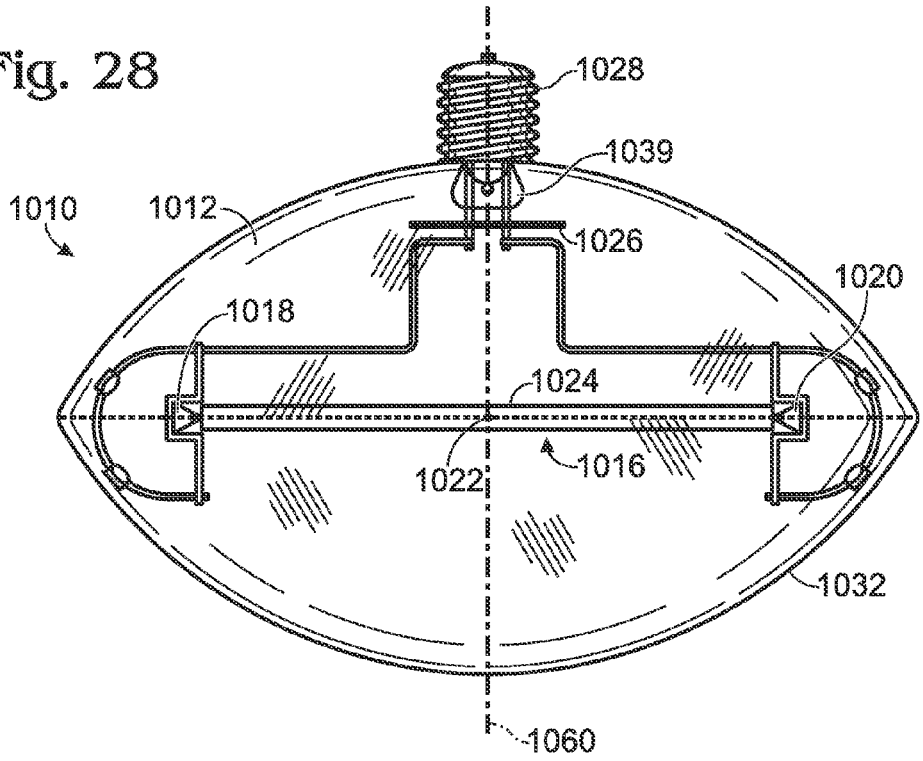
FIG. 28 is a side elevation view of yet another example of a lighting apparatus.

Turning attention to FIG. 28, a lighting apparatus 1010 will be described. As can be seen in FIG. 28, lighting apparatus 1010 includes a reflector 1012, a light source 1016, a base electrode 1028, and an envelope 1032. As with lighting apparatus 910, features of lighting apparatus 1010 that are substantially similar to the features of lighting apparatuses 810 and/or 910 will not be redundantly explained. Rather, the use of related reference numbers (e.g., 812 vs. 912) should cue the reader that the features are similar and that the discussion above pertains to the given similar feature being referenced.

As can be seen in FIG. 28, light source 1016 includes a first electrode 1018, a second electrode 1020, and an arc tube 1024. Arc tube 1024 contains a gas between first electrode 1018 and second electrode 1020. Specifically, in this present example arc tube 1024 contains sodium. From the foregoing, the reader will appreciate that light source 1016 defines a high-pressure discharge lamp configured to venerate light by discharging electricity between first electrode 1018 and second electrode 1020 through the gas within arc tube 1024.

As shown in FIG. 28, envelope 1032 is made of a weather resistant glass and has a shape comprising two elliptical paraboloids of substantially equal size joined at their open ends. In the example shown in FIG. 28, the paraboloid half of envelope 1032 connected to base electrode 1028 is coated with aluminum via a vapor deposition process to form reflector 1012 with a reflective exterior surface. The lower paraboloid half of envelope 1032 is clear for light to pass through.

As can be seen in FIG. 28, reflective exterior surface 1014 partially encloses an interior space and defines a focal point 1022 within the interior space of reflector 1014. As can further be seen in FIG. 28, arc tube 1024 is disposed at least partially within the interior space and substantially at focal point 1022. Lighting apparatus 1010 also includes a secondary reflector 1026 mounted proximate base electrode 1028 to reflect light away from base electrode 1028 and towards a target illumination area.

As shown in FIG. 28, lighting apparatus 1010 includes a gas getter 1039. The inventor contemplates use of any suitable conventional gas getter.

The principles discussed above can be used to provide a modular light-and-reflector combination, or lighting module 1100, that can be used in retrofitting various types of lamps and light sources. FIGS. 29-34 show various aspects of a lighting module 1100 according to the present disclosure.

As noted above, a typically efficient reflector may include a substantially paraboloid reflective surface, and the attributes disclosed above for the reflector and lamp combination apply as well to the following embodiments. The paraboloid reflector will usually have a focal point at a location defined by $(\text{radius})^2/4*(\text{depth})$, at which the lamp within the reflector should be placed for optimum light focusing. In one sense, a paraboloid reflector can be considered an ellipse having one focal point at infinity.

Figure 29:
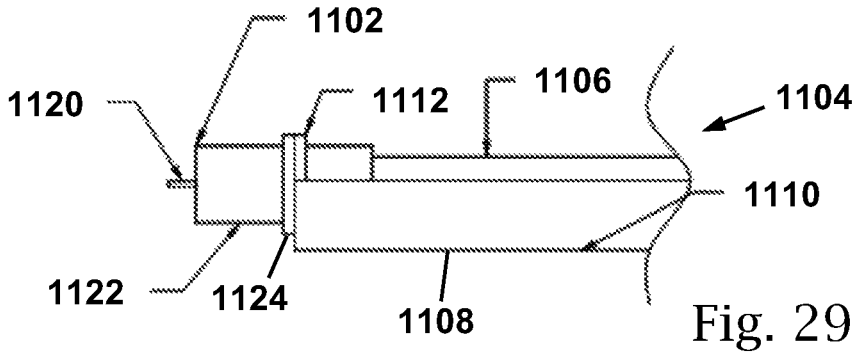
FIG. 29 is an embodiment of a lighting module according to the present disclosure.
Figure 30:
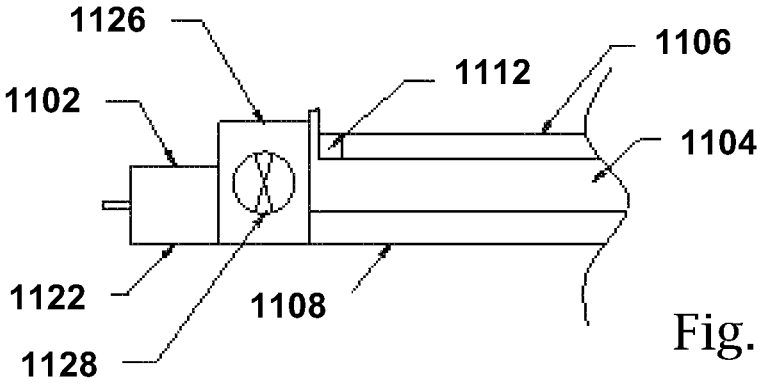
FIG. 30 is another embodiment of a lighting module according to the present disclosure.

As can be seen in FIGS. 29-30, a typical embodiment of a lighting module 1100 will include an adapter 1102 and reflector 1104. The module is configured to accept one or more types of lamps 1106, which will usually be coupled to the adapter 1102 and have their light reflected by reflector 1104. As with the above embodiments, the adapter 1102 and reflector 1104 will typically be configured such that the lamp 1106 resides at the focal point of the substantially paraboloid reflector.

As can be seen from the Figures, the reflector 1104 may include a reflector frame 1108 that may be configured with a reflective surface 1110. As noted above, the reflector frame may be constructed of any appropriate material, including (for example) plastic, metal, etc. The reflector may be semicylindrical, or paraboloid, or any desired shape to accommodate what will typically be a paraboloid reflector. The reflective surface 1110 can also be formed in any appropriate manner that provides for reflection of the lamp's light under the conditions of the lamp's use. In some embodiments, such as when the lighting module 1100 is used in a light fixture that has its own reflector, the reflector may not be provided, or it may be provided without a reflective surface 1110. Also, in some embodiments, the reflective surface 1110 may be integral with the reflector frame 1108, while in other embodiments the reflective surface 1110 may be slightly or substantially spaced apart from the reflector frame 1108.

As can be seen from the Figures, the adapter 1102 in most embodiments has a circular cross-section. So that it may be rotatably coupled to such an adapter, a reflector 1104 in the same lighting module may be provided with a slip ring 1112. The slip ring will typically be provided with a substantially circular cross-section just slightly larger than the cross-section of the adapter to which it will be attached. In this way, the reflector may be rotated around the adapter to any desired configuration; this rotation may occur around a rotational axis 1114 substantially aligned with an included lamp 1106. In cases where the lighting module includes a lamp 1106, such rotation of the reflector 1104 may serve to direct reflected light in a desired direction. In other embodiments, the slip ring 1112 may be coupled to, and allow the reflector to rotate around, the lamp or other structure besides the adapter.

Figure 31:
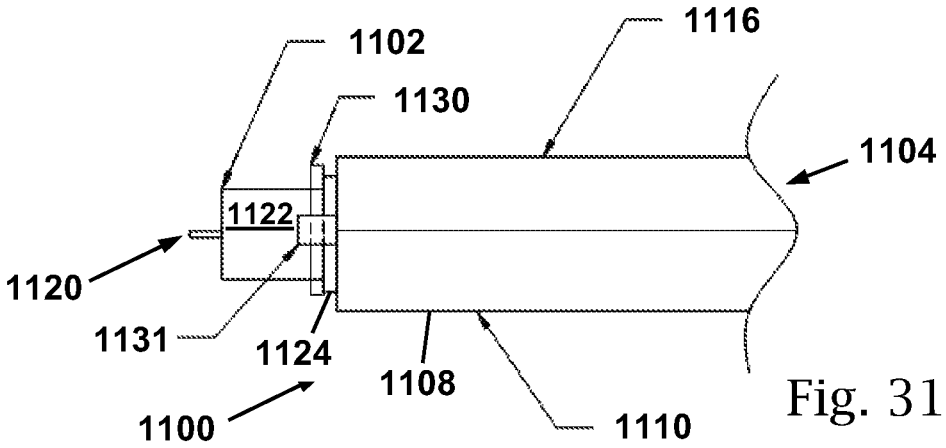
FIG. 31 is another embodiment of a lighting module according to the present disclosure.
Figure 32A:
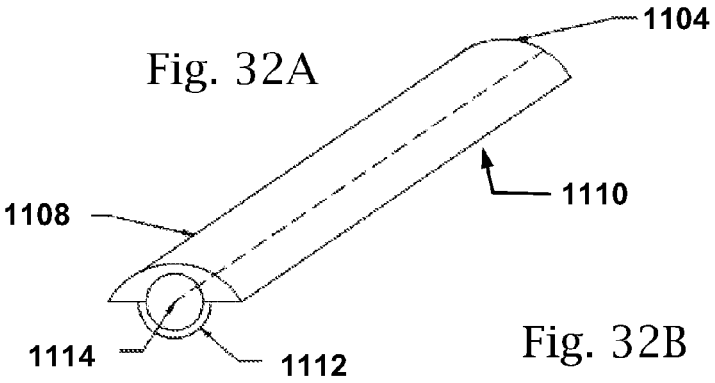
FIGS. 32A and 32B are embodiments of a reflector for a lighting module according to the present disclosure.
Figure 32B:
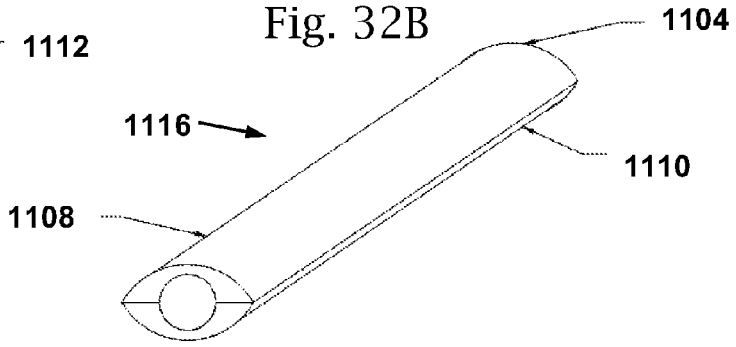

In some embodiments, such as the one shown in FIG. 31, the reflector frame 1108 may completely surround an included lamp 1106, such that the assembled parts form a cylindrical, rather than semicylindrical, structure. In these embodiments, the reflector frame 1108 may be coupled, typically reversibly, to an envelope element, or lens, 1116. Such a configuration may serve to more completely protect an included lamp 1106 when, for example, the lighting module 1100 (and a light fixture to which it is coupled) are placed in an environment that may be potentially damaging to the lamp.

Figure 33A:
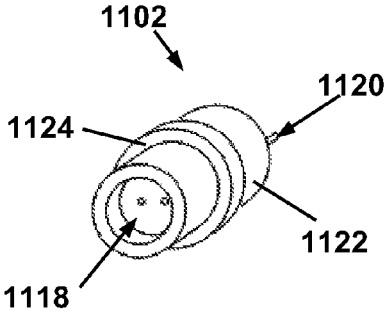
FIGS. 33A, B, and C are embodiments of an adapter for a lighting module according to the present disclosure.
Figure 33C:
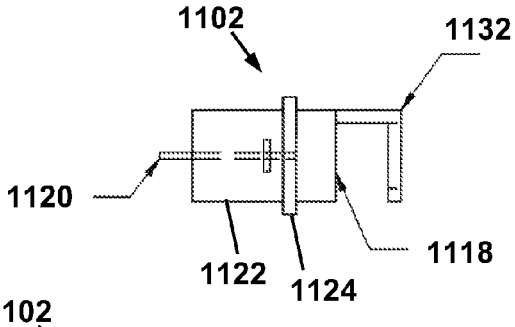
Figure 33B:
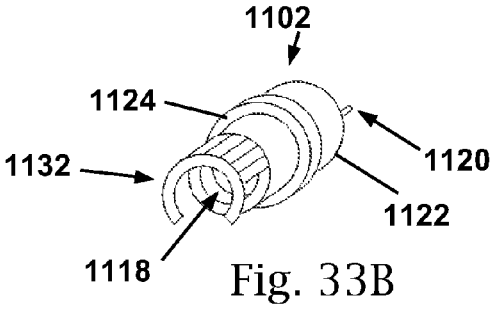

Looking especially to FIGS. 33A-C, there are shown some features of embodiments of adapter 1102. The adapter may function to allow some lamps 1106 to be coupled to light fixtures for which they were not designed. For example, because the paraboloid reflector described here may provide highly efficient light reflection, it may be possible to replace a higher wattage lamp with a lower wattage lamp. Or a smaller lamp in place of a larger one. For example, the adapter could be used to couple a T5 lamp bulb to a standard-sized T12 recessed fluorescent light fixture.

To couple a lamp of one size to a light fixture made for another, the adapter may include a first set of female mini-pin electrodes 1118 and a second set of male medium pin electrodes 1120. Thus, a smaller lamp 1106 having male mini-pin electrodes can couple to the female mini-pin electrodes of the adapter, and the male medium pin electrodes of the adapter can, in turn, couple to the electrodes of the light fixture. In this way, the adapter may facilitate, and be in, electrical communication with the lamp through their electrical contacts, or electrodes. Note that the use of the adapter will thus allow nominally incompatible electrodes to be in electrical communication. Although shown as having pairs of pins at each end, the adapter may utilize any appropriate combinations of pins to accommodate various configurations of lamps and light fixtures. For example, the adapter may use mini bi-pins, medium bi-pins, 4-pin connectors, recessed DC, or single-pin connectors, as the case may be.

Note that because a lower-wattage lamp 1106 may be placed into a higher-wattage fixture with the adapter 1102, some provision may need to be made to modify the characteristics of the power flowing to the lamp. In the illustrated embodiments of an adapter 1102, the adapter may include an integral stepdown transformer 1122. This transformer may alter the characteristics of the power supplied to the lamp 1106 by changing the voltage (for example, lowering the voltage) and/or the current (for example, increasing the current) so that they are appropriate for the lamp to which the adapter 1102 is connected. Typically, the adapter will utilize the ballast of the light fixture to provide regulated current, with the adapter simply changing the current to a different level. In these simplest embodiments, the adapter 1102 may simply lower the voltage to a single set level.

The adapter may also include a lock ring 1124, useful in coupling the adapter to, for example, a reflector frame 1108, in a manner described below.

In some embodiments, the adapter 1102 may be coupled to a dimmer control 1126 with or without an included dimmer knob 1128. In this case, the voltage to the lamp may be reduced so that its power consumption can be minimized while still providing enough light for whatever activity may be occurring in the lit location. The dimmer knob 1128 may be configured to allow fine control over the activity of the dimmer control, allowing small adjustments to be made to the electrical flow to the lamp. In other embodiments, the dimmer knob 1128 may have discrete settings allowing only rough control over the electrical flow to the lamp.

Although described as typically being integral components of the adapter, in some embodiments the transformer and/or dimmer control may be separate elements to which the adapter is coupled at the time of its use.

Figure 34:
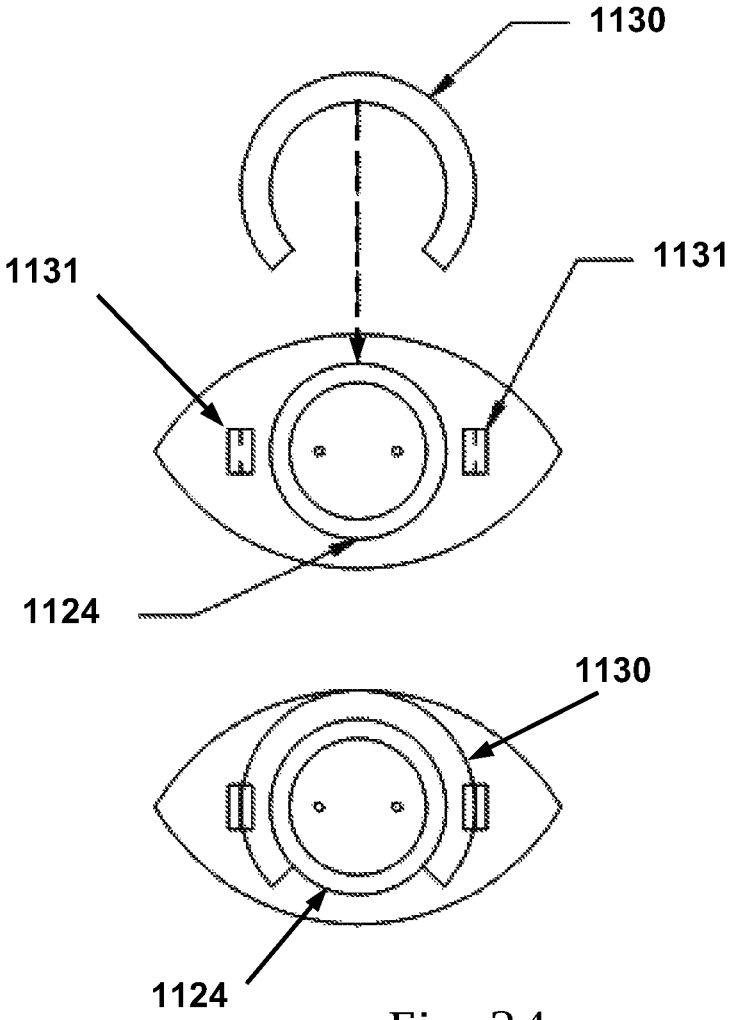
FIG. 34 is an embodiment of a coupling system for a lighting module according to the present disclosure.

FIG. 34 shows one way in which an adapter 1102 may be reversibly coupled to a reflector 1108 with a coupling system 1129. As shown in the Figure, a key 1130 may be used to lock the adapter 1102 into a semi-fixed relationship with a pair of bracket posts 1131 on a reflector 1108. To couple the adapter and the reflector, the adapter may be positioned in an opening at an end of the reflector having one or more bracket posts. The adapter may, for example, be inserted into the opening until its lock ring 1124 is substantially flush with one end of the reflector (as seen in side view in FIG. 31). Once the adapter is in place, the key 1130 may be slid or clipped into place with the bracket posts 1131.

In a typically embodiment, the bracket posts 1131 may each include a slot 1133 of substantially the same depth as the thickness of key 1130. The slots 1133 may be formed in the bracket posts at a distance away from the end of the reflector 1108 that is just slightly greater than the thickness of lock ring 1124 on the adapter. As well, the diameter of the lock ring 1124 may be greater than the diameter of the opening in the end of the reflector, and greater than the opening in the key (though likely less than the distance between the bracket posts). Thus, once the adapter is inserted into the reflector, and the key is put into place in the bracket posts, the adapter is prevented from escaping longitudinally (i.e. along the rotational axis 1114) from the reflector opening, but is still free to rotate relative to the reflector. This allows the reflector, as noted above, to be rotated to any desired position, while keeping it coupled to the adapter and, thus, its attached lamp.

Finally, as seen in FIGS. 33B-C, the adapter may include a support clip 1132. The support clip may be provided on the adapter as a way to solidify the connection between the adapter 1102 and the lamp 1106 to which it is coupled. Thus, not all the stress of coupling between the adapter and lamp will be borne by the electrical connections (e.g. the mini bi-pins); much of the coupling stress may be taken by the support clip, which may be integral with the body of the adapter. The support clip may be adjustable, or it may have a fixed size. In some embodiments, the end of the lamp having electrical connections could be inserted longitudinally through the opening of the support clip, while in other embodiments, the lamp may be partially inserted into the electrical connections and then the support clip rotated downward to clip onto the lamp.

Figure 35:
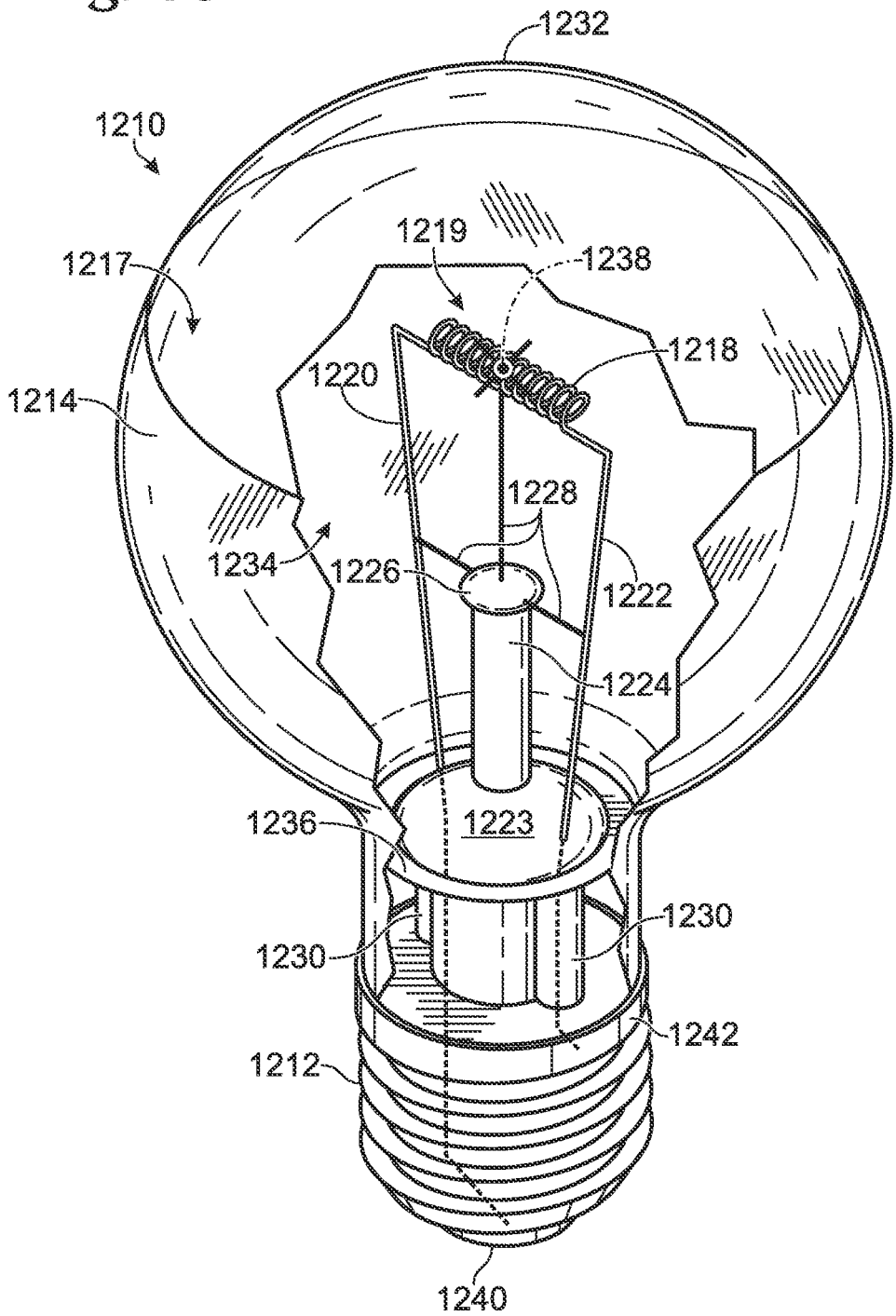
FIG. 35 is a perspective view of an example lighting apparatus according to the present disclosure.
Figure 36:
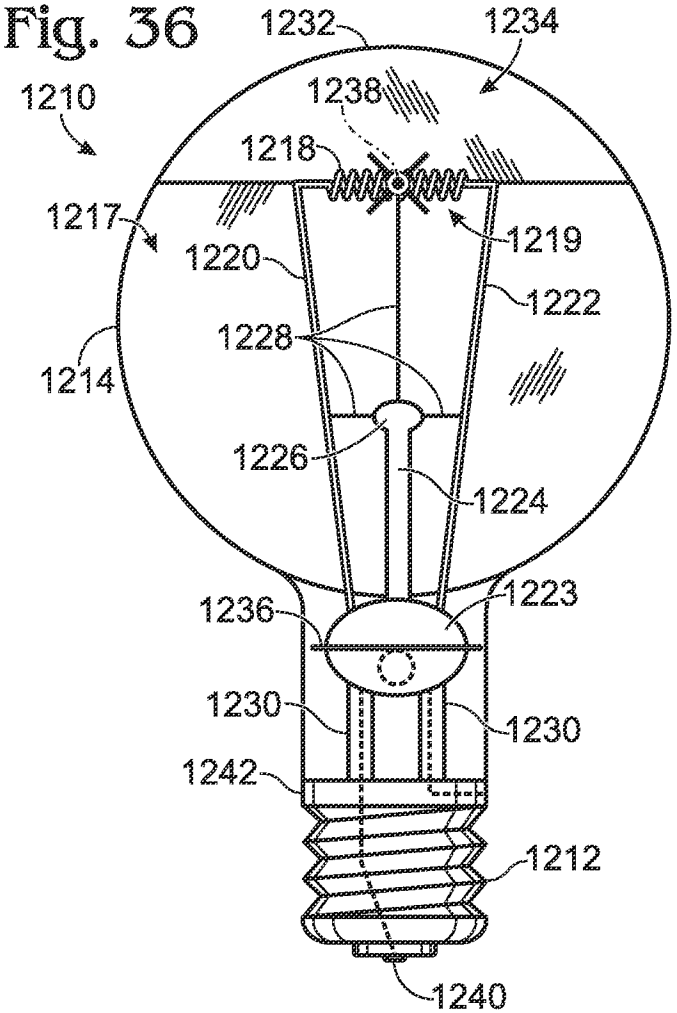
FIG. 36 is a front elevation view of the example lighting apparatus illustrated in FIG. 35.

Another example of a lighting apparatus 1210 that embodies certain features of this disclosure is illustrated in FIGS. 35 & 36. Specifically, the example illustrated in FIGS. 35 & 36 includes a light source that produces light by passing electrical current through a filament and a reflector that allows the light source to more efficiently illuminate a target illumination area. This disclosure specifically contemplates lighting apparatuses including a tungsten filament and a reflector defining a metal coating placed on the interior of lighting apparatuses' envelopes, but other lighting apparatus designs are equally within this disclosure.

The example lighting apparatus 1210 that is illustrated in FIGS. 35 & 36 includes a base 1212, a reflector 1214, an envelope 1232, a heat deflector 1236, and a light source 1219, including a filament 1218, circuitry, and support elements. The circuitry of light source 1219 includes a first wire 1220 and a second wire 1222, which are configured with base 1212 to provide electric current from a light socket to light source 1219.

The support elements of the example illustrated in FIG. 35 include a button 1226, a button rod 1224, and support wires 1228, which all function to maintain the position of filament 1218 inside envelope 1232. Reflector 1214 illustrated in FIGS. 35 & 36 defines a metal coating applied to the interior of envelope 1232.

Base 1212 illustrated in FIGS. 35 & 36 is threaded and complimentarily configured with Edison socket power sources. Specifically, base 1212 includes a center contact 1240 and an upper rim contact 1242, which are complimentarily configured with such sockets to provide power to light source 1219. Center contact 1240 and upper rim contact 1242 are configured with first wire 1220 and second wire 1222, respectively, to provide electric current from a light socket to light source 1219. In this example, first wire 1220 is connected to center contact 1240, and second wire 1222 is connected to upper rim contact 1242.

The outer surface of base 1212 in the example illustrated in FIGS. 35 & 36 is made of brass, but the use of this material is not required. Bases may have outer surfaces made of brass, aluminum, other metals, or any other conductive materials.

Base 1212 in the example illustrated in FIGS. 35 & 36 is complimentarily configured with Edison sockets, but designs of lighting apparatuses according to this disclosure are not limited to use with Edison sockets. This disclosure contemplates bases compatible with any socket generally known in the art. Specifically, this disclosure contemplates bases compatible with sockets including, but not limited to, Edison sockets, bayonet mounts, wedge base sockets, and bi-pin sockets. This disclosure additionally contemplates any necessary changes to the circuitry within the lighting apparatus necessary for compatibility with such alternative sockets. Additionally or alternatively, this disclosure contemplates lighting apparatuses with bases that are compatible with any variation in size of disclosed sockets.

The example illustrated in FIGS. 35 & 36 includes an envelope 1232 that defines an interior space 1234, within which all internal elements of lighting apparatuses are enclosed. Envelope 1232 is substantially orb shaped and narrows to a stem near the point at which it connects to base 1212. Envelope 1232 substantially encloses interior space 1234, save the area connected to and enclosed by base 1212. In the example illustrated in FIGS. 35 & 36, internal elements are enclosed by envelope 1232, including light source 1219, which includes circuitry and support elements, heat deflector 1236, and reflector 1214.

Envelope 1232 illustrated in FIGS. 35 & 36 includes a primary enclosure that is substantially orb shaped and narrows to a stern near the point at which it connects to base 1212, but this specific shape is not required. Other examples of envelope shapes may include, but are not limited to, all ANSI designated shapes and sizes of incandescent light bulbs and any other bulb shape generally understood in the art, including those designs applicable for high intensity discharge lighting apparatuses.

In the example of a lighting apparatus illustrated in FIGS. 35 & 36, envelope 1232 is substantially colorless and translucent, but this disclosure contemplates the use of envelopes of tinted with various opacities and colors. Tinting for the purposes of this disclosure may specifically include the tinting envelopes with different colors to produce colored illumination, frosting envelopes to provide softer illumination, and/or any other envelope or light bulb tinting technologies known in the art. Additionally or alternatively, examples of envelope colors and opacities may specifically include all previously disclosed opacities and colors.

Envelope 1232 illustrated in FIGS. 35 & 36 includes a gas comprising a combination of nitrogen and argon that fills the remainder of interior space 1234 not taken up by other lighting apparatus elements. This nitrogen and argon gas combination is used primarily to retard evaporation of the filament while incandescent. The specific use of a nitrogen and argon gas to fill the interior space is not required. In some embodiments, the interior space may substantially define a vacuum. Additionally or alternatively, gases other than a nitrogen and argon may be used, including, but not limited to, inert gases, such as noble gases, and halogen gases. Specifically, halogen gases may be used to redeposit atoms from the tungsten filament back to the filament as they evaporate.

The example illustrated in FIGS. 35 & 36 includes reflector 1214 designed to reflect light from light source 1219 more efficiently towards a target illumination area. Reflector 1214 includes a reflective surface substantially facing both light source 1219 and the target illumination area. In this specific example, reflector 1214 comprises a reflective metallic coating applied to the interior of envelope 1232. Reflector 1214 additionally defines a reflector interior space 1217. Reflector interior spaces, including reflector interior space 1217, include the entire area enclosed by the reflector and an infinite projection of this shape. Reflector 1214 additionally defines a focal point 1238 in interior space 1234 of lighting apparatus 1210.

Reflector 1214 in FIGS. 35 & 36 is a coating applied to the interior of envelope 1232. Reflector 1214 defines a central point substantially aligned with the center of a projection of envelope 1232's surface over the opening between envelope 1232's orb and stem. In this design, reflector 1214 defines a dome shape and is primarily designed to reflect light towards a target illumination area positioned substantially opposite base 1212.

However, reflectors according to this disclosure are not required to be so positioned. Embodiments with reflectors placed on the interior of the envelope may center the reflector at any point on the interior surface of the envelope. Additionally or alternatively, the reflector may be positioned at any point on a projection of the surface of the envelope's primary enclosure over the opening between the envelope's primary enclosure and its stem. Such variations may allow lighting apparatuses to direct reflected light towards a greater variety of target illumination areas.

This disclosure additionally or alternatively contemplates the use of reflectors substantially positioned on the exterior of the envelope. These reflectors, and their associated reflective surface, may similarly be placed at any position around the lighting apparatus. Examples of such reflectors may include, but are not limited to, a metallic coating placed on the exterior of the envelope or a body separate from the envelope that includes a reflective surface facing the light source and target illumination area.

As an additional example design, the reflector may define an additional body placed on the interior of the envelope. In some lighting apparatuses, this additional body may define a dome shaped surface placed within the envelope. In one particular example, the reflector defines a focal point and the filament or other light source of the bulb is positioned substantially at the focal point of the focal point.

As a specific, non-limiting example, this disclosure specifically contemplates reflectors disposed opposite the base and centered on the top point of the envelope opposite the base. Such lighting apparatuses may be particularly suited for reflecting light from the light source towards a target illumination substantially in the direction of the base.

Additionally or alternatively, this disclosure contemplates the use of multiple reflectors in the same lighting apparatus, including those placed on the interior and exterior of the envelope.

Reflector 1214 illustrated in FIGS. 35 & 36 defines a metallic coating applied to the interior of envelope 1232 but this design is not required. Reflectors that define a body separate from the envelope are equally within this disclosure. Such a body may be placed on either the interior or exterior of the envelope. Reflectors may additionally define a component of a light fixture in which a lighting apparatus is placed.

Reflectors defining metallic coatings applied to the interior of lighting apparatuses' envelopes may be composed of any reflective metal. Additionally or alternatively, reflectors may be composed of any reflective non-metallic material, a combination of non-metallic and metallic reflective materials, a combination of reflective and non-reflective materials, or any other suitable material.

Reflector 1214 substantially defines a cross section having the shape of a parabola, but this design is not required. This disclosure contemplates reflectors that define cross sections in the shape of a portion of a circle, a parabola, a polygon, or any other shape.

In some examples, the reflector defines a flat disc. In other examples, the reflector defines a concave shape. A wide variety of reflector shape geometries may be used. The present disclosure contemplates concave reflectors as well as reflectors defining a planar surface.

Reflector 1214 defines focal point 1238 based on its geometry. Generally, the shape, size, and position of the reflector may be used to determine the focal point for that given lighting apparatus. For example, prior discussions stated that the focal point of concave reflectors with generally circular cross sections may be defined as half the radius of the circle divided by two. For concave parabolic reflectors, the focal point may be defined as the product of one-half the maximum interior width of the parabola squared divided by four times the height of the parabola.

However, focal points need not be defined strictly by these methods. Any method of calculating the focal point of a given geometry understood in the art may be used to determine the focal point of a given reflector. Additionally or alternatively, focal points may define "effective focal points" that amount to estimations of focal points that are not determined through the use of a strict formula. Such "effective focal points" may be particularly suited for use with reflectors with polygonal cross sections that have more complex mathematical expressions for the focal point.

Lighting apparatuses may have reflectors that enclose different amounts of surface area of their respective envelopes. Such variation of reflector sizes may be used to produce light beams of varying width and/or intensity. FIG. 25A illustrates the previously discussed system of determining the size of a reflector given an angle. FIG. 25A illustrates this system using a series of example angles labeled with lower case Greek letters. Although FIG. 25A illustrates a small collection of example angle, this disclosure equally contemplates reflectors sized from 0° and 360° based on this method.

The orientation of the reflector relative to the light source may be selected to direct light to a desired target illumination area. A wide range of spacing between the reflector and the light source are appropriate for different lighting applications. Additionally or alternatively, a wide range of orientations of the tight source relative to the reflector may be used. For example, the reflector may be spaced from the longitudinal axis of the envelope adjacent the light source on a side of the light source substantially opposite the target illumination area. In other examples, the reflector intersects the longitudinal axis of the envelope.

Lighting apparatus 1210 illustrated in FIGS. 35 & 36 includes light source 1219, which includes filament 1218, circuitry, and support elements. The electrical circuitry of the light source includes first wire 1220 and second wire 1222, which are configured with base 1212. As previously stated, first wire 1220 is electrically connected to center contact 1240 and second wire 1222 is electrically connected to upper rim contact 1242. This circuitry is designed to provide electric current to light source 1219 from a light socket.

The electrical circuitry additionally includes a fuse 1230 through which both first wire 1220 and second wire 1222 pass. The support elements of the example illustrated in FIGS. 35 & 36 include a stem press 1223, a button 1226, a button rod 1224, and support wires 1228. These support elements serve as a means to maintain filament 1218's position substantially at focal point 1238 of lighting apparatus 1210.

The example illustrated in FIGS. 35 & 36 includes circuitry, including first wire 1220 and second wire 1222, that is complimentarily configured with the base to deliver an electrical current to filament 1218. First wire 1220 is connected to the center contact 1240 on one end, and one end of filament 1218 on the opposite end. Second wire 1222 is connected to the opposite end of filament 1218 on one end, and upper rim contact 1242 on the opposite end.

First wire 1220 and second wire 1222 pass through fuse 1230 to protect the lamp and external power circuit if filament 1218 arcs. Additionally, first wire 1220 and second wire 1222 pass through stem press 1223 near base 1212. The entirety of this circuitry is designed to produce an electrical current that is delivered to and from base 1212 via an electrical socket, and that passes through filament 1218 to produce light.

Both first wire 1220 and second wire 1222 pass through fuse 1230 between their respective connections with filament 1218 and contacts with base 1212. Fuse 1230 protects the device and electrical circuit in which the lighting apparatus is installed if filament 1218 arcs. Fuse 1230 in this example defines a standard incandescent light fuse. However, fuses according to the present disclosure may take any design of incandescent light fuses currently understood in the art.

The circuitry in the example illustrated in FIGS. 35 & 36 includes first wire 1220 and second wire 1222, which are made of copper between base 1212 and stem press 1223 and of nickel-plated copper between stem press 1223 and filament 1218. However, the use of these materials is not required, nor is the use of different wires inside and outside of the stem press. Wires made of any capably conductive material are equally within this disclosure. Specific wire materials may include, but are not limited to, copper, nickel, nickel plated copper, and other materials generally known to be used for electrical wiring in the art.

The circuitry designs described above are merely illustrative. Any means used to direct electric current from a socket, base, or other power source to the filament are equally within this disclosure.

The lighting apparatus example 1210 illustrated in FIGS. 35 & 36 includes a support system that includes a button 1226, button rod 1224, stem press 1223 and a collection of support wires 1228 that maintain filament 1218's position substantially at the focal point of reflector 1214. Stem press 1223 is connected to base 1212, button rod 1224 is connected to the top of stem press 1223, and button 1226 is connected to the top of button rod 1224.

Stem press 1223, button rod 1224, and button 1226 are all made of a glass, and are connected by heating the glass during manufacturing. Support wires 1228 project from button 1236, are connected to one or all of first wire 1220, second wire 1222, and filament 1218, and are configured to hold filament 1218's position at the focal point of reflector 1214. This specific design is not required however, and any means for maintaining the filament's position inside the reflector is equally within this disclosure.

Figure 37:
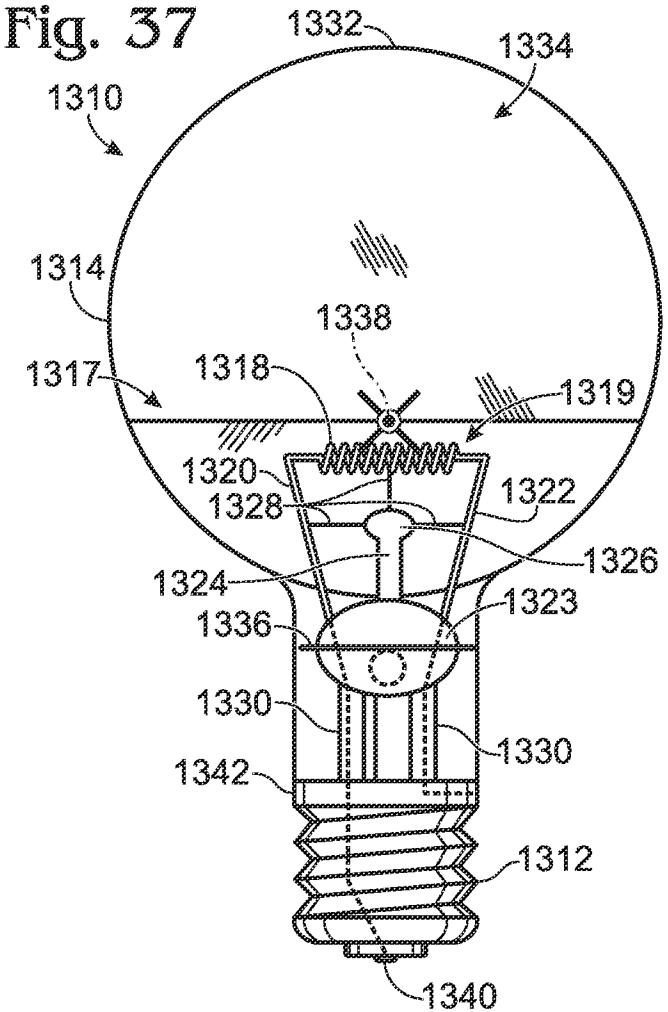
FIG. 37 is a front elevation view of an example lighting apparatus according to the present disclosure with the light source oriented away from the focal point of the reflector.

The support system of lighting apparatus example 1210 illustrated in FIGS. 35 & 36 maintains the position of filament 1218 at the focal point of reflector 1214, but this position in not required. This disclosure specifically contemplates positioning the filament at non-focal point locations in the interior space of the envelope. Additionally, as shown in FIG. 37, this disclosure specifically contemplates placement of the filament anywhere in the interior space in order to focus light from the lighting apparatus at different angles.

Placement of the reflector inside of the envelope has been observed to improve energy efficiency by reducing the frequency of light passing through or reflecting off mediums, such as glass envelopes or reflectors. When light passes through a medium or reflects off of a surface, a certain percentage of the incident light tends to be absorbed or diffused, which reduces the light available to irradiate the target illumination area. By not directing the light through the glass envelope multiple times, which may occur when the reflector is mounted outside the envelope, the illumination efficiency has been observed to improve.

The example of a lighting apparatus illustrated in FIGS. 35 and 36 includes a coiled tungsten filament 1218 that generates light when exposed to particular levels of electric current. Additionally or alternatively, the light source may include a high intensity discharge lamp, such as high pressure sodium lamps or metal halide lamps, or any other known light source technology.

With reference to FIGS. 35 and 36, an electrical current is delivered to filament 1218 from base 1212 through first wire 1220, and delivered from filament 1218 back to base 1212 through second wire 1222. The passage of the electric current through filament 1218 produces light through incandescence, or passing sufficient current through the filament to heat it to a temperature in which the filament produces light.

Filament 1218 in the example illustrated in FIGS. 35 & 36 is coiled in shape. This design is not required, and this disclosure contemplates all filament geometries generally known in the art. Examples of filament designs include, but are not limited to, straight wires, coiled wires, and coiled-coil designs.

Additionally, filament 1218 in FIGS. 35 & 36 follows a substantially straight path parallel to stem press 23 between first wire 1220 and second wire 1222 and has a length substantially equal to the width of stem press 23. Filaments of any length that are able to fit within the interior space of a lighting apparatus are equally within this disclosure. Additionally, filaments are not required to follow a substantially straight path between the first and second wires.

The example illustrated in FIGS. 35 & 36 includes a filament 1218 that is made of tungsten. Filament materials are not, however, limited to tungsten.

The example of a lighting apparatus illustrated in FIGS. 35 & 36 includes a heat deflector 1236 placed in the stem of envelope 1232. Heat deflectors are generally used in higher wattage lighting apparatuses and other lighting apparatuses that operate at higher temperatures to reduce the circulation of heat into the neck bulb. Heat deflector 1236 illustrated in FIGS. 35 & 36 includes a reflective surface on the side facing the light source, which allows heat deflector 1236 to reflect light directed at heat deflector towards the lighting apparatus's target illumination area. Additionally or alternatively, heat deflectors according to this disclosure may perform only the disclosed light reflection functionality, and such heat deflectors are not required to substantially deflect heat.

Turning attention to FIG. 37, a lighting apparatus 1310 will now be described. Lighting apparatus 1310 includes a base 1312, a reflector 1314, an envelope 1332, a heat deflector 1336, and a light source 1319, including a filament 1318, circuitry, and support elements.

The circuitry of light source 1319 includes a first wire 1320 and a second wire 1322, which are configured with base 1312 to provide electric current from a light socket to light source 1319. The support elements of the example illustrated in FIG. 37 include a button 1326, a button rod 1324, and support wires 1328, which all function to maintain filament 1318 position inside envelope 1332 and away from focal point 1338. Reflector 1314 illustrated in FIG. 37 defines a metal coating applied to the interior of envelope 1332.

FIG. 37 includes a filament 1318 that is placed away from the focal point of reflector interior space. Indeed, filament 1318 is spaced vertically from focal point 1338 towards base 1312. The magnitude of the filament's spacing from the focal point can be selected to achieve desired illumination properties. Indeed, this disclosure contemplates lighting apparatuses that include filaments placed at any point in the reflector interior space defined the lighting apparatus's reflector. As previously stated, the reflector interior space of a lighting apparatus includes the entire area enclosed by the reflector and an infinite projection of this area in the direction opposite the base.

Additionally or alternatively, this disclosure specifically contemplates implementing the functionality and design described in connection with incandescent bulbs to other enclosed envelope style of lighting apparatuses. For example, the reflectors, light source circuitry, and light source support element features described above may apply to lighting apparatuses other than incandescent lighting apparatuses. As a specific example, features described above in connection with incandescent bulbs may be applied to lighting apparatuses incorporating high intensity discharge lamps.

Figure 40A:
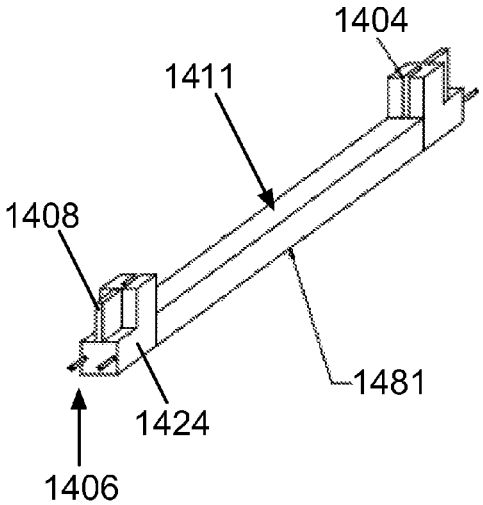
FIG. 40A is a perspective view of an embodiment of a frame with a substantially planar upper surface.
Figure 40B:
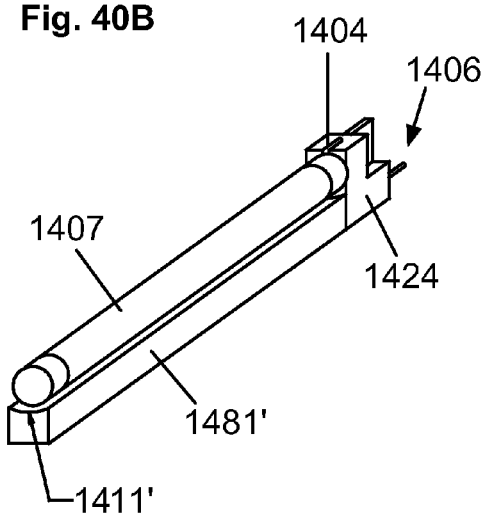
FIG. 40B is a perspective view of an embodiment of a frame with an end cap removed to show a curved and reflective upper surface of the frame.
Figure 41:
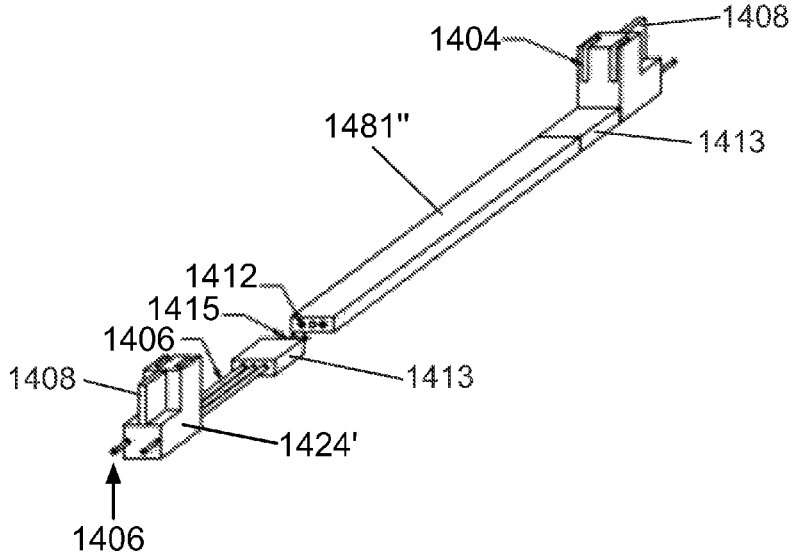
FIG. 41 is another embodiment of a frame for supporting a light for use in a lighting module according to the present disclosure.
Figure 44:
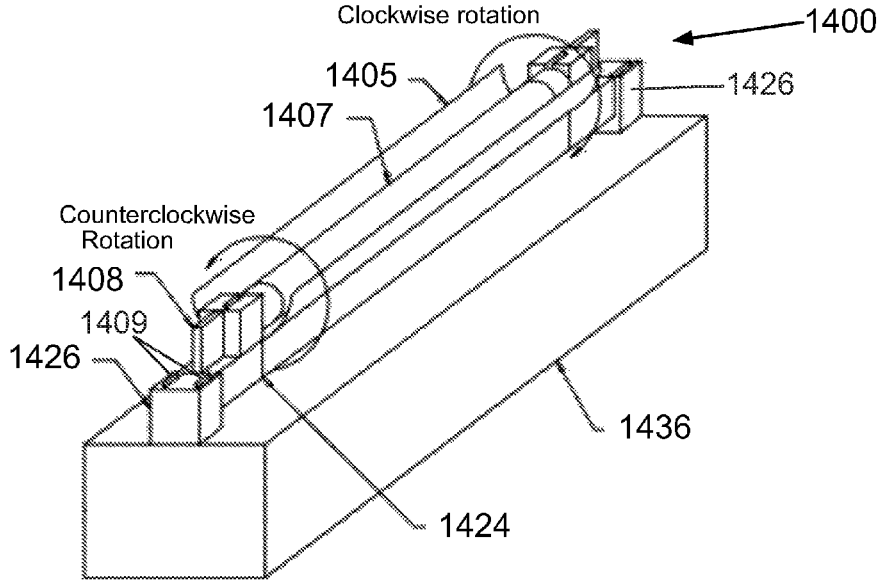
FIG. 44 is an embodiment of an adjustable light source in use with a light fixture.
Figure 42:
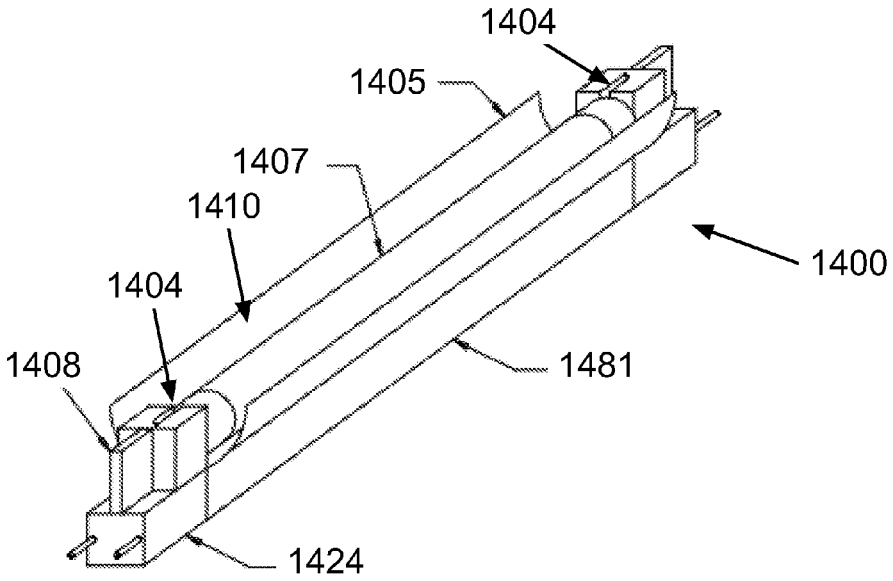
FIG. 42 is an embodiment of an adjustable light source showing an included lamp in an interior position relative to its reflector, according to the present disclosure.

FIGS. 38 through 44 are embodiments and elements of adjustable light sources for use in a lighting module according to the present disclosure. As shown in FIG. 42, an adjustable light source 1400 includes a reflector 1405, a frame 1481, and light source or lamp 1407. In FIG. 44, adjustable light source 1400 is mounted on an optional light fixture 1436. With further reference to FIG. 44, adjustable light source 1400 is electrically coupled to light fixture 1436 tombstones 1426.

Adjustable light source 1400 is configured to rotate relative to fixture 1436 and tombstone 1426. The structure enabling light source 1400 to rotate will be explained in more detail below. In operation, a user may conveniently direct the light emitted by light source 1400 to a desired target illumination area without needing to move light fixture 1436. Indeed, directing light from light source 1400 to a target illumination area may be accomplished by rotating light source 1400 into a position where an increased portion of its emitted and reflected light is incident on the target illumination area.

Figure 38:
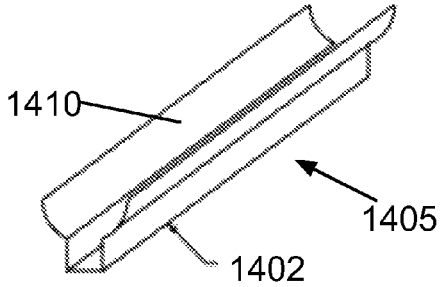
FIG. 38 is perspective view of an embodiment of a selectively attachable reflector for a lighting module according to the present disclosure.
Figure 39:
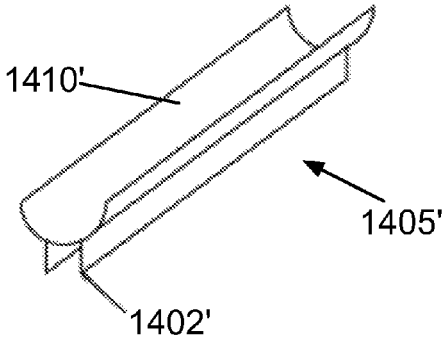
FIG. 39 is a perspective view another embodiment of a selectively attachable reflector for a lighting module according to the present disclosure.

FIGS. 38 and 39 show embodiments of reflectors 1405 and 1405', respectively, for use in adjustable light source 1400. Reflector 1405 shown in FIG. 38 defines a curved portion having a reflective exterior surface 1410 and defining a focal point of light reflected from reflective exterior surface 1410. As shown in FIG. 38, reflector 1405 may be paraboloid in shape, or semicylindrical or any other appropriate shape. Reflector 1405 further includes a reflector clip 1402 extending from a gap in the curved portion.

In the example shown in FIG. 39, reflector 1405' defines a continuous curved portion having a reflective surface 1410'. As with reflector 1405, reflector 1405' may adopt any useful shape, such as a portion of a cylinder or elongate shape having a cross section defining a portion of an ellipse, a regular polygon, or any other a concave shape. Reflector 1405' further includes a reflector clip 1402' extending from the curved portion.

In both reflector 1405 and 1405', the reflector clip serves to couple the modular reflectors to frame or ballast housing 1481. The reflector clip may hold the reflector in a position such that the reflector's reflective surface 1410 or 1410' is appropriately placed relative to light source or lamp 1407.

Although shown as being removable in FIGS. 38 and 39, in some embodiments the reflector and frame form a unitary structure where the reflector is coupled to the frame in a substantially permanent manner.

FIGS. 40A and 40B show two embodiments of the frame, namely frame 1481 and 1481'. Frames 1481 and 1481' shown in FIGS. 40A and 40B are substantially the same except for the shape of their upper, reflective surface 1410 and 1410', respectively. Accordingly, frame 1410 will be described in detail in the following paragraphs and the reader should understand that the description applies to frame 1481' as well, except as specifically noted.

For example, the embodiments of FIGS. 40A and 40B differ in the shape of their upper surfaces 1411 and 1411' of their frames, or ballast housings, 1481 and 1481', respectively. As can be seen in FIG. 40A, upper surface 1411 (which may be reflective) is substantially planar. As shown in FIG. 40B, upper surface 1411' (which may be reflective) defines a concave curve. The concavity upper surface 1411' may take any appropriate shape, but in a typical embodiment designed such that an accompanying lamp resides at a focal point defined by the concavity itself or in combination with a complimentarily configured curved portion of a reflector, which is described in more detail below.

In either case, the reflector 1405 may be appropriately shaped to couple to the upper surface of the frame to which it is coupled. In the case of concave upper surface 1411', its concavity is complimentarily configured with the gap in concave inner surface 1410 of reflector 1405 to form a substantially continuous curved, reflective exterior surface facing lamp 1407.

Frame 1481 supports the other components of adjustable light source 1400. As shown in FIG. 40A, frame 1481 includes two end caps 1424 that serve to electrically couple adjustable light source 1400 to optional light fixture 1436. End cap 1424 includes a single electrically conductive slide track configured to receive an electrically conductive pin. With brief reference to FIG. 41, the reader can see an example of an end cap 1424', which includes two electrically conductive slide tracks.

Figure 43:
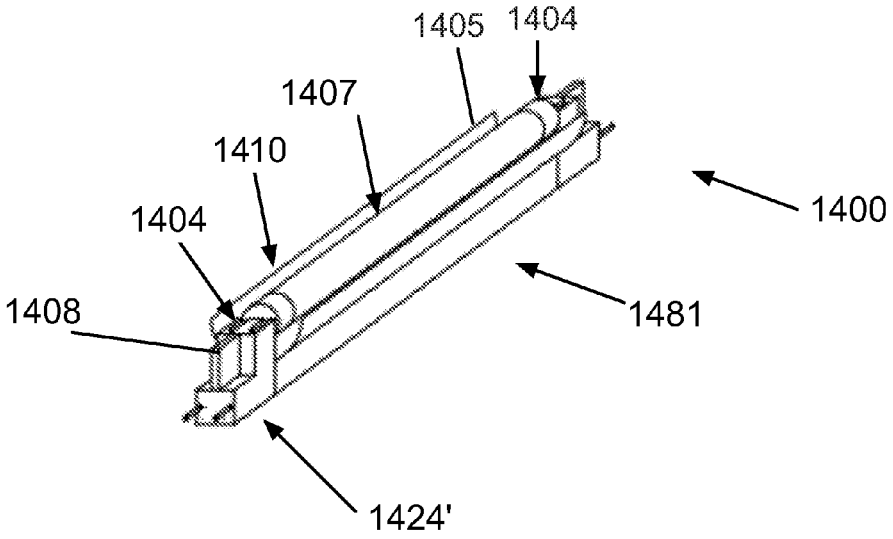
FIG. 43 is an embodiment of an adjustable light source showing an included lamp in an exterior position relative to its reflector, according to the present disclosure.

As shown in FIGS. 40A, 42, and 43, end caps 1424 include two leads 1406 that provide an electrical connection between lamp 1407 and light fixture 1436. Leads 1406 are electrically coupled to slide tracks 1409 formed in tombstone 1426, which is electrically connected to light fixture 1436. Light fixture 1436 is in turn electrically connected to a power supply, such power provided by a local utility or power stored in a power storage device.

With reference to FIGS. 40A and 41-44, end cap 1424 is provided with a grip 1408 to adjust the position of light source 1400 relative to light fixture 1436. Turning grip 1408 rotates light source 1400 relative to light fixture 1436. Light source 1400 is able to rotate due to left and right pins 1406 moving in opposite vertical directions inside electrically conductive slide tracks 1409, which define vertical channels.

In the example shown in FIG. 44, light source 1400 rotates counterclockwise when the pins oriented to the left of the page on each longitudinal end of light source 1400 move in their respective slide tracks 1409 toward the bottom of the page and the pins oriented to the right of the page move toward the top of the page. Light source 1400 rotates clockwise when the pins oriented to the right of the page on each longitudinal end of light source 1400 move in their respective slide tracks 1409 toward the bottom of the page and the pins oriented to the left of the page move toward the top of the page.

As can be seen from FIGS. 40A and 40B, slide tracks 1404 define elongated electrical couplers, rather than point source connections, to which an accompanying lamp 1406 connects. In a typical embodiment, and the embodiments illustrated in FIGS. 40A and 40B, slide tracks 1404 allow lamp 1407 to receive electrical power throughout a range of positions along slide track 1404. The range of positions of lamp 1407 are described in more detail below with reference to FIGS. 42 and 43.

In some embodiments, it may be that the slide tracks selectively or constantly restrict the lamp from sliding within the tracks. In these embodiments, moving the reflector relative to the lamp may compensate for limited movement of the lamp.

For example, as seen in FIGS. 38 and 39, reflectors 1405 and 1405' include reflector clips 1402 and 1402', which enable the reflectors to move closer to or farther away from a lamp. The size and shape of the reflector clip are complimentarily configured with frame 481 such that the reflector clip may travel in a vertical direction once coupled to the frame. Thus, additionally or alternatively to moving the lamp within the slide tracks to change the lamp's position relative to the focal point defined by the reflective exterior surface, the lamp may be held substantially stationary while the reflector moves relative to the lamp. In the latter case, the position of the lamp relative to the focal point defined by the reflective exterior surface is adjusted by moving the reflector instead of the lamp.

As discussed above, adjustable light source 1400 is connected to optional light fixture 1436 in a manner enabling light source 1400 to move relative to light fixture 1436. In the illustrated embodiments, such as shown in FIG. 44, light source 1400 may be rotated (relative to the long axis of lamp 1407) both clockwise and counterclockwise. Grips 1408 facilitate a user rotating light source 1400 to a desired position by providing a surface against which torque may be applied by the user.

Rotating light source 1400 allows for efficient directional aiming of the light emanating from lamp 1407 and the light reflected from reflector 1405. Rotating the entire light source 1400 helps to efficiently direct light to a desired target illumination area because reflector 1405 rotates along with lamp 1407. In some examples, lamp 1407 is positioned substantially at the focal point defined by reflector 1405. In such examples, the enhanced light focusing effect resulting from the relative position of the lamp and the reflector combination is unaffected by rotating the light source with grips 1408.

Additionally or alternatively, lamp 1407 may be rotated relative to end caps 1424 while retaining an electrical connection with slide tracks 1404. The leads or pins of lamp 1407 are inserted into, or otherwise coupled to, slide tracks 1404, which define electrically conductive surfaces. The inner, electrically conductive surfaces of slide tracks 1404 define bearing surfaces against which the pins of lamp 1407 may rotate.

FIG. 41 depicts another embodiment of a frame 1481" for supporting components of an adjustable light source. As can be seen, the embodiment of FIG. 41 shows that the adjustable light source may include both adjustable and modular components. Frame 1481" defines a female socket 1412 at each of its ends for receiving pins 1415 of a male plug 1413. Male plug 1413, in turn, is configured to couple to end caps 1424' by one or more leads 1406. As seen in the Figures, endcap 1424' may be quite similar to an endcap 1424, with the main difference, here and in other embodiments, being that endcap 1424' includes a pair of slide tracks 1404 while endcap 1424 includes a single slide track 1404.

Leads 1406 may be reversibly connected to the end caps, or they may pass through the end caps, terminating in connections to which a light fixture may be coupled. Including female sockets and male plugs allows for modular coupling of one or more components of the light source and also allows for fast and efficient coupling of the leads to a chosen adapter.

FIGS. 42 and 43 show lamp 1407 positioned proximate and distal the apex of curved exterior surface 1410 of reflector 1405, respectively. Positioning lamp 1407 at different positions relative to reflector 1405, in particular to the focal point defined by reflector 1405, serves to adjust the illumination properties of the light source, such as from focused to diffused light. FIG. 42 depicts light source 1400 with lamp 1407 in an interior position relative to reflector 1405, which may also be described as lamp 1407 being proximate to the reflector apex.

In FIG. 42, lamp 1407 is coupled to slide tracks 1404, which as noted earlier allow lamp 1407 to be moved to an upper or lower position in the tracks. Here, lamp 1407 resides substantially within the confines of reflector 1405, i.e., substantially below the upper edge of reflector 1405, by being placed at or near the lower portion of slide tracks 1404. In some examples, lamp 1407 is positioned at the focal point defined by reflector 1405. In still other examples, lamp 1407 is positioned at a position below the focal point.

In FIG. 43, by contrast, lamp 1407 is positioned at an exterior position relative to its reflector and in comparison to the interior position shown in FIG. 42. As can be seen in FIG. 43, lamp 1407 is positioned substantially outside the confines of reflector 1405, i.e., substantially at or above the upper edge of reflector 1405, by being placed at or near the upper portion of slide tracks 1404. In this position, light from lamp 1407 may be less focused by the reflector 1405, and thus may throw a relatively diffuse light. With these movements along slide tracks 1404, the property of light directed to a target illumination area can be controlled by a user.

As described above and shown in FIG. 44, adjustable light source 1400 be used with a light fixture, such as a fluorescent light fixture 1436. As noted above, lamp 1407 may be adjusted up and down within slide tracks 1404. As shown in FIG. 44, light source 1400 may also be rotatably adjusted within slide tracks 1409 of tombstones 1426. Here, light source 1400 may be rotated either clockwise or counterclockwise, or both, a user grasping the grips 1408 of the light source. When the light source is configured to be coupled and rotated in this way, the ballast may reside in any of at least three locations: in the light fixture; in the light source; or a combination of circuitry in the light source and ballast it the light fixture.

Figure 45:
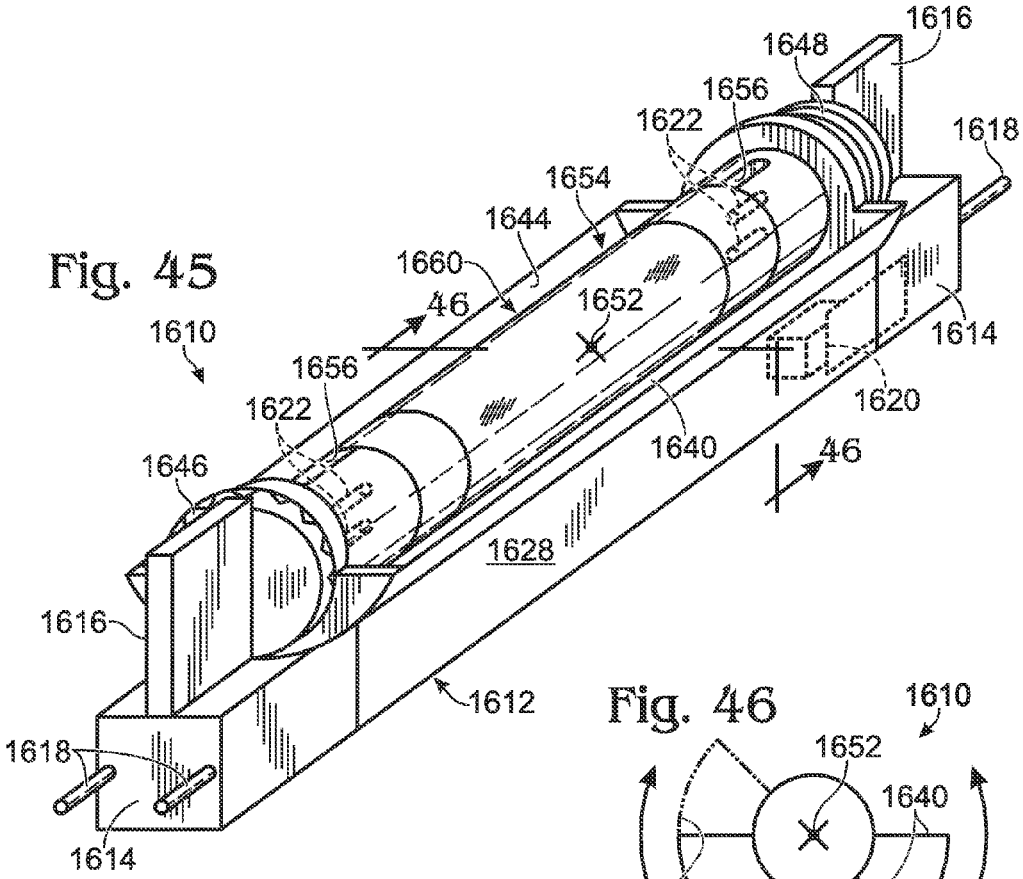
FIG. 45 is a perspective view of an embodiment of an adjustable light source with a movable reflector.
Figure 46:
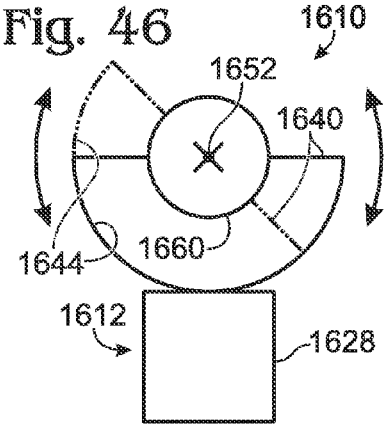
FIG. 46 is a cross section of the embodiment of an adjustable light source depicting the rotation of the reflector.
Figure 48:
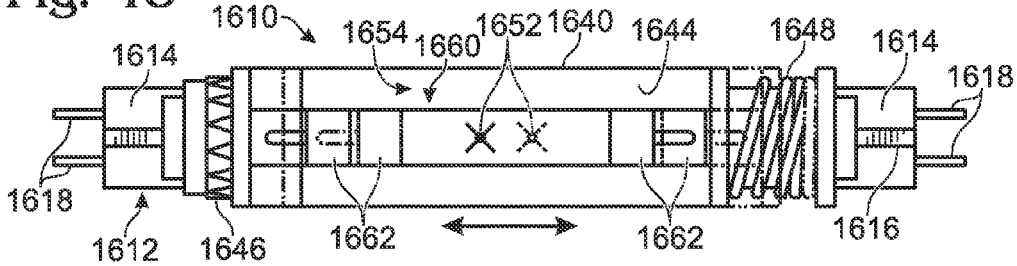
FIG. 48 is a top view of the embodiment of the adjustable light source illustrated in FIG. 45.

Turning attention to FIGS. 45, 46, and 48, a further example of a lighting apparatus 1610 includes a frame 1612, a reflector 1640, a light source 1660, and several sub-elements associated with these elements. Lighting apparatus 1610 efficiently illuminates a target illumination area through the use of reflection technologies previously discussed in this disclosure in combination with newly disclosed elements and functionalities. Specifically, lighting apparatus 1610 is configured for reflector 1640 to selectively move, which allows lighting apparatus 1610 to achieve a variety of lighting angles and intensities while targeting a greater variety of target illumination areas. Lighting apparatus 1610 substantially defines a lighting fixture, however many of the inventive elements of this disclosure may be equally applied to lighting apparatuses designed for placement in an external fixture or lamp.

As can be seen in FIG. 45, frame 1612 physically supports reflector 1640 and light source 1660. Frame 1612 additionally includes end caps 1614, finger grips 1616, lead 1618 for connection to an external power source, a circuit 1620, and a center body 1628.

Frame 1612 illustrated in FIG. 45 substantially defines a plastic body that is primarily used to support lighting apparatus 1610. Additionally or alternatively, frame 1612 may be designed to affix lighting apparatus 1610 to a physical location, such as a wall, ceiling, lamp, or other known means for supporting lighting apparatuses.

End caps 1614 are physically attached to frame 1612 at each longitudinal end of center body 1628. End caps 1614 each include a lead 1618 for connecting to an external power source. Leads 1618 illustrated in FIG. 45 define a double pin design routed through one end cap 1614 and are electrically connected to circuit 1620. However, leads according to this disclosure are not so limited and designs may include any design that a given power source and/or fixture requires.

Circuit 1620 is physically positioned within frame 1612 and is electrically connected to an external power source through leads 1618 and to light source 1660. Circuit 1620 primarily functions to convert power from an external power source to a rating compatible with light source 1660. Circuit 1620 includes a ballast and transformer to control the voltage and current, respectively. However, any circuit design understood to convert electrical power to different ratings is equally contemplated by this disclosure.

Frame 1612 includes a pair of finger grips 1616 attached to end caps 1614. Finger grips 1616 primarily allow a user to grip lighting apparatus 1610 and to rotate reflector 1640, such as in the manner described below. Finger grips 1616 may additionally provide additional support to reflector 1640. Additionally or alternatively, some embodiments may include finger grips that are attached to the reflector, and the finger grips may control the rotational adjustment of the reflector.

Lighting apparatus frames according to this disclosure may additionally be designed with a support connector that better allow frame 1612 to be implemented in different contexts. For example, frames may be configured for use with track lighting systems and/or other lighting systems generally understood in the art. Support connectors may additionally or alternatively define a permanent connection to a connected means for supporting lighting apparatuses, such as a tripod, stand, or other arrangement.

In the example shown in FIG. 45, reflector 1640 includes a reflective surface 1644, a handle 1646, a spring 1648, a positioning implement 1650, and a notch 1656 for attaching light source 1660. In the present example shown in FIGS. 45 and 46, handle 146 defines a disk and the disk defines gear teeth along the radial periphery of the disk.

Reflector 1640 illustrated FIG. 45 has a cross section substantially in the shape of a parabola perpendicular to its length, but reflective surfaces according to this disclosure may define any convex shape. As a non-limiting example, reflectors adapt a variety of shapes, including cross sections having a "w" shape, cross sections defining regular polygons, cross sections defining an elliptical polygon, and other convex designs. As a point of reference, FIG. 25B illustrates the longitudinal cross sections of a non-exclusive collection of potential reflective surface designs.

Reflector 1640 is attached to center body 1628 and configured such that reflective surface 1644 is able to rotate around an axis defined by the longitudinal axis of light source 1660. This rotation, viewed as a cross section of lighting apparatus 1610, is illustrated in FIG. 46. Users of different embodiments of lighting apparatuses according to this disclosure may rotate reflectors in a variety of ways; two specific ways are described below.

Lighting apparatus 1610 illustrates the first of these example rotating reflector designs. A user may rotate reflector 1640 by gripping and applying force to finger grips 1616 in order to rotate both the finger grip 1616 and reflector 1640.

As a second example, a user may rotate the reflector by gripping and applying force directly to the reflector. Embodiments of lighting apparatuses according to this disclosure may implement one or both of these functionalities. Additionally or alternatively, rotating reflectors may take designs different than the specific ones described provided they fulfill rotating reflector functionality.

As illustrated FIG. 45, reflective surface 1644 defines a convex shape that surrounds light source 1660 and substantially defines a series of focal points 1652. Differently stated, reflector 1640 could be said to define a series of focal points 1652 that extend along the length of reflector 1640. Focal points for the purposes of this disclosure may include focal points defined by any method previously recited in this disclosure.

Reflective surface 1644 defines a reflector interior space 1654 that includes an infinite projection of reflective surface 1644 in both directions.

Reflective surface 1644 illustrated in FIG. 45 includes a dust and water repellant coating. The coating applied to reflective surface 1644 is preferably also highly reflective. The combination of the reflectivity and dust and water repellence allows lighting apparatus 1610 to generate light towards a target illumination area with a reduced loss of energy resulting from light being absorbed into or passing through the reflective surface. The coating on reflective surface 1644 additionally reduces the amount of heat created by the aforementioned absorption of light. Although reflective surface 1644 includes such a coating, any reflective material, whether coated or not, may be used to substantially achieve the inventive elements of the present disclosure.

Lighting apparatus 1610 and, by extension, reflector 1640 are designed to allow the longitudinal position of reflector 1640 to be adjusted. This allows lighting apparatus 1610 to direct light towards a target illumination at a greater variety of lighting angles and intensities while remaining at substantially the same physical position. Lighting apparatus 1610 additionally includes a positioning mechanism, which allows reflector 1640 to be positioned at different points along light source 1660's longitudinal axis.

This disclosure specifically describes three examples of positioning mechanisms. Lighting apparatus 1610 includes a first example of such a positioning mechanism, which controls the position of reflector 1640 in a manner somewhat similar to the retraction mechanism of a twist-controlled retractable ball point pen. An illustration displaying this positioning mechanism's operation is provided in FIG. 48.

The positioning mechanism illustrated in FIG. 48 includes a threaded bar connected to the center of handle 1646. The threaded bar is routed through and complimentarily configured with a hole on the side of reflector 1640 proximate handle 1646. A user may control the position of reflector 1640 by turning handle 1646, which rotates the attached threaded bar; this moves reflector to different points along frame 1612. Spring 1648 is used to provide resistance to reflector 1640 from the opposite side, which may allow lighting apparatuses to more specifically target particular reflector positions.

Although a specific mechanism is disclosed in the previous paragraph, this disclosure contemplates other twist adjustment systems as a positioning mechanism.

Lighting apparatuses according to this disclosure may additionally include a spring and lock system, somewhat similar to the retraction mechanism of certain lockable and retractable pens. In this design, a series of protrusions may be positioned on the frame that is complimentarily configured with a retractable protrusion on the bottom of the reflector. The reflector protrusion and frame protrusions are complimentarily configured to allow for motion only in the direction towards the spring while the reflector protrusion is extended, and to allow motion in both directions when the reflector protrusion is retracted. The spring applies force to the reflector in the direction of the end of the frame distal the spring.

In embodiments including a spring and lock system, the movement of the reflector between various locked positions is controlled by manual force; however, a handle and threaded bar mechanism as listed above may also be used to control and power the reflector's longitudinal movement. As a result of the force from the spring and the protrusion configuration, a user may lock the reflector in several positions along the length of the frame. For the purposes of this disclosure, a spring and lock system refers to the functionality described in the preceding paragraphs and other functionally equivalent systems understood in the art.

Additionally or alternatively, this disclosure contemplates a lighting apparatus including a reflector that is manually movable along the length of the frame. In such a design, the reflector is affixed to the frame in a way that allows a user to grip and manually apply force along the frame's longitudinal axis to position the reflector at various locations along the length.

In some embodiments, reflectors may include a reflector clip connected to the bottom of the reflector. The reflector clip is complimentarily shaped and sized with the center body of the frame in a way that allows the reflector to be supported in a position by the frame. The reflector clip and center body are designed such that the reflector may be positioned in a variety of vertical positions relative to the frame. This vertical movement substantially allows a user to vertically adjust the focal point defined by the reflective surface.

Reflector 1640 additionally includes notch 1656, which is primarily used for attaching light source 1660. Notch 1656 is electrically connected to circuit 1620 and is designed to deliver electrical power of a compatible rating to light source 1660. Notch 1656 is complimentarily configured with light source 1660; in this example notch 1656 defines a T5 tombstone notch compatible with a complimentary configured light source end cap 1662 that is attached at the end of light source 1660. This specific design is not required, however, and any means for electrically and physically connecting light source 1660 to lighting apparatus 1610 at a position inside reflector interior space 1654 is equally within this disclosure.

In the example shown in FIG. 45, lighting apparatus 1610 includes light source 1660 placed substantially at the focal point of reflective surface 1644. Light source 1660 defines a fluorescent tube lamp and includes light source end cap 1662, which is complimentarily configured with notch 1656 in the manner stated above. Although light source 1660 defines a fluorescent lamp, any electrically powered light source known in the art may equally fulfill the primary functionalities of this disclosure. Specifically, light sources do not need to have the elongated, tubular shape illustrated, but rather may define any shape that may be fit inside a given lighting apparatus's reflector.

Figure 47:
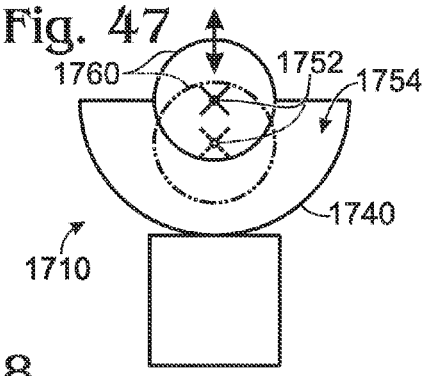
FIG. 47 is a cross section of an embodiment of an adjustable light source with a movable light source depicting the adjustability of the light source.
Figure 49:
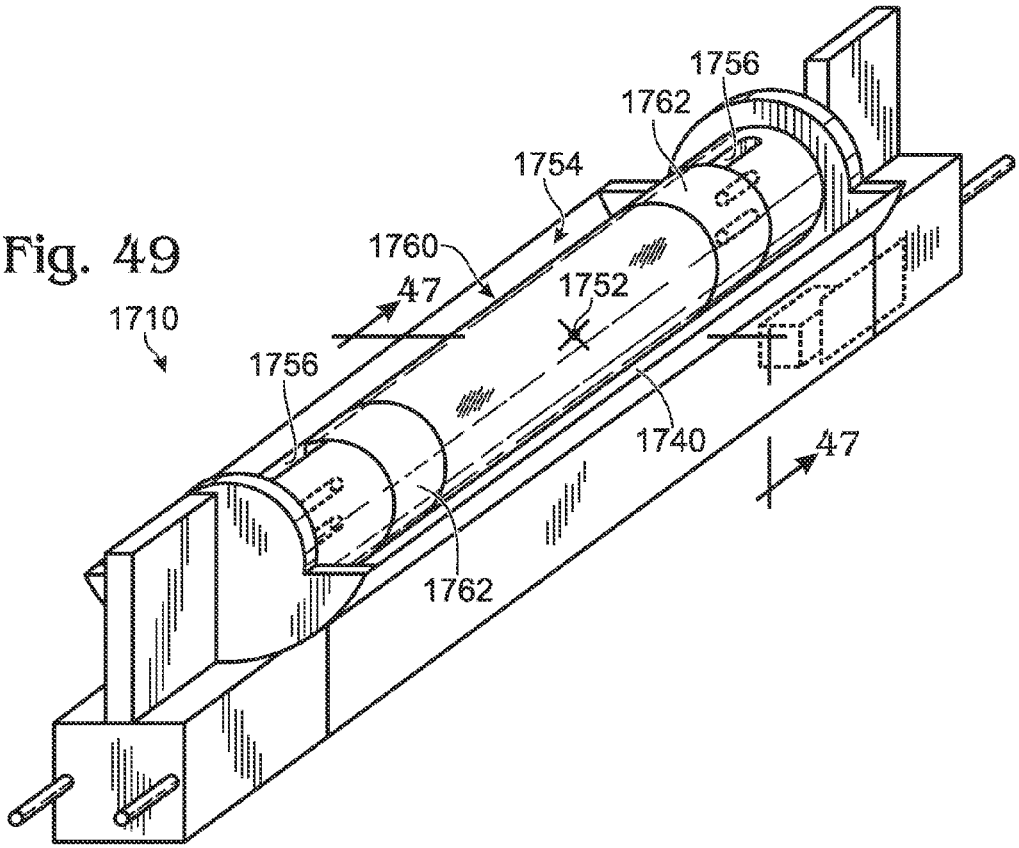
FIG. 49 is a perspective view of the embodiment in FIG. 47.
Figure 50:
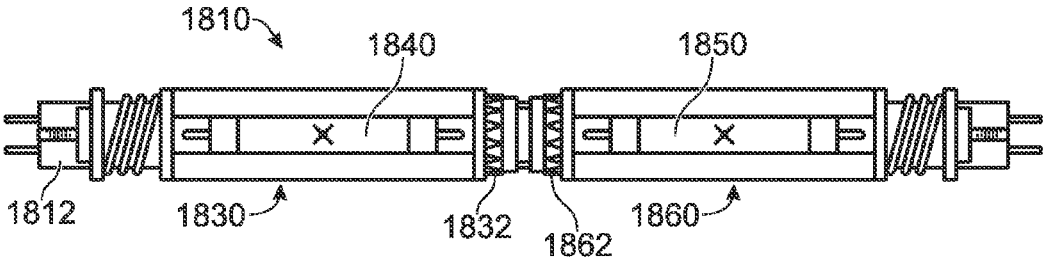
FIG. 50 is an elevation view of an additional embodiment of an adjustable light source.

Turning attention to FIGS. 47 & 49, another example of a lighting apparatus 710 will now be described. Lighting apparatus 1710 includes many similar or identical features to lighting apparatus 1610. Thus, for the sake of brevity, each feature of lighting apparatus 1710 will not be redundantly explained. Rather, key distinctions between lighting apparatus 1710 sand lighting apparatus 1610 will be described in detail and the reader should reference the discussion above for features substantially similar between the two lighting apparatuses.

The movable reflector functionality listed above is not included in lighting apparatus 1710 illustrated in FIGS. 47 & 49, though those technologies may be implemented in lighting apparatuses similar to lighting apparatus 1710. Rather, lighting apparatus 1710 includes a design that allows a light source 1760 to move vertically inside a reflector 1740 attached to lighting apparatus 1710. All additional functionality and design that is or may be included in lighting apparatus 1610, including the rotation of the reflector, may be used equally within this design.

Lighting apparatus 1710 includes a notch 1756 with electrical contacts that allow for attachment of complimentarily configured light source 1760 at various points vertically along the notch, as illustrated in FIG. 47. This design allows light source 1760 to be positioned at several vertical points in a reflective interior space 1754 defined by reflector 1740, including at a focal point 1752 defined by reflector 1740. An end cap 1762 of light source 1760 may be inserted into the top of the electrical contacts of notch 1756 and a user may manually move light source 1760 vets calls to achieve various intensities and angles of illumination. This design provides specific benefit over light sources that must be twisted or rotated to vertically adjust inside a lighting apparatus or fixture.

Although lighting apparatus 1610 and lighting apparatus 1710 are listed as separate embodiments implementing a part of the inventive subject matter of this disclosure, this disclosure specifically contemplates embodiments that implement the functionality of both embodiments. Specifically, lighting apparatuses that implement any combination of rotating reflectors, reflectors that are able to move along length of the lighting apparatus, and/or light sources that are able to move vertically inside the reflector are equally within this disclosure.

Figure 51:
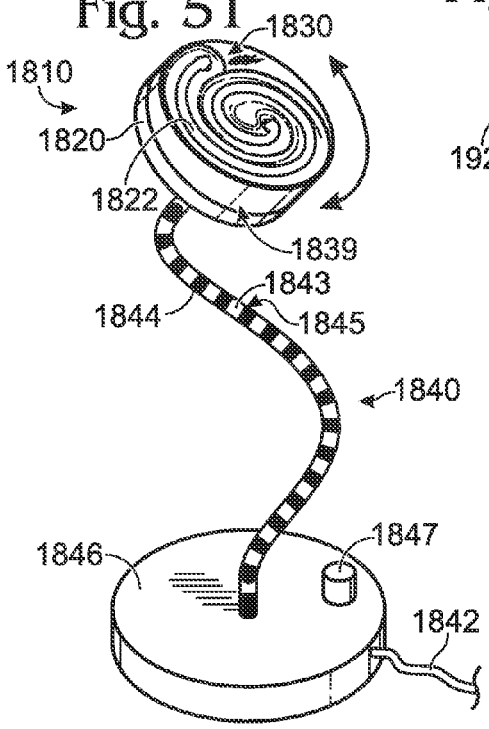
FIG. 51 is a perspective view of an example of a spiral light source and reflector mounted in a fixture including a flexible stem.

With reference to FIG. 51, a lighting apparatus 1810 includes a base 1846, an adjustable support defining a flexible stem 1844, a wire 1842, and a lighting enclosure 1820, which includes a light source 1822, a reflector 1830, and a circuit 1839. Lighting apparatus 1810 is designed to allow adjustment of the angle and position of the lighting enclosure 1820 to target a variety of target illumination areas. Additionally, reflector 1830 substantially implements parts of this disclosure relating to using reflectivity to more efficiently illuminate a target illumination area.

As can be seen in FIG. 51, flexible stem 1844 is connected to base 1846 on one end, and is connected to and substantially supports lighting enclosure 1820 on the opposite end. Flexible stern 1844 is specifically designed with a certain amount of flexibility that allows a user to position lighting enclosure 1820 at different positions and angles. Additionally, base 1846 and flexible stern 1844 are designed to cooperatively support lighting enclosure 1820 in a particular position when not being manipulated by a user.

FIG. 51 illustrates base 1846 that defines a substantially circular body. Base 1846 is weighted and is designed to provide a foundation for flexible stem 1844 and lighting enclosure 1820.

Bases according to this disclosure do not need to take the form specifically illustrated in FIG. 51. The heart of the inventive subject matter of this disclosure is directed to any base design capable of supporting the lighting enclosure and flexible stem. Potential alternative base designs may include, but are not limited to, clips, tripods, or designs including a direct attachment of the flexible stem to an external body, such as a piece of furniture.

Flexible stem 1844, as illustrated in FIG. 51, is connected to base 1846 on one end and lighting enclosure 1820 on the opposite end. As previously stated, flexible stem 1844 has two primary functions: allowing adjustment of lighting enclosure 1820's position and angle, and substantially supporting lighting enclosure 1820 in position when not being adjusted.

Flexible stem 1844 substantially defines a series of bodies 1843 connected by swivel points 1845. Swivel points 1845 allow bodies 1843 to rotate at the point where swivel points 1845 and bodies 1843 connect. Swivel points 1845 and bodies 1843 collectively define a substantially flexible and rotatable stem. Flexible stem 1844 additionally includes a primary swivel point (not shown), connected between the body most proximate lighting enclosure 1820 and lighting enclosure 1822, which allows for greater flexibility and rotation than lighting apparatus 1810's other swivel points.

Flexible stems, including flexible stem 1844, according to this disclosure may be designed to adjust the attached lighting enclosure to any position within the flexible stem's length. Additionally, flexible stems may allow lighting enclosure to be positioned in any angle.

Lighting apparatus 1810 additionally includes a wire 1842 electrically connected to an external power source on one end and light source 1822 on the opposite end. Prior to reaching light source 1822, wire 1842 is routed through base 1846 and a switch 1847.

Switch 1847 is attached at a position along the length of wire 1842. Switch 1847 is additionally attached to the top of base 1846. Switch 1847 is primarily designed to control the intensity of light source 1822's output. Specifically, switch 1847 defines a potentiometer designed to gradually change the intensity of light source 1822's output by controlling the amount of power delivered to light source 1822. Switches that define electronic switches and three way switches are equally within this disclosure. This disclosure also specifically contemplates lighting sources that do not include switches.

Switch 1847 is positioned on the top of base 1846, but switches may be placed in other areas as well. Specifically, this disclosure contemplates switches placed at any point along the length of the wire, including switches that are additionally attached to the base, lighting enclosure, or adjustable support.

In the segment of wire 1842 between switch 1847 and lighting enclosure 1820, wire 1842 is routed through base 1846 and the center of flexible support 1844. However, this design is not specifically required. Wires may take any path between both the external power source and the switch and/or base. Additionally, wires may take any path between the switch and/or base and the lighting enclosure. Potential routes of the wire specifically include any combination of interior and exterior segments, including wholly exterior wires. Additionally or alternatively, this disclosure specifically contemplates wires that are not connected to the base and/or switch, particularly in lighting apparatuses not including a switch.

Figure 54:
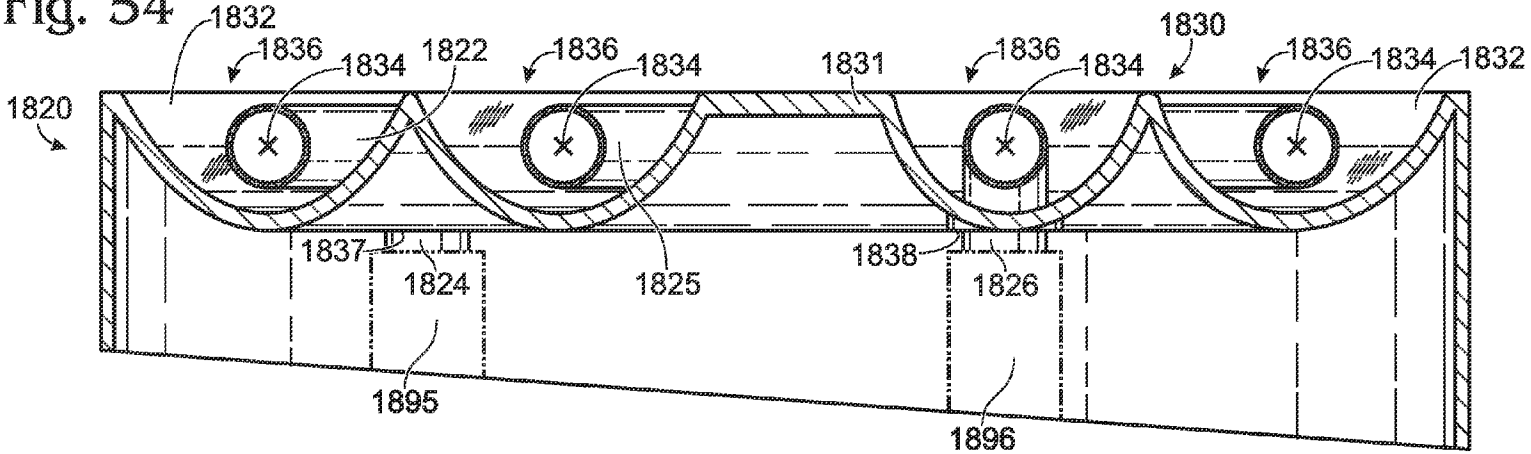
FIG. 54 is a side elevation view of a cross section taken about line 54-54 in FIG. 53.

As seen in FIGS. 51 and 54, lighting enclosure 1820 includes a light source 1822, a reflector 1830, a first socket 1895, a second socket 1896, and a circuit 1839. Lighting enclosure 1820 is affixed to flexible stem 1844 and is designed to support and electrically connect light source 1822. Lighting enclosure is generally supported in position by flexible stem 1844. Specifically, lighting enclosure 1820 is connected to flexible stem 1844 on the end opposite base 1846. Lighting enclosure 1820 is constructed of a metal, but lighting enclosures made of a plastic or a metal are both equally within this disclosure.

Figure 53:
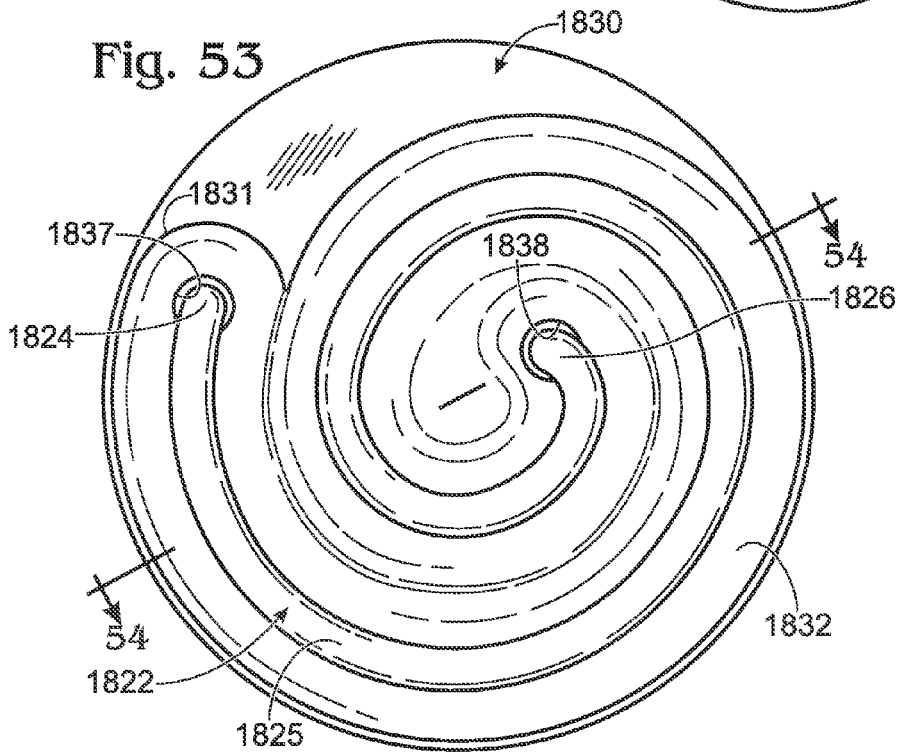
FIG. 53 is a top view of the spiral light source and reflector depicted in the fixture shown in FIG. 51.

Reflector 1830, illustrated in FIGS. 51, 53, and 54, is supported by lighting enclosure 1820 and is positioned between light source 1822 and the remainder of lighting enclosure 1820. Reflector 1830 includes two layers, a support layer 1831 and a reflective surface 1832. Support layer 1831 defines a thin supporting positioned below reflective surface 1832. Support layer 1831 is designed to maintain reflective surface 1832's shape and position relative to light source 1822.

Reflective surface 1832 in lighting apparatus 1810 defines a thin dust-free coating applied to the top of the support surface. This surface may be applied to either plastic or metal support layers. This surface may be made of any previously disclosed reflective material or materials. Additionally, reflective surface 1832 may define a single layer, or a plurality of several layers composed of varying materials.

As shown in FIG. 53, reflective surface 1832 and support layer 1831 additionally include a first electrode hole 1837 and a second electrode hole 1838, which are complimentarily configured with light source 1822 to allow the transmission of energy to the light source. First electrode hole 1837 and second electrode hole 1838 are substantially positioned in line with first socket 1895 and second socket 1896, respectively.

Support layer 1831 substantially defines a metal body with a compound parabolic reflector shape, illustrated in detail in FIGS. 53 & 54. This layer provides the shape and support for reflective surface 1832. Although support layer 1831 in the example shown in FIGS. 51, 53, and 54 is metal, plastic support layers are equally within this disclosure.

Reflective surface 1832, as seen in FIGS. 53 & 54, substantially defines series of connected recesses in the shape of parabolas. Reflector 1830 defines a reflective interior space 1836 and a series of focal points 1834 that substantially follow the lateral center of the compound reflective recess along its length. Reflective interior space 1836 is defined in this example, as described in other disclosed examples, as the area enclosed by a reflective surface.

FIG. 54 illustrates reflective interior space 1836 by arrows positioned directly above the recesses of reflector 1830, but this is done merely to better illustrate that light source 1822 is positioned within reflective interior space 1836. However, reflective interior space 1836, similar to other reflective interior spaces, defines an infinite projection of the entirety of reflector 1830.

Each focal point 1834 in the series defined by reflector 1830 is found as the radius squared divided by four times the depth, the radius and depth referring to the parabolic shape seen in the cross section illustrated in FIG. 54. The series of focal points comprises all such points through the length of the spiral of the compound parabolic reflector.

Figure 55:
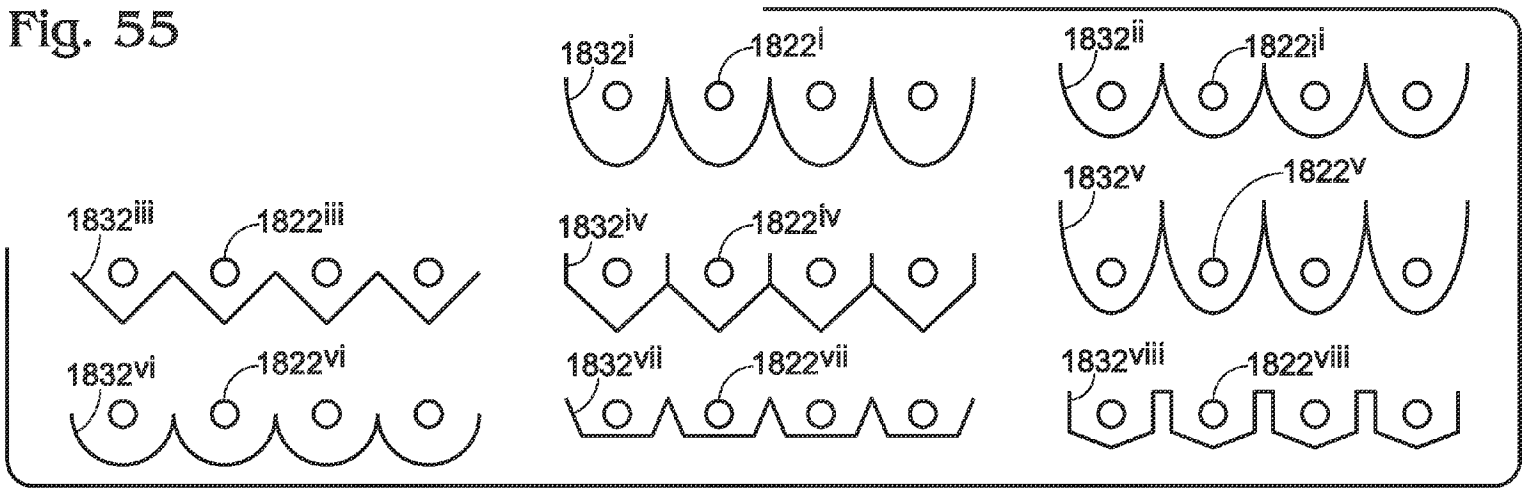
FIG. 55 depicts a variety of reflector profiles examples illustrated as side elevation views of cross sections of the reflector surfaces taken transverse the longitudinal axis.

Although the cross section of reflective surface 1832 substantially defines a parabola in this example, lighting apparatuses according to this disclosure are not specifically required to have this design. As an example, a cross section of the reflective surface may substantially define any of the shapes illustrated in FIG. 25A repeated in series in a parabola, similar to the use of the parabola in the compound parabola design. FIG. 55 illustrates several examples of compound reflectors, viewed in cross section from an orientation similar to the view of reflector 1830 illustrated in FIG. 54.

In particular, FIG. 55 depicts a surface $1832^{i}$ surrounding a light source $1822^{i}$, a reflective surface $1832^{ii}$ surrounding a light source $1822^{ii}$, a reflective surface $1832^{iii}$ surrounding a light source $1822^{iii}$, a reflective surface $1832^{iv}$ surrounding a light source $1822^{iv}$, a reflective surface $1832^{v}$ surrounding a light source $1822^{v}$, a reflective surface $1832^{vi}$ surrounding a light source $1822^{vi}$, a reflective surface $1832^{vii}$ surrounding a light source $1822^{vii}$, and a reflective surface $1832^{viii}$ surrounding a light source $1822^{viii}$.

The designs illustrated in FIG. 55 include tightly packed compound designs, but should not be read to limit reflectors to such designs. This disclosure contemplates reflectors based on various shapes, with no limitation on the size of the gaps in each individual shape. Each of these designs may have a series of focal points or effective focal points, and the manner of finding each is previously disclosed.

Though this disclosure identifies the benefits of using reflectors with compound shapes, this disclosure specifically contemplates lighting apparatuses implementing other reflector shapes, including all previous reflector designs described in this disclosure. As a specific example, this disclosure contemplates the use of lighting apparatuses including adjustable supports, such as a flexible stem, with all previously disclosed focal point lighting apparatus designs.

Light source 1822 substantially defines a compact fluorescent lamp with a substantially spiral shape. In this specific design, the spiral shape of light source 1822 is complimentarily configured with the spiral shape of reflector 1830.

Light source 1822 includes a lighting element 1825, which defines a tube that is connected on each of its terminal ends to a first electrode 1824 and a second electrode 1826. Lighting element 1825 is filled with a gas that produces light when exposed to an electric current, but any type of light source may be used. This disclosure specifically contemplates the use of filament based lighting elements.

First electrode 1824 and second electrode 1826 are designed to be routed through first electrode hole 1837 and second electrode hole 1838. First electrode 1824 and second electrode 1826 are electrically connected to circuit 1839 via first socket 1895 and second socket 1896. When tight source 1820's first electrode 1824 is inserted through first electrode hole 1837, second electrode 1826 is inserted through second electrode hole 1838, and they are plugged in to their corresponding sockets in lighting enclosure 1820. When plugged in, first socket 1895 and second socket 1896 support light source 1822 substantially near focal point 1834.

Although light source 1822 is substantially spiral shaped, this design is not specifically required. This disclosure contemplates the use of light sources of any shape generally understood in the art. In such designs, appropriate modifications to the lighting enclosure are contemplated. As a non-limiting, illustrative example, a lighting apparatus implementing an incandescent bulb may include a single socket in the center of the reflector, rather than the two socket design in lighting apparatus 1810.

Light source 1822 and reflector 1830 are illustrated in FIG. 54 with the positive terminals proximate the perimeter of the reflector and the negative terminals proximate the center of the reflector; however, this specific design is not required. This disclosure contemplates no specific limitation as to the physical location of any of a light source's terminals or any corresponding holes in an associated reflector.

Circuit 1839 is contained within body 1821, and is operationally attached to wire 1842 between light source 1822 and an external power source. Circuit 1839 primarily functions to convert power from an external source transferred from an external power source for use with light source 1822. Circuit 1839 is additionally connected to sockets 1895 and 1896, which are used to connect and support light source 1822. Circuit 1839 defines a ballast; however, any combination of circuit elements may be used.

Additionally or alternatively, this disclosure specifically contemplates the use of bulbs that adjust the spectrum and/or intensity illumination. As specific examples, lighting apparatuses may implement dimmer bulbs, three way adjustable bulbs, fixed wattage bulbs, or other technologies generally understood to adjust the intensity of the output of a light source. In embodiments including such functionality, this disclosure specifically contemplates the use of switches that are complimentarily configured with the bulb implementing these technologies.

Figure 52:
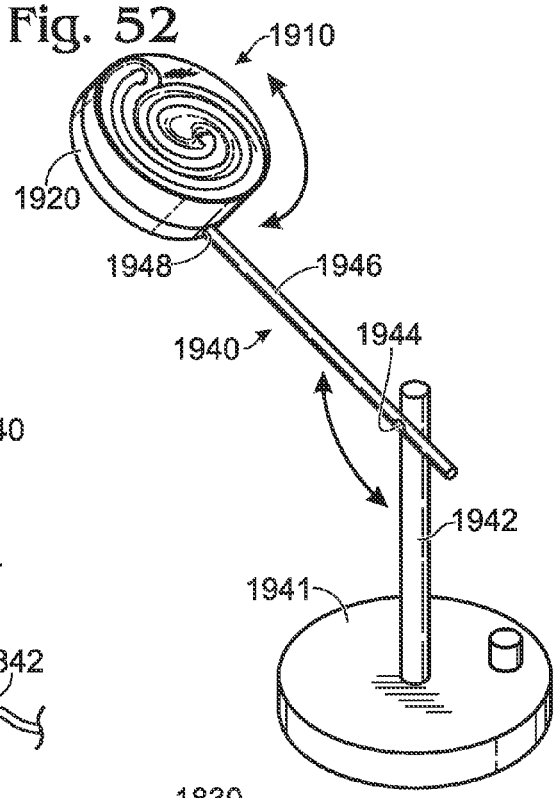
FIG. 52 is a perspective view of an example of a spiral light source mounted in a fixture including a pivoting stem.

Turning attention to FIG. 52, a second example of a lighting apparatus 1910 will now be described. Lighting apparatus 1910 includes many similar or identical features to lighting apparatus 1810. Thus, for the sake of brevity, each feature of lighting apparatus 1910 will not be redundantly explained. Rather, key distinctions between lighting apparatus 1910 and lighting apparatus 1810 will be described in detail and the reader should reference the discussion above for features substantially similar between the two lighting apparatus.

As can be seen in FIG. 52, lighting apparatus 1910 includes a support 1940 and a lighting enclosure 1920, which includes a light source 1922, a reflector 1930, and a circuit 1939. The primary difference between the lighting apparatus 1910 and lighting apparatus 1810 lies the pivoting support design of support 1940 illustrated in FIG. 52.

Whereas lighting apparatus 1810 is substantially supported by a flexible stem connected to a base, lighting apparatus 1910 includes a support 1940, which includes a first rotation point 1948, a first bar 1946, a second rotation point 1944, a second bar 1942, and base 1941. Support 1840 serves to support lighting enclosure 1910 in position, while allowing lighting enclosure 1910 to be adjusted by moving and/or rotating it at the rotation points. Specifically, the rotation points are designed to allow certain movement of the elements at the rotation points while a user applies manual pressure. However, the rotation points are designed to substantially maintain lighting enclosure 1910's position while the user applies no pressure.

Lighting enclosure 1910 is connected to first bar 1946 by way of first rotation point 1948. First rotation point 1948 allows lighting enclosure 1920 to rotate around an axis defined by the length of first bar 1946.

First bar 1946 is connected to second bar 1942 by second rotation point 1944. Second rotation point 1944 is designed to allow first bar 1946 to rotate around an axis perpendicular to the intersection of first bar 1946 and second bar 1942.

Second bar 1942 is connected to a third rotation point at the center of base 1941 on the end of second bar 1942 opposite second rotation point 1944. Second bar 1942 is connected to base in a manner that allows second bar 1942 to rotate around an axis defined by the center of base 1941.

The difference in support design and the supports relation to other elements are the primary variations between lighting apparatus 1810 and lighting apparatus 1910. As a result, the remaining elements of lighting apparatus 1910 are substantially similar to the related elements of lighting apparatus 1810. Additionally or alternatively, an of the disclosed variations of lighting apparatus 1810 may be equally implemented with respect to lighting apparatus 1910. Specifically, lighting apparatuses similar to lighting apparatus 1910 may include the various wire arrangements previously disclosed.

Although not specifically illustrated, lighting apparatuses implementing pivoting supports similar to 1910 may include any of the features described in connection with lighting apparatus 1810. This disclosure specifically contemplates the use of compound reflectors, wires, switches, and circuits, as described in connection with lighting apparatus 1810 and other similar lighting apparatuses, in connection with such lighting apparatuses implementing pivoting supports.

With reference to FIGS. 56-60, a lighting apparatus 2000 will now be described. Lighting apparatus 2000 includes a reflector 2030, a first endcap 2010 connected to reflector 2030 on a first end of reflector 2030, a second endcap 2020, biasing member 2070, a coupling interface 2052, and a pair of strap rings 2080.

Figure 59:
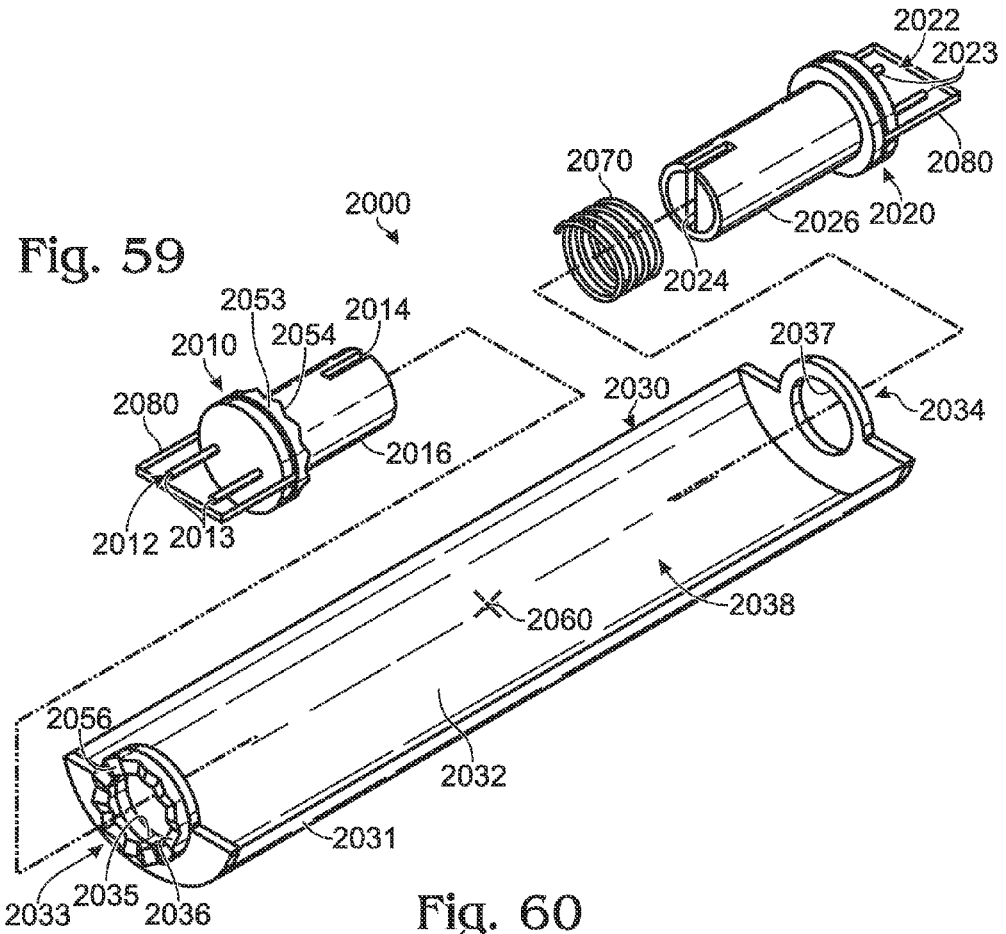
FIG. 59 is an exploded view of the adapter for lighting apparatuses shown in FIG. 1.

Reflector 2030 extends longitudinally between first endcap 2010 and second endcap 2020. As shown in FIG. 59, reflector 2030 includes a curved body 2031, a first bearing 2033, and a second bearing 2034. Curved body 2031 includes a reflective interior surface 2032 partially enclosing a reflective interior space 2038.

First hearing 2033 is located on a first end of reflector 2030 and defines a first endcap aperture 2035. Second bearing 2034 is located on a second end of reflector 2030 opposite the first end. Second bearing 2034 defines a second endcap aperture 2037.

As shown in FIG. 59, first bearing 2033 includes a bearing flange 2056 with bearing gear teeth 2036 projecting towards first endcap 2010. Bearing flange 2056 surrounds first endcap aperture 2035.

Reflective interior surface 2032 substantially defines a parabola when viewing a cross section taken transverse to reflective interior surface 2032's longitudinal axis. Reflective interior surface 2032 additionally defines a focal point 2060 within reflective interior space 2038 located at a distance of the radius of reflective interior surface 2032 squared and then divided by two from the vertex of reflective interior surface 2032. Focal point 2060 is representative of a series of focal points that extend longitudinally within reflector 2030.

Reflective interior surface 2032 is made of a dust resistant reflective material. This disclosure contemplates such dust free metallic materials included within reflective surfaces as the primary surface material or as a coating applied to the surface material. However, reflective interior surfaces according to this disclosure may implement any reflective surface, and a dust resistant reflective material is not required.

As FIGS. 56-58 show, lighting apparatus 2000 includes first endcap 2010 positioned near the first bearing of reflector 2030. First endcap 2010 includes a first electrode 2012, a cap flange 2053 defining cap gear teeth 2054, and a first shaft 2016.

First endcap 2010 includes a first electrode 2012 that defines bi-pins 2013 aligned in a first electrode plane on a first side of first endcap 2010 opposite reflector 2030.

First shaft 2016 projects from a second side of first endcap 2010 opposite the first side and is configured to be routed through first endcap aperture 2035. First endcap 2010 is connected to reflector 2030 by routing first shaft 2016 though first endcap aperture 2035, which allows reflector 2030 to rotate around first endcap 2010.

First endcap 2010 additionally includes a first shaft slot 2014 positioned substantially at the end of first shaft 2016 that projects through into first endcap aperture 2035. First shaft slot 2014 extends transverse to the first electrode plane. First shaft slot 2014 is configured to receive an electrode pin of a light source and to position the light source substantially near focal point 2060.

First endcap 2010 additionally includes a circuit (not pictured) electrically connected to a first electrode 2012. The circuit is configured to convert electrical energy from the first lead to a selected voltage and current to be used with a connected light source. First shaft slot 2014 is electrically connected to the circuit opposite a first electrode 2012.

Second endcap 2020 is positioned near second bearing 2034 of reflector 2030. Second endcap 2020 includes a second electrode 2022 and a second shaft 2026.

Second electrode 2022 defines bi-pins 2023 aligned in a second electrode plane on a first side of second endcap 2020 opposite reflector 2030. A first electrode 2012 and second electrode 2022 are collectively configured to couple lighting apparatus with external lighting fixtures configured to receive bi-pins 2013 and bi-pins 2023.

Second shaft 2026 projects from a second side of second endcap 2020 opposite the first side configured to be routed through second endcap aperture 2037. Second endcap 2020 is connected to reflector 2030 by routing second shaft 2026 though second endcap aperture 2037, which allows reflector 2030 to rotate around second endcap 2020.

Second endcap 2020 additionally includes a second shaft slot 2024 positioned substantially at the end of second shaft 2026 that projects through second endcap aperture 2037. Second shaft slot 2024 extends transverse to the second electrode plane. Second shaft slot 2024 is configured to receive an electrode pin of a light source and to position the light source substantially near focal point 2060.

First shaft slot 2014 and second shaft slot 2024 are configured to support a light source that includes a first electrode defining a bi-pin complimentarily configured with first shaft slot 2014 and a second electrode defining a bi-pin complimentarily configured with second shaft slot 2024. First shaft slot 2014 and second shaft slot 2024 are additionally configured to support the light source substantially near focal point 2060.

First shaft slot 2014 and second shaft slot 2024 are electrically connected to an external power source through a first electrode 2012 and second electrode 2022, respectively, and are configured to electrically communicate power to the light source.

First shaft slot 2014 and second shaft slot 2024 allow a connected light source to move vertically within them, such that the electrodes of a connected light source remain in contact with electrical contacts contained within the slots as the connected light source's position is vertically adjusted. As a connected light source moves vertically within first shaft slot 2014 and second shaft slot 2024, the light source continues to draw power from contacts within the slots and remains illuminated.

As shown in FIGS. 56-59, lighting apparatus 2000 includes a biasing member 2070 defining a spring. Biasing member 2070 is mounted between reflector 2030 and second endcap 2020 and biases reflector 2030 towards first endcap 2010. Though biasing member 2070 defines a spring in this example, biasing members may be any member configured to bias a reflector 2030 towards first endcap 2010, including springs, coils, or non-rigid solid materials.

Figure 60:
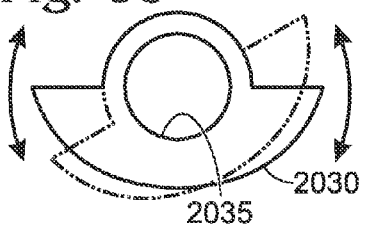
FIG. 60 is a side elevation view of a reflector of the adapter for lighting apparatuses shown in FIG. 1 depicting its rotational adjustability.

As shown in FIG. 60, reflector 2030 is configured to rotate about first endcap aperture 2035. When a light source is supported within first shaft slot 2014 and second shaft slot 2024 substantially near focal point 2060, reflector 2030 rotates around the light source. FIG. 60 illustrates an elevation view of reflector 2030 with arrows indicating the direction of rotation and a dashed representation of reflector 2030 illustrating a previous position.

As FIGS. 56-59 illustrate, first endcap 2010 and reflector 2030 selectively couple at coupling interface 2052. Cap flange 2053 of first endcap 2010 includes cap gear teeth 2054 for engaging reflector 2030. Likewise, reflector 2030 includes a bearing flange 2056 surrounding first endcap aperture 2035 defining complimentary bearing gear teeth 2036 configured to interlock with cap gear teeth 2054.

Reflector 2030 may be rotated by slightly moving it slightly away from first endcap 2010 in a longitudinal direction towards second endcap 2020 to disengage the intermeshed gear teeth. When reflector 2030 is interlocked with first endcap 2010, the position of bearing flange 2056 relative to first endcap 2010 remains substantially fixed. In turn, reflector 2030 is held in position when cap gear teeth 2054 are intermeshed with bearing gear teeth 2036. When reflector 2030 is not presently being manipulated by a user, biasing member 2070 biases reflector 2030 towards first endcap 2010, to a position where cap flange 2053 and bearing flange 2056 are substantially interlocked.

Reflector 2030 is preferably rotated by gripping and manipulating curved body 2031. Additionally or alternatively, a user may grip and manipulate first bearing 2033 or second bearing 2034. Additionally, in some examples, bearing flange 2056 may be large enough to extend over the top portion of first bearing 2033 to allow easier manipulation by the user. Bearings and/or flanges according to this disclosure may additionally be constructed of a substantially non-conductive material.

A first electrode 2012 and second electrode 2022 are illustrated with a bi-pin configuration, but this specific design is not required. The specific form of leads is not material to the inventive subject matter of this disclosure, and such leads may be configured for use with any lighting fixture, external power source, or support generally understood in the art.

Strap rings 2080 are rotatably attached to the endcaps of lighting apparatus 2000. Strap rings 2080 support the attachment of lighting apparatus 2000 to complimentary lighting fixtures. However, including strap rings is not material to the inventive subject matter of this disclosure, and adapters with and without strap rings are both equally within this disclosure.

The adjustability of reflector 2030 allows the user of lighting apparatus 2000 greater flexibility in choosing target illumination areas and in better targeting a target illumination area.

Lighting apparatus 2000 includes first shaft slot 2014 and second shaft slot 2024 configured to support a single light source including electrodes defining mini bi-pin connectors. However, neither the type of light source electrode connector nor the using a single light source within a reflector are material to the primary inventive subject matter of this disclosure. For example, this disclosure specifically contemplates the use of small and medium bi-pin connectors.

Figure 61:
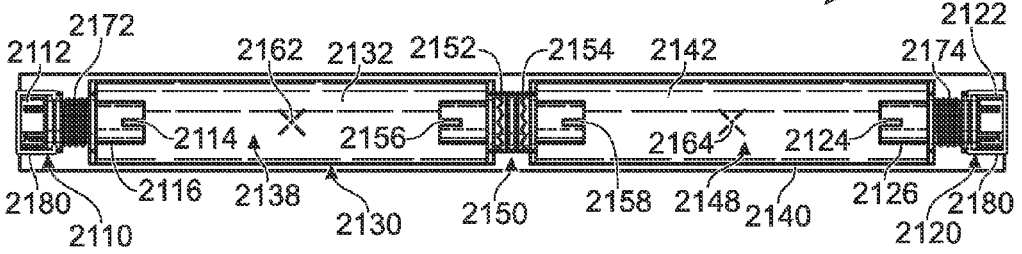
FIG. 61 is a top view of a second example of an adapter for lighting apparatuses that includes a second adjustable reflector.

Turning attention to FIG. 61, a second example of a lighting apparatus 2100 will now be described. Lighting apparatus 2100 includes many similar or identical features to lighting apparatus 2000 combined in unique and distinct ways. Thus, for the sake of brevity, each feature of lighting apparatus 2100 will not be redundantly explained. Rather, key distinctions between lighting apparatus 2100 and lighting apparatus 2000 will be described in detail and the reader should reference the discussion above for features substantially similar between the two adapters.

As can be seen in FIG. 61, lighting apparatus 2100 includes two adjustable reflectors similar to those seen in lighting apparatus 2000.

Specifically, lighting apparatus 2100 includes a first endcap 2110, a middle element 2150, a first reflector 2130 connected between first endcap 2110 and middle element 2150, a second endcap 2120, a second reflector 2140 connected between middle element 2150 and second endcap 2120.

First reflector 2130 is substantially similar to reflector 2030, and similarly defines a first focal point 2162 within a first reflector interior space 2138. First reflector 2130 additionally includes endcap openings positioned at each of its ends.

Second reflector 2140 is substantially similar to reflector 2030, and similarly defines a second focal point 2164 within a second reflector interior space 2148. Second reflector 2140 additionally includes endcap openings positioned at each of its ends.

First endcap 2110 includes a first lead 2112, first socket 2114, and first shaft 2116, which are substantially similar to a first electrode 2012, first shaft slot 2014, and first shaft 2016, respectively. First endcap 2110 differs from first endcap 2010, however, in that it includes a first biasing member 2172 positioned on first shaft 2116 rather than a set of interlocking gear teeth. First shaft 2116 is configured to be routed through the endcap opening on one end of first reflector 2130 such that first biasing member 2172 is positioned on first shaft 2116 in the area between first reflector 2130 and the primary body of first endcap 2110.

Second endcap 2120, likewise, includes a second lead 2122, second light socket 2124, and second shaft 2126, which are substantially similar to second electrode 2022, second shaft slot 2024, and second shaft 2026, respectively. Second endcap 2120 differs from second endcap 2020, however, in that it includes a second sprig 2174 positioned on second shaft 2126, rather than a set of gear teeth. Second shaft 2126 is configured to be routed through the endcap open on one end of second reflector 2140 such that second spring 2174 is positioned on second shaft 2126 in the area between second reflector 2140 and the primary body of second endcap 2120.

As FIG. 61 shows, lighting apparatus 2100 additionally includes middle element 2150, which substantially defines a shaft that is routed through first reflector 2130 at the end opposite first endcap 2110 and to second reflector 2140 at the end opposite second endcap 2120. Middle element 2150 includes a set of first set of interlocking members 2152 positioned on the side proximate first reflector 2130 and a set of second set of interlocking members 2154 positioned on the side proximate second reflector 2140. Middle element 2150 additionally includes a first middle socket 2156 on the end routed through first reflector 2130 that is complimentarily configured with first socket 2114 and a second middle socket 2158 on the end routed through second reflector 2140 complimentarily configured with second light socket 2124.

First set of interlocking members 2152 and second set of interlocking members 2154 are configured with an interlocking design similar to coupling interface 2052.

Lighting apparatus 2100 is configured to operate light sources within adjustable reflectors similar to lighting apparatus 2000. Specifically, first socket 2114 and first middle socket 2156 are configured to support a light source substantially near first focal point 2162. Additionally, second light socket 2124 and second middle socket 2158 are configured to support a light source substantially near second focal point 2164.

First reflector 2130 and second reflector 2140 are rotatably adjustable, similar to reflector 2030, each reflector, gear teeth, and spring combination functioning substantially similar to those seen in lighting apparatus 2000. The four light sockets included on lighting apparatus 2100 additionally allow vertical adjustment of connected light sources, also similar to lighting apparatus 2000.

Reflector 2030, first reflector 2130, and second reflector 2140 substantially define parabolas when viewed from a cross section transverse to their longitudinal axis, but this design is not specifically required. Reflective surfaces may define any circular or elliptical segment, parabolas, or regular polygons when viewed from such a cross section. Additionally, reflective surfaces that define paraboloids or other convex three dimensional shapes are equally within this disclosure.

Additionally, the focal points defined by various reflector shapes may be determined by a variety of focal point calculations. This disclosure includes several such focal point calculation that may be applied to designs similar to lighting apparatus 2000 and lighting apparatus 2100 that implement different reflector shapes. As a specific example, reflector designs for which the focal point location is difficult to calculate, including polygonal reflectors, an effective focal point that is an approximation of the reflector's true focal point may be used to position the light source. Other reflector shapes define focal points which are defined in the way generally understood in the art.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that art, believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

I claim:

1. A lighting apparatus, comprising:

a first endcap including a cap flange defining cap gear teeth and a first shaft extending from the cap flange;

a second endcap including a second shaft extending toward the first endcap;

a first electrode attached to the first endcap opposite the first shaft;

a second electrode attached to the second endcap opposite the second shaft; and a reflector including:

a first bearing proximate the first endcap and defining a first aperture to receive the first shaft, the first bearing including a bearing flange with bearing gear teeth facing the first endcap and configured to intermesh with the cap gear teeth;

a second bearing proximate the second endcap and defining a second aperture to receive the second shaft; and a curved body defining a reflective interior surface;

wherein the first shaft and the second shaft are configured to cooperatively support a light source.

2. The lighting apparatus of claim 1, further comprising:

a circuit within the first endcap and electrically connected to the first electrode, the circuit being configured to convert electrical energy from the first electrode to a selected voltage acid current.

3. The lighting apparatus of claim 1, wherein the first electrode includes first bi-pins aligned in a first plane and the first shaft includes a first shaft pin slot extending transverse to the first plane; and wherein the second electrode includes second bi-pins aligned in a second plane and the second shaft includes a second shaft pin slot extending transverse to the second plane; and wherein the first shaft pin slot is configured to receive a first light source electrode on a first end of the light source and the second shaft pin slot is configured to receive a second light source electrode on a second end of the light source opposite the first end of the light source.

4. The lighting apparatus of claim 3, wherein the first shaft pin slot and the second pin slot cooperate to support adjustment of the vertical position of the light source while delivering power to the light source.

5. The lighting apparatus of claim 3, wherein the first shaft pin slot defines mini pin slot; and wherein the second shaft pin slot defines a mini pin slot.

6. The lighting apparatus of claim 3, wherein the first shaft pin slot defines a medium pin slot; and wherein the second shaft pin slot defines a medium pin slot.

7. The lighting apparatus of claim 1, wherein the first shaft and the second shaft are complimentarily configured to support a light source substantially near a focal point defined by the reflective interior surface.

8. The lighting apparatus of claim 1, further comprising:

a first strap ring attached to the first endcap; and a second strap ring attached to the second endcap;

wherein the first strap ring and the second strap ring cooperate to attach the lighting apparatus to an external lighting fixture.

9. The lighting apparatus of claim 8, wherein the first strap ring is rotatably attached to the first endcap, and wherein the second strap ring is rotatably attached to the second endcap.

10. The lighting apparatus of claim 1, wherein the reflector is configured to rotate around the first endcap by a user gripping the reflector.

11. The lighting apparatus of claim 1, further comprising a biasing member mounted between the reflector and the second endcap, the biasing member biasing the reflector towards the first endcap to intermesh the bearing gear teeth and the cap gear teeth.

12. The lighting apparatus of claim 11, wherein the biasing member is a spring.

13. The lighting apparatus of claim 1, wherein the cross section of the reflective interior surface transverse its longitudinal axis substantially defines a parabola.

14. The lighting apparatus of claim 1, wherein the cross section of the reflective interior surface transverse its longitudinal axis substantially defines a portion of a regular polygon.

15. The lighting apparatus of claim 1, wherein the reflective interior surface includes a dust resistant metallic material.

16. A lighting apparatus, comprising:

a first endcap including a lead complimentarily configured with an external power source on a first side of the first endcap and a light socket on a second side of the first endcap opposite the first side;

a second endcap spaced from the first endcap and including a lead complimentarily configured with an external power source on a first side of the second endcap and a second light socket on a second side of the second endcap opposite the first side;

a middle element positioned substantially near the midpoint between the first endcap and the second endcap;

a first reflector rotatably attached to the first endcap and to the middle element, the reflector including a first reflective surface that partially encloses a first interior space and defines a first focal point within the first interior space; and a second reflector rotatably attached to the middle element and to the second endcap, the reflector including a second reflective surface that partially encloses a second interior space and defines a second focal point within the second interior space;

wherein the first endcap and middle element are configured to support a first light source substantially near the first focal point;

wherein the second endcap and middle element are configured to support a second light source substantially near the second focal point;

wherein the first reflector is configured to move longitudinally relative to the first light source; and wherein the second reflector is configured to move longitudinally relative to the second light source.

17. A lighting apparatus, comprising;

a first endcap including a cap flange defining cap gear teeth and a first shaft extending from the cap flange;

a second endcap including a second shaft extending toward the first endcap;

a reflector including:

a first bearing proximate the first endcap and defining a first aperture to receive the first shaft, the first bearing including a bearing flange with bearing gear teeth facing the first endcap and configured to intermesh with the cap gear teeth;

a curved body defining a reflective interior surface, a reflector interior space that is partially enclosed by the reflective interior surface, and a focal point within the reflector interior space;

a second bearing proximate the second endcap and defining a second aperture to receive the second shaft; and a first shaft slot on a first end of the first shaft positioned within the reflective interior space extending transverse to the longitudinal axis of the reflector;

a second shaft slot on a first end of the second shaft positioned within the reflective interior space extending transverse to the longitudinal axis of the reflector; and wherein the first shaft slot is configured to receive a first electrode on a first end of a light source; and wherein the second shaft slot is configured to receive a second electrode on a second end of the light source opposite the first end.

18. The lighting apparatus of claim 17, further comprising a spring mounted between the reflector and the second endcap, the spring biasing the reflector towards the first endcap to intermesh the bearing gear teeth and the cap gear teeth.

19. The lighting apparatus of claim 17, further comprising:

a first strap ring rotatably attached to the first endcap; and a second strap ring rotatably attached to the second endcap;

wherein the first strap ring and the second strap ring are collectively assist the attachment of the lighting apparatus to an external lighting fixture.

20. The lighting apparatus of claim 17, wherein the reflector is configured to rotate around the first endcap by a user gripping the first bearing.

* * * * *